US010037005B2

(12) United States Patent
Lecher

(10) Patent No.: US 10,037,005 B2
(45) Date of Patent: Jul. 31, 2018

(54) METHODS USING A SERIES OF SEQUENTIAL TIMEKEEPING PERIODS

(71) Applicant: Donald J. Lecher, Atlanta, GA (US)

(72) Inventor: Donald J. Lecher, Atlanta, GA (US)

( * ) Notice: Subject to any disclaimer, the term of this patent is extended or adjusted under 35 U.S.C. 154(b) by 0 days.

(21) Appl. No.: 15/284,487

(22) Filed: Oct. 3, 2016

(65) Prior Publication Data

US 2017/0090425 A1 Mar. 30, 2017

Related U.S. Application Data

(62) Division of application No. 13/868,080, filed on Apr. 22, 2013, now Pat. No. 9,459,590.

(51) Int. Cl.
*G04B 19/16* (2006.01)

(52) U.S. Cl.
CPC ..... *G04B 19/16* (2013.01)

(58) Field of Classification Search
CPC .... G04B 19/16; G04B 19/163; G04B 19/166; G04B 19/10; G04B 19/20
See application file for complete search history.

(56) References Cited

U.S. PATENT DOCUMENTS 395,696 A * 1/1889 Ethridge ..... G04B 19/163 368/231
2,764,828 A * 10/1956 Wolaver ..... G04B 19/2536 368/37
3,518,825 A 7/1970 Nissen
4,674,889 A 6/1987 Klaus
4,723,232 A 2/1988 Beebe
4,740,934 A 4/1988 Noirjean
5,051,968 A 9/1991 Calabrese
5,068,837 A 11/1991 Lowrance
5,349,572 A 9/1994 Belik
5,687,140 A 11/1997 Sekine et al.
5,699,321 A 12/1997 Vaucher
6,018,503 A 1/2000 Pfister et al.
6,842,404 B2 1/2005 Haselberger
7,113,450 B2 9/2006 Plancon et al.
7,215,601 B2 5/2007 Plancon et al.
7,396,154 B2 7/2008 Houlon
2011/0051561 A1 3/2011 Fujisawa

OTHER PUBLICATIONS

U.S.P.T.O. Non-Final Office Action, dated Dec. 23, 2015 in U.S. Appl. No. 13/868,080, 10 pp.
U.S.P.T.O. Notice of Allowance, dated May 31, 2016 in U.S. Appl. No. 13/868,080, 7 pp.

* cited by examiner

*Primary Examiner* — Sean Kayes

(57) ABSTRACT

A method displaying a series of sequential timekeeping periods on a timekeeping device includes, at a beginning of a time period, rotating an indicia dial in a first direction, and aligning a first set of indicia on the indicia dial with a corresponding set of apertures on a cloaking dial, thereby displaying a first 12-hour period of time on the timekeeping device. The method further includes, at an ending of the time period, rotating the indicia dial in a second direction opposite the first direction, and aligning a second set of indicia on the indicia dial with the corresponding set of outer dial apertures of the cloaking dial, thereby displaying a second 12-hour period of time on the timekeeping device.

12 Claims, 34 Drawing Sheets

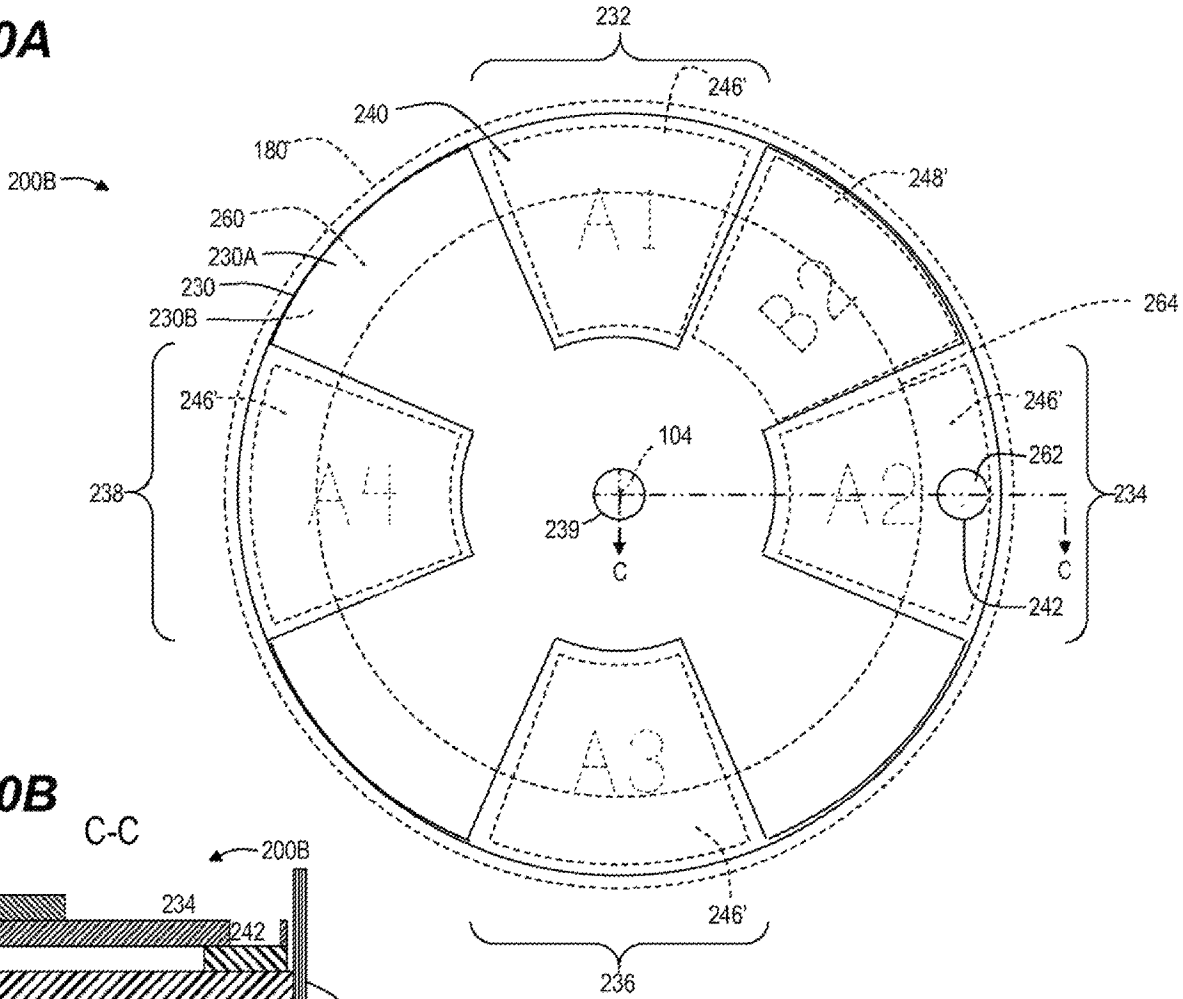
Fig. 10A
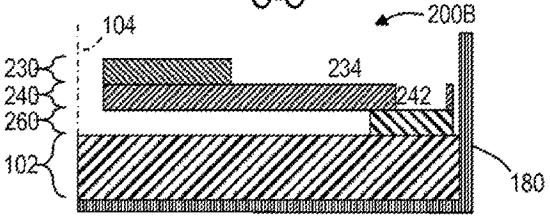
Fig. 10B C-C

METHODS USING A SERIES OF SEQUENTIAL TIMEKEEPING PERIODS

CROSS-REFERENCE TO RELATED APPLICATIONS

This application is a continuation of co-pending U.S. patent application Ser. No. 13/868,080, filed on Apr. 22, 2013, and titled "METHODS AND DEVICES USING A SERIES OF SEQUENTIAL TIMEKEEPING PERIODS," to be issued on Oct. 4, 2016 as U.S. Pat. No. 9,459,590, the entire contents of which are expressly incorporated herein by reference.

FIELD

The embodiments and methods described herein are related to a timekeeping device and a graphical display device that use a series of 12-hour sequential timekeeping periods for displaying a time in a timekeeping mode, an elapsed time in an elapsed chronograph mode, and a countdown time in a countdown chronograph mode. The timekeeping device and graphical display device further include a date dial or date value that is incremented at the end of a second sequential 12-hour timekeeping period during a timekeeping or an elapsed chronograph mode, and is decremented at the end of a second sequential 12-hour countdown timekeeping period during a countdown chronograph mode.

BACKGROUND

Timekeeping devices have enabled users to know whether the hour indicated by an hour hand on a timepiece is in the first or second half of a day. The indication is typically performed by having two sets of hour indicia on the face of the dial, a first set illustrating hour indicia between 0:00 hours, (or mid-night), and 12:00 hours, (or noon), and second set illustrating hour indicia between 12:00 hours and 0:00 hours. However, the second set of hour indicia cannot be functionally used for operating a chronograph mode to displaying chronograph times since the user would not be able to properly discern which set of the first and second set of indicia is relevant to any chronograph time once an elapsed chronograph time is greater than 12 hours.

Another timepiece disclosed in U.S. Pat. No. 4,740,934 to Noirjean has hour and minute hands rotatably driven before a dial by a movement at the rate of one revolution every twelve hours and of one revolution every hour respectively. The dial is not provided with the traditional indicia that are typically used for designating hours but is formed with display apertures located where these indicia are normally located. A rotary disc, lying beneath the dial, bears two sets of indicia distributed along its periphery and is driven by a mechanism to move the rotary disc in the same direction such that the two sets of indicia are displayed through the display apertures.

A drawback from this type of invention is that the rotary disc bearing the two sets of indicia can only be actuated at limited and specific times of the day, thus creating an inability to spontaneously use a chronograph function on the timekeeping device in combination with the two sets of hour indicia. The embodiments described herein address this limitation in the prior art and provide the ability to instantly display a chronograph time using either of two sets of 12-hour sequential timekeeping periods and the ability to toggle between a timekeeping display mode and any number of chronographs display modes at any time and as many times as a user determines.

SUMMARY

It should be appreciated that this Summary is provided to introduce a selection of concepts in a simplified form that are further described below in the Detailed Description. This Summary is not intended to be used to limit the scope of the claimed subject matter.

In one embodiment disclosed herein, a timekeeping device includes a movement having a central axis of rotation and a plurality of indicator hands rotationally connected to the movement at the central axis of rotation. The timekeeping device further includes a first dial including a plurality of first dial apertures, wherein the plurality of first dial apertures include four first dial apertures oriented at an angle of 90 degrees from adjacent ones of the four first dial apertures with respect to the central axis of rotation. The first dial further includes a first dial front side and a first dial rear side opposite the first dial front side. The device further includes a second dial adjacent the first dial rear side, and a third dial positioned on the first dial rear side. The second dial and the third dial are rotationally connected to the movement to enable independent rotation of the second dial about the central axis of rotation and independent rotation of the third dial about the central axis of rotation.

In another embodiment disclosed herein, a timekeeping device includes a movement having a central axis of rotation, a plurality of indicator hands rotationally connected to the movement at the central axis of rotation, a first dial having a plurality of first dial apertures, the first dial having a first dial front side and a first dial rear side opposite the first dial front side, and a second dial adjacent the first dial rear side. The second dial further includes a first set of indicia representing a first 12-hour period of time, and a second set of indicia representing a second 12-hour period of time sequentially following the first 12-hour period of time. The plurality of first dial apertures capable of being aligned with the first set of indicia at a first time, and being aligned with the second set of indicia at a second time.

In another embodiment disclosed herein, a method for displaying a series of sequential timekeeping periods on a timekeeping device includes at a beginning of a time period, rotating an hour indicia dial in a first direction through an angle of 45 degrees to align a first set of indicia on the hour indicia dial with a plurality of outer dial apertures of an outer dial to display a first 12-hour period of time on the timekeeping device, the outer dial adjacent to the hour indicia dial and the first set of indicia. At an ending of the time period, the method further includes rotating the hour indicia dial in a second direction opposite the first direction through an angle of 45 degrees to align a second set of indicia on the hour indicia dial with the plurality of outer dial apertures of the outer dial to display a second 12-hour period of time on the timekeeping device, the second 12-hour period of time sequentially following the first 12-hour period of time.

In another embodiment disclosed herein, a computer-readable storage medium tangibly embodying a program of instructions executable by a computer for performing a method of displaying a series of sequential timekeeping periods for a graphical timekeeping display includes, at a beginning of a time period, displaying on the graphical timekeeping display, a first set of hour indicia that represents a first 12-hour period of time. The method further includes graphically rotating a plurality of indicator hands about a central axis or central point of rotation to display on the graphical timekeeping device a first time within the first 12-hour period of time. The method further includes, at an end of the time period, replacing the first set of hour indicia by displaying on the graphical timekeeping display a second set of hour indicia that represents a second 12-hour period of time, the second 12-hour period of time sequentially following the first 12-hour period of time. The method further includes graphically rotating the plurality of indicator hands about the central axis or central point of rotation to display on the graphical timekeeping device a second time within the second 12-hour period of time.

BRIEF DESCRIPTION OF THE SEVERAL VIEWS OF THE DRAWINGS

The embodiments of the invention will be better understood from the following detailed description with reference to the drawings, which are not necessarily drawing to scale and in which:

FIG. 10A illustrates top assembly view of an alternative embodiment of the second embodiment presented in FIGS. 6-8;

FIG. 10B illustrates cross-sectional view along line C-C of the top assembly view of the alternative embodiment of second embodiment presented in FIG. 10A;

DETAILED DESCRIPTION

The embodiments described herein provide the ability to instantly toggle between a time display mode and a chronograph display mode of a timekeeping device or a graphical timekeeping display while using two sets of 12-hour sequential timekeeping periods in both display modes at any time and as many times as a user determines. The embodiments described herein provide the ability to display an elapsed time chronograph mode and a countdown time chronograph mode each using two sets of 12-hour sequential timekeeping periods. The embodiments described herein provide the ability to display a date value in the time display mode and a chronograph day value in any chronograph display mode, where the chronograph day value is incremented in an elapsed time chronograph mode for every consecutive 24-hour period, and the chronograph day value is decremented in a countdown time chronograph mode for every consecutive 24-hour period.

Figure 1:
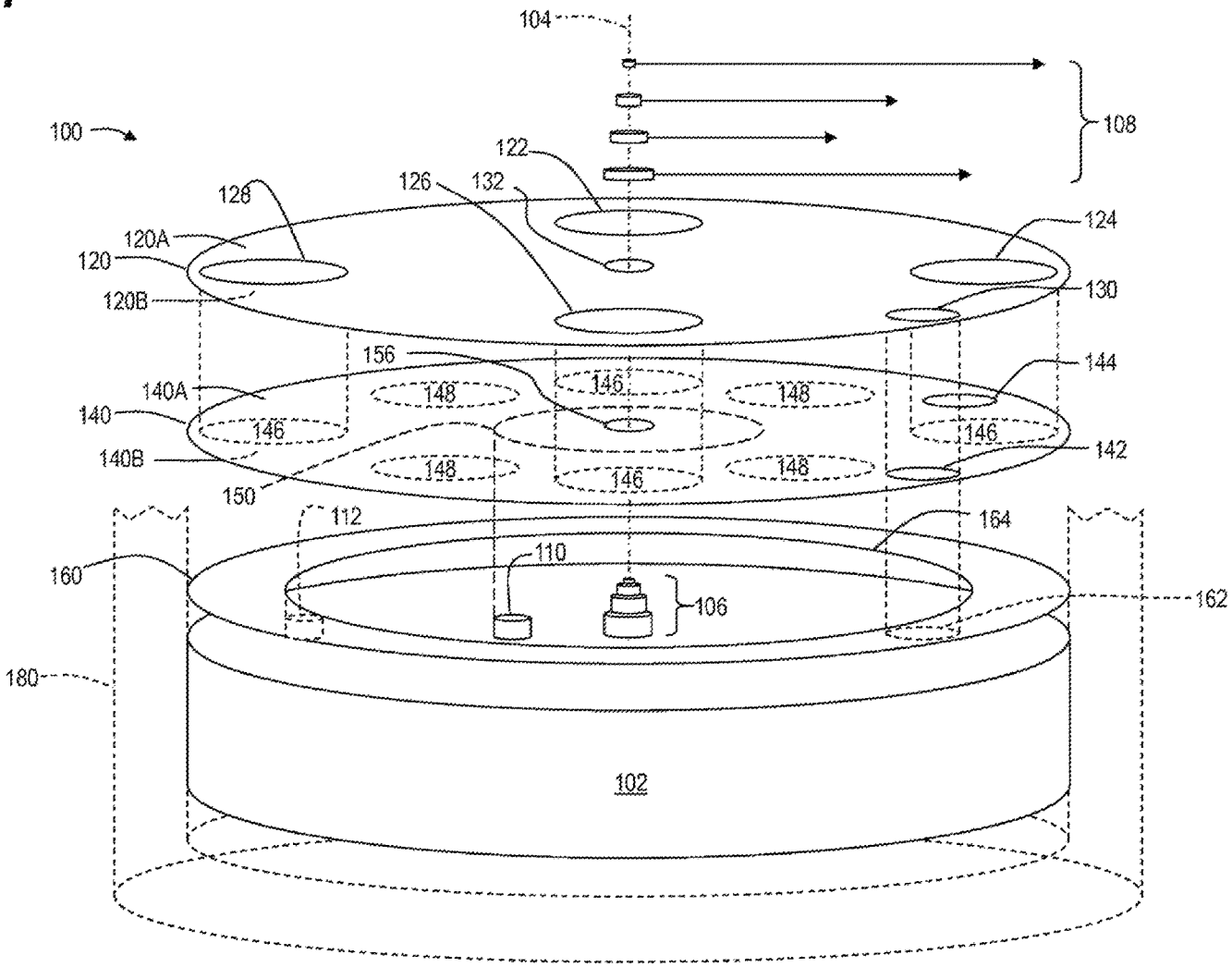
FIG. 1 illustrates a perspective exploded view of a first embodiment of a timekeeping device presented herein.

FIG. 1 illustrates a perspective exploded view of a first embodiment a timekeeping device 100 including a timekeeping device movement 102 that includes a central axis of rotation 104, a plurality of concentric indicator hand attachment stems 106, a plurality of indicator hands 108, an hour dial actuator 110, and a date dial actuator 112. The plurality of indicator hands 108 may include an hour indicator hand, a minute indicator hand, a second indicator hand and multipurpose indicator hand to display a second hour for a second time zone, to indicate a time zone, and/or indicate particular operating parameters on the first embodiment of the timekeeping device 100. The hour dial actuator 110 and date dial actuator 112 may be located between the central axis of rotation 104 and an outer edge of the timekeeping device movement 102. The timekeeping device movement 102 is controlled by controller circuit generally described hereafter and illustrated in FIGS. 25-26.

Figure 4A:
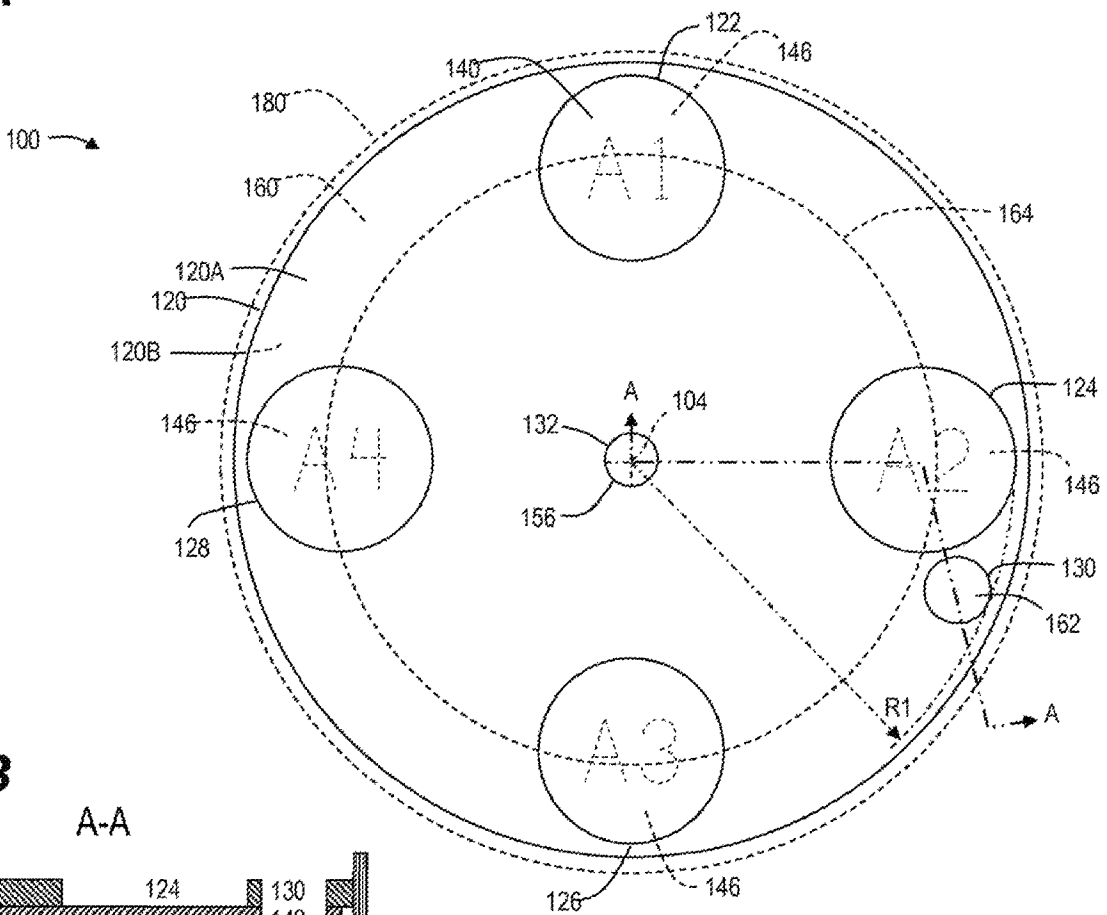
FIG. 4A illustrates a top assembly view of the first embodiment presented in FIGS. 1-3.

A fixed dial 120 is fixedly attached to a timekeeping device case 180, (partially illustrated), and includes a fixed dial front side 120A and a fixed dial rear side 120B opposite the fixed dial front side 120A. The fixed dial 120 further includes four fixed dial hour apertures 122, 124, 126 and 128 that are disposed at equal intervals of 90-degrees, and generally positioned at the locations of 12:00, 3:00, 6:00 and 9:00 of a conventional timekeeping device. A radius of the four fixed dial hour apertures R1, as shown in FIG. 4A, is defined as encompassing each of the four fixed dial hour apertures 122, 124, 126 and 128 from the central axis of rotation 104. A fifth fixed dial date aperture 130 is also located on the fixed dial 120 between two of the four fixed dial hour apertures, in this case between fixed dial apertures 124 and 126. The fifth fixed dial date aperture 130 is located within the radius of the four fixed dial hour apertures R1 of the fixed dial 120 with respect to the central axis of rotation 104. Additionally, a fixed dial central aperture 132 in the fixed dial 120 may be disposed to allow the plurality of concentric indicator hand attachment stems 106 to be connected to the plurality of indicator hands 108 above the fixed dial front side 120A.

An hour dial 140 is positioned below the fixed dial 120 in a direction toward the fixed dial rear side 120B, and similarly includes an hour dial front side 140A, and an hour dial rear side 140B. The hour dial 140 further includes two hour dial date/day apertures 142, 144 that, when the hour dial 140 is rotated between two positions, are each aligned with the fifth fixed dial date aperture 130 of the fixed dial 120. Hour dial 140 includes two distinct sets of hour dial indicia, a first set of 12-hour dial indicia 146, and second set of 12-hour dial indicia 148. Each set of hour dial indicia are disposed at equal intervals of 90-degrees with respect to the central axis of rotation 104, thus yielding an alternating disposition of the first and second sets of hour dial indicia around the periphery of the hour dial 140. Additionally, an hour dial central aperture 156 in the hour dial 140 may be configured to allow the plurality of concentric indicator hand attachment stems 106 to be connected to the plurality of indicator hands 108 above the fixed dial front side 120A.

An hour dial actuator interface 150 is disposed on the hour dial rear side 140B that engages the hour dial actuator 110 of the timekeeping device movement 102 to rotate the hour dial 140 around the central axis of rotation 104. The hour dial actuator interface 150 may include a gear track that engages a mating gear of the hour dial actuator 110 or may include other known mechanisms that transfer the rotational motion of the hour dial actuator 110 to the hour dial 140.

A date dial 160 is positioned below the hour dial 140 in a direction toward the hour dial rear side 140B and includes a date dial indicium display region 162 that aligns with one of the two hour dial date/day apertures 142, 144 when the hour dial 140 is rotated between two positions, and is also aligned with the fifth fixed dial date aperture 130 of the fixed dial 120. The date dial 160 includes a date dial inner diameter 164 that interfaces with the date dial actuator 112 to rotate the date dial 160 around the central axis of rotation 104. The date dial inner diameter 164 may include a gear track (not shown) that engages a mating gear of the date dial actuator 112 or may include other known mechanisms that transfer the rotational motion of the date dial actuator 112 to the date dial 160.

A timekeeping device case 180 encloses the timekeeping device movement 102, the date dial 160, the hour dial 140 and the fixed dial 120 to allow rotational movement of the hour dial 140 and the date dial 160, but fixedly holds the fixed dial 120 in place relative to the other dials. Depending on the type of timekeeping device, a transparent glass or mineral crystal window, (not shown), may enclose all the elements within the timekeeping device case 180 to encapsulate the timekeeping device elements from ambient humidity, fluids, dust and dirt. The first embodiment of the timekeeping device 100 may include wrist-worn watches, pocket watches, travel clocks, wall clocks and permanent installed clocks.

Figure 2:
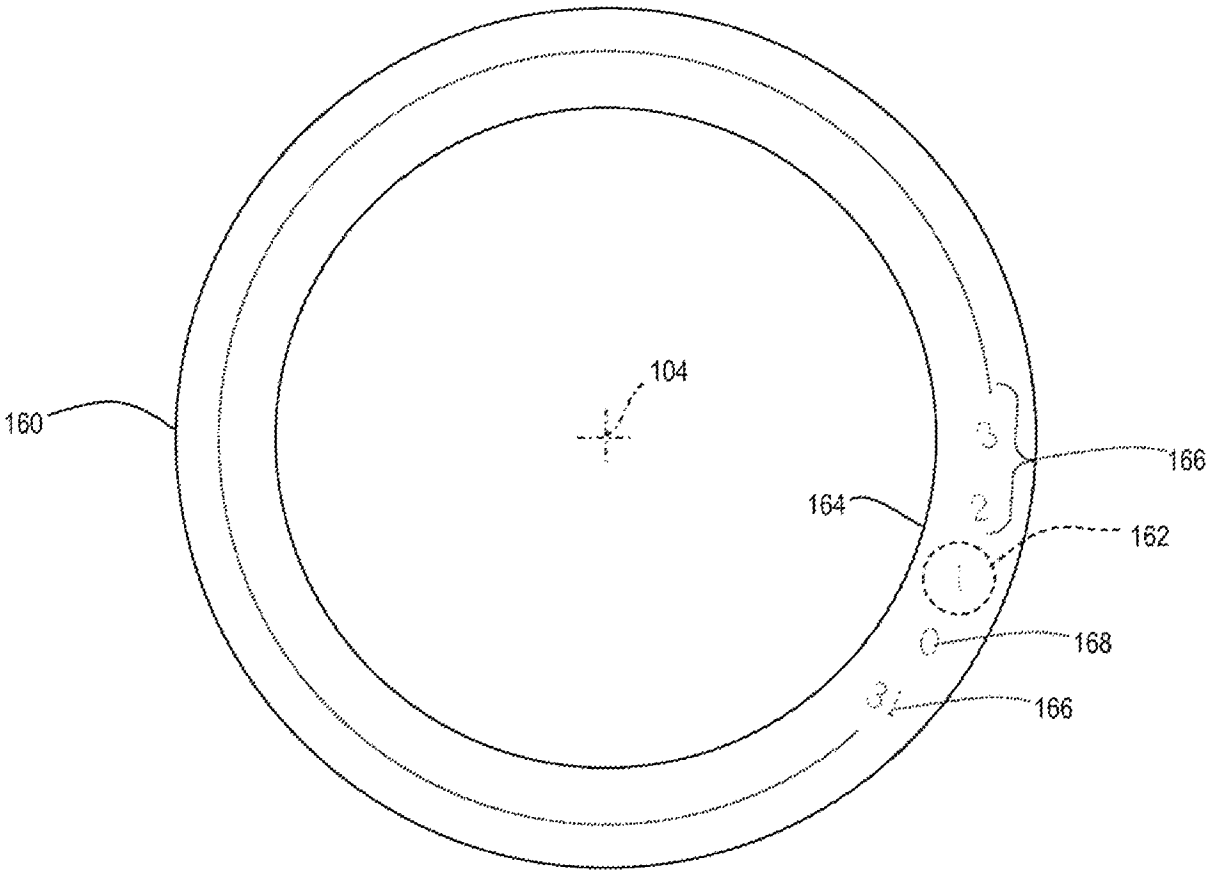
FIG. 2 illustrates a top view of a date dial of the first embodiment presented in FIG. 1.

FIG. 2 illustrates a top view of the date dial 160 of the first embodiment of the timekeeping device 100 where a date dial indicium display region 162 is positioned to display a series of date dial indicia 166. The date dial indicium display region 162 is oriented with respect to the central axis of rotation 104 between the "3 o'clock" and "4 o'clock" position and is aligned with the fifth fixed dial date aperture 130 of the fixed dial 120.

The series of date dial indicia 166 are exemplary illustrated as a series of numbers from "0" to "31". Traditionally, the values 1 to 31 are reserved for displaying the numbered date through the fifth fixed dial date aperture 130, however, a "0" value may be added as a date dial null indicia value 168 that may function to identify a day "0" period of time, that is, a date display value of less than 24-hours for chronograph functions later described herein. A date dial inner diameter 164 may interface with the date dial actuator 112 as described above. Again, the date dial inner diameter 164 may include a gear track, (not shown), that engages a mating gear of the date dial actuator 112 or may include other known mechanisms that transfer the rotational motion of the date dial actuator 112 to the date dial 160.

Figure 3:
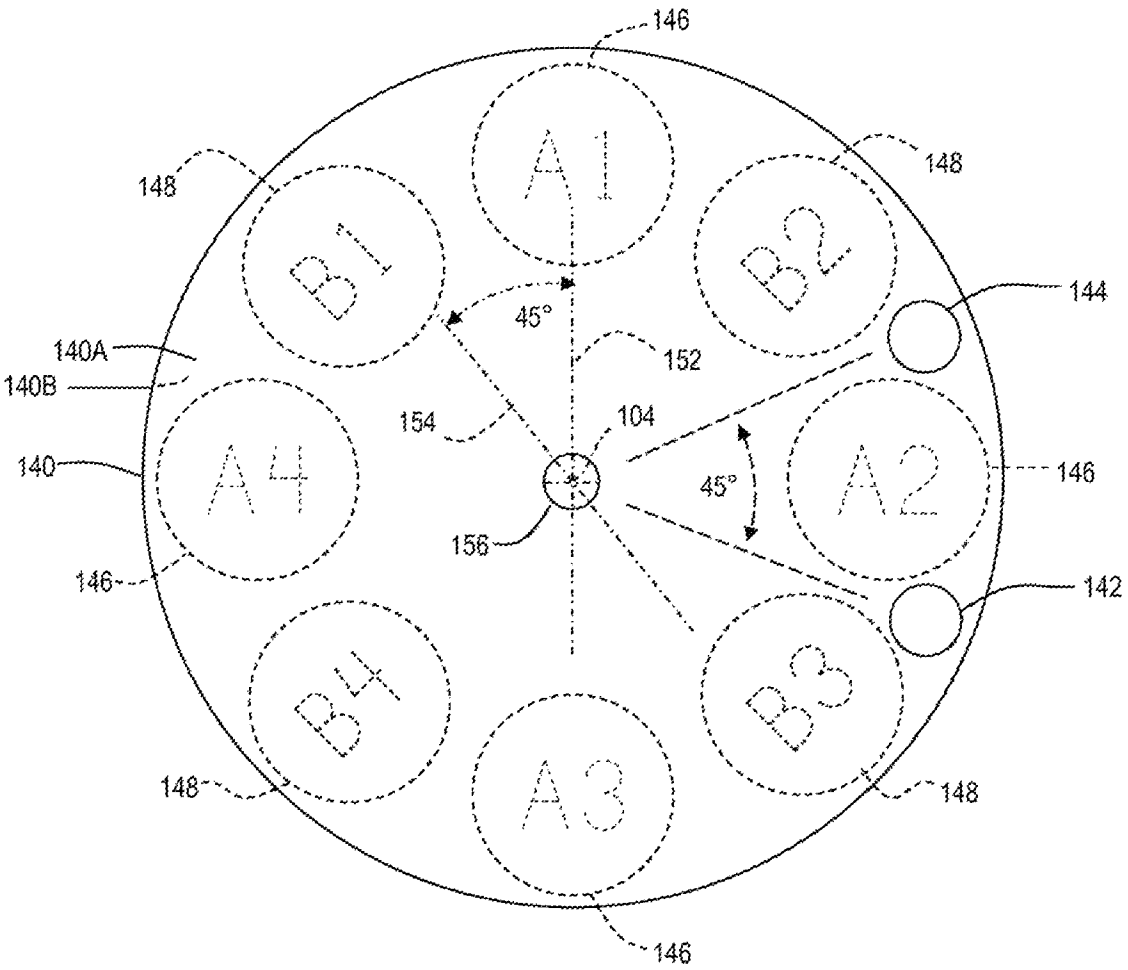
FIG. 3 illustrates a top view of an hour dial of the first embodiment presented in FIG. 1.

FIG. 3 illustrates a top view of the hour dial 140 of the first embodiment that includes the first set of 12-hour indicia 146 with exemplary characters "A1," "A2," "A3" and "A4" representing a first series of hour indicia that include a first 12-hour period of time, and the second set of 12-hour indicia 148 with exemplary characters "B1," "B2," "B3" and "B4" representing a second series of hour indicia that include a second 12-hour period of time. For example, exemplary characters "A1," "A2," "A3" and "A4" may represent 0:00, (or 12:00), 3:00, 6:00 and 9:00, respectively, while exemplary characters "B1," "B2," "B3" and "B4" may represent 12:00 (or 24:00), 15:00, 18:00 and 21:00, respectively. Each indicium of the first set of 12-hour indicia 146 is disposed at an angle of 90-degrees to each other with respect to the central axis of rotation 104. Likewise, each of the second set of 12-hour indicia 148 is disposed at an angle of 90-degrees to each other with respect to the central axis of rotation 104. Thus, both sets of indicia alternate around the face of the hour dial 140 between the first set 146 and the second set 148 of indicia.

The first set of 12-hour indicia 146 further includes a first common graphical indicia alignment axis 152 where each of the first set of 12-hour indicia 146 are oriented to be displayed in a common direction, (about axis 152), when the hour dial 140 is in a first position. The second set of 12-hour indicia 148 further includes a second common graphical indicia alignment axis 154 where each of the second set of 12-hour indicia 148 are oriented to be displayed in a second common direction, (about central axis of rotation 104) when the hour dial 140 is in a second position.

Each of the common graphical indicia alignment axes 152 and 154 represents a relative display orientation of the two sets of 12-hour indicia 146 and 148. The indicium in each set (146 or 148) may be displayed along a similar vertical axis, that is, where all the indicia of each indicia set may be displayed in a vertical or an upright orientation. Additionally, each 12-hour indicia set (146 or 148) may also be displayed in a variable orientation based on the position of the indicia around the central axis of rotation 104. For example, the indicia at the three o'clock position may be rotated clockwise 90-degrees, and the indicia at the nine o'clock position may be rotated counter-clockwise 90-degrees. Nevertheless, the common graphical indicia alignment axes 152 and 154 of each first and second set of 12-hour 146, 148 of indicia remains at a 45-degree angular offset with respect to each other. In other words, the angle between the first common graphical indicia alignment axis 152 and the second common graphical indicia alignment axis 154 is at 45-degrees with respect to the central axis of rotation 104.

The two hour dial date/day apertures 142, 144 are located between one of the indicia regions of either the first 146 or second 148 set of 12-hour indicia, and the two hour dial date/day apertures 142, 144 are disposed at an angle of 45-degrees with respect to the central axis of rotation 104. These two hour dial date/day apertures 142, 144 are oriented on the hour dial 140 to allow the display of the date dial 160 there-through with the corresponding series of date dial indicia 166 at the date dial indicium display region 162.

FIG. 4A illustrates a top assembly view of the first embodiment of the timekeeping device 100 where the fixed dial 120 overlays the hour dial 140, which overlays the date dial 160. The first set of 12-hour indicia 146 of the hour dial 140 is oriented by the hour dial actuator 110 of the timekeeping device movement 102 to be display through the four fixed dial hour apertures 122, 124, 126 and 128. Likewise, the date dial actuator 112 orients the date dial 160 to position the appropriate indicium of the series of date dial indicia 166, relative to the function of the timekeeping device 100, to be displayed through one of the two hour dial date/day apertures 142, 144, (not shown in FIG. 4A, see FIG. 3), and the fifth fixed dial date aperture 130.

The radius R1 of the four fixed dial hour apertures extends from the central axis of rotation 104 of the timekeeping device movement 102 and is defined by the outer perimeter of the four fixed dial hour apertures 122, 124, 126 and 128 of fixed dial 120. In this first embodiment, the fifth fixed dial date aperture 130 is also included within the R1 radius of the four fixed dial hour apertures.

Figure 4B:
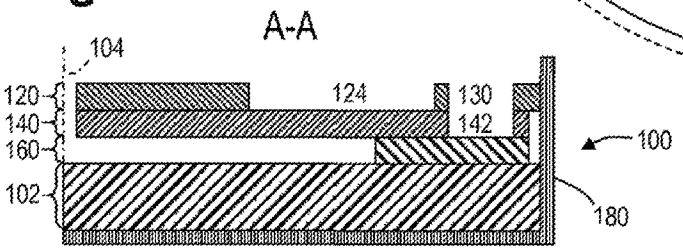
FIG. 4B illustrates a partial cross-sectional view along line A-A of the top assembly view of the first embodiment presented in FIG. 4A.

FIG. 4B illustrates a partial cross-sectional view along line A-A of the top assembly view of FIG. 4A where a timekeeping device case 180 encloses the timekeeping device movement 102, the date dial 160, the hour dial 140, (including the hour dial date/day aperture 142), and the fixed dial 120, (including one of the four fixed dial hour apertures, e.g., 124, and the fifth fixed dial date aperture 130). Fixed dial 120 is fixed to the timekeeping device case 180 with respect to the timekeeping device movement 102. However, the hour dial 140 and the date dial 160 are able to freely rotate with respect the timekeeping device case 180.

Figure 5A:
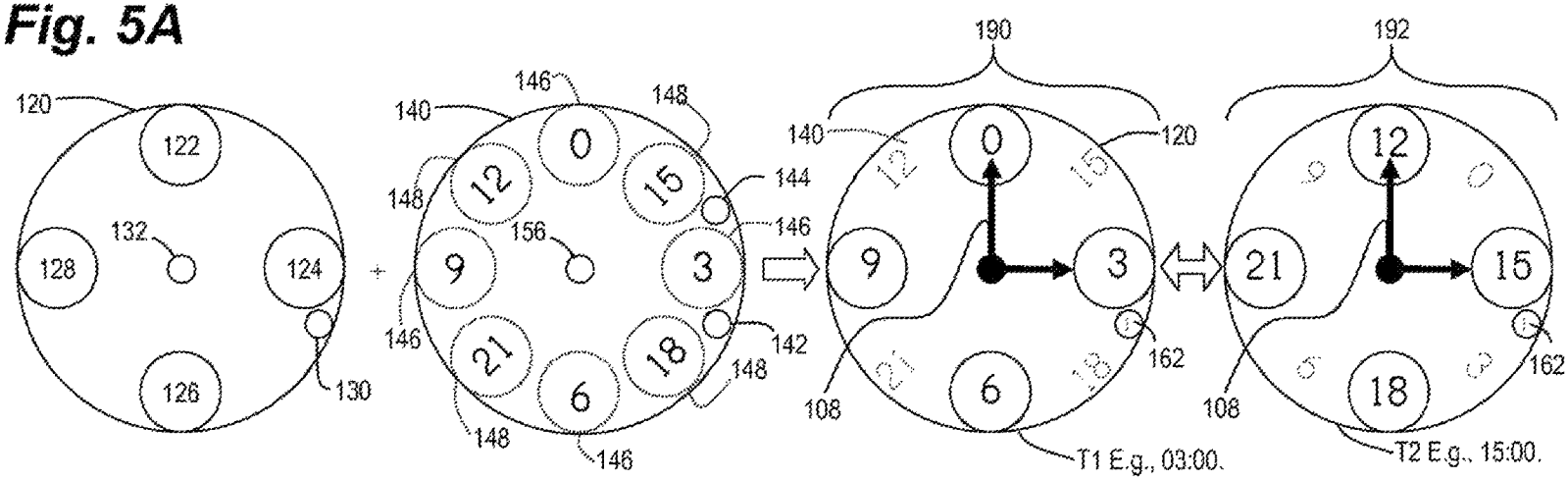
FIG. 5A illustrates a schematic diagram of the first embodiment presented in FIGS. 1-4B displaying two sequential 12-hour periods of time by an hour dial displaying 0/3/6/9 indicia during a first sequential 12-hour period of time, and displaying 12/15/18/21 indicia during a second sequential 12-hour period of time.

FIG. 5A illustrates a schematic diagram for displaying two sequential 12-hour periods of time in a manner consistent with the first embodiment illustrated in FIGS. 1-4B, and similarly for the embodiments that follow hereafter. The fixed dial 120 having the four fixed dial hour apertures 122, 124, 126 and 128 and fifth fixed dial date aperture 130 overlay the hour dial 140 such that when the hour dial 140 is in a first position, a first 12-hour time period 190 is displayed through the four fixed dial hour apertures 122, 124, 126 and 128 as the first set of 12-hour indicia 146 are displayed. A plurality of indicator hands 108 over the fixed dial 120 and connected to the timekeeping device movement

102 display a first representative time T1, (e.g., 3:00), within the first 12-hour time period 190. Additionally, the date dial indicium display region 162 displays an indicium of the series of date dial indicia 166, (see FIG. 2), though one of the two hour dial date/day apertures 142, 144, and the fifth fixed dial date aperture 130 to indicate a date value, or a 24-hour day value for a chronograph function as later described.

At the end of the first 12-hour time period 190, (for example, when the plurality of indicator hands 108 are immediately before the 12:00 position), the hour dial 140 is rotated 4S-degrees such that the second set of 12-hour indicia 148 is aligned through the four fixed dial hour apertures 122, 124, 126 and 128 to display a second 12-hour time period 192. The plurality of indicator hands 108 over the fixed dial 120 connected to the timekeeping device movement 102 then display a second representative time T2, (e.g., 15:00), within the second 12-hour time period 192. Additionally, the date dial indicium display region 162 displays an indicium of the series of date dial indicia 166, (see FIG. 2), though the other of the two hour dial date/day apertures 142, 144, and the fifth fixed dial date aperture 130 to indicate a date value, or a 24-hour day value for a chronograph function as later described.

The first set of 12-hour indicia 146 may display the hours of 0:00, 3:00, 6:00 and 9:00 to represent the first 12-hour time period 190 being from 12 o'clock midnight (12 AM) to 12 o'clock noon, (12 PM), and the second set of 12-hour indicia 148 may display the hours of 12:00, 15:00, 18:00 and 21:00 to represent the second 12-hour time period 192 being from 12 o'clock noon (12 PM) to 12 o'clock midnight (12 AM).

Figure 5B:
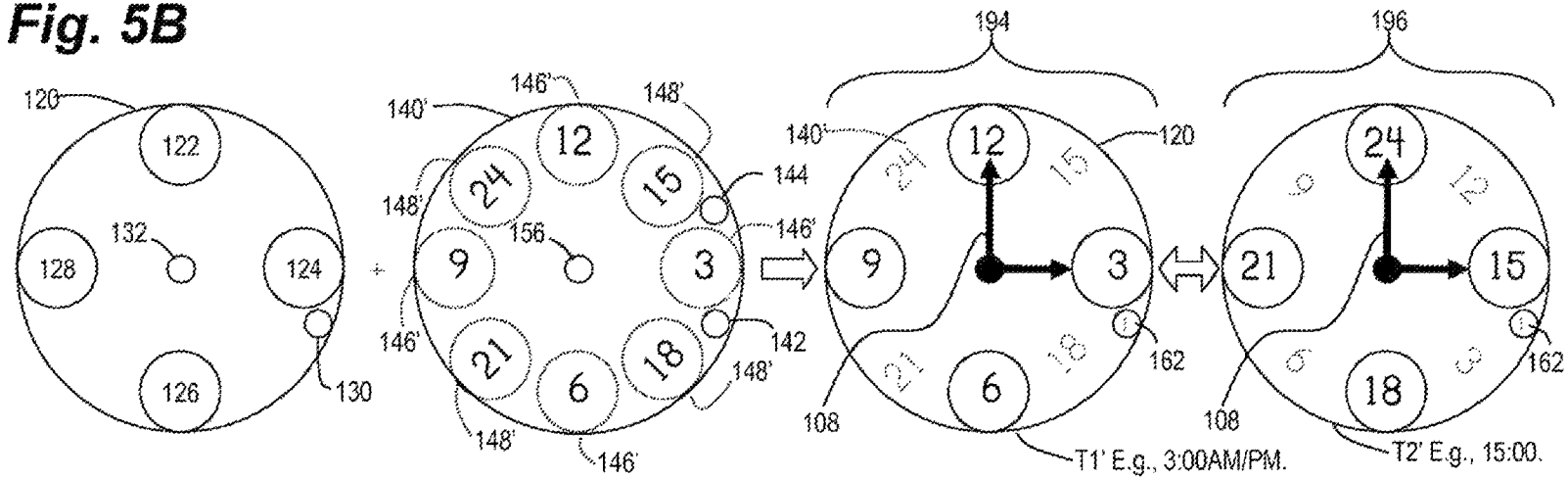
FIG. 5B illustrates a schematic diagram of an alternative first embodiment presented in FIGS. 1-4B displaying two sequential 12-hour periods of time by an hour dial displaying 12/3/6/9 indicia during a first sequential 12-hour period of time, and displaying 24/15/18/21 indicia during a second sequential 12-hour period of time.

FIG. 5B illustrates an alternate schematic diagram for displaying two sequential 12-hour periods of time in an alternate manner to FIG. 5A and similar to the first embodiment illustrated in FIGS. 1-4B, and applicable to the embodiments that follow hereafter. The difference between FIG. 5B and FIG. 5A is the illustration of a first alternative set of 12-hour indicia 146' to display a first alternative 12-hour time period 194 using the hour indicia of 12:00, 3:00, 6:00 and 9:00, and a second alternative set of 12-hour indicia 148' displays the second alternative 12-hour time period 196 using the hour indicia of 24:00, 15:00, 18:00 and 21:00. In this alternative embodiment, the first alternative set of 12-hour indicia 146' includes a traditional 12, 3, 6 and 9 o'clock set of indicia while the second alternative set of 12-hour indicia 148' includes a "24" hour indicia designation at the 0:00 hour position.

This alternative embodiment of the first 146' and second 148' alternative sets of 12-hour indicia may be used on a timekeeping device described in the embodiments herein to conform to a typical numbering sequence of timekeeping devices that may not display two sequential 12-hour periods of time for the purpose of keeping time during a 24-hour day period. For example, a timekeeping device in this alternative embodiment of the hour dial 140' may display the first alternative 12-hour time period 194 for the entirety of a 24-hour period of time when a time display function is operating, e.g., T1', at 3:00 AM or 3:00 PM, and may display the second alternative 12-hour time period 196 only when a chronograph function is operating to display a chronograph time within a second alternative 12-hour time period 196, e.g., T2' displaying a chronograph time of 15:00, or 15 hours.

In summary, the first embodiment of the timekeeping device includes a movement 102 including a central axis of rotation 104, a plurality of indicator hands 108 rotationally connected to the movement 102 at the central axis of rotation 104, and a first dial 120 including a plurality of first dial apertures, the plurality of first dial apertures including four first dial apertures 122-128, each oriented at an angle of 90-degrees from adjacent apertures with respect to the central axis of rotation 104. The timekeeping device further includes a second dial 140 adjacent a first dial rear side 140B, and a third dial 160 positioned toward the first dial rear side 140B, where the second dial 140 and the third dial 160 are rotationally connected to the movement 102 to enable independent rotation about the central axis of rotation 104.

The first embodiment of the timekeeping device further includes the second dial 140 including two second dial apertures 142, 144 oriented at an angle of 45-degrees from each other with respect to the central axis of rotation 104, and the third dial 160 is adjacent the second dial rear side 140B. The plurality of first dial apertures includes a fifth first dial aperture 130 oriented inside a radius R1 from the central axis of rotation 104 containing the four first dial apertures 122-128, where the fifth first dial aperture 130 being aligned with one of the two second dial apertures 142 or 144 at a first time T1, and aligned with another of the two second dial apertures 144 or 142, respectively, at a second time T2.

The first embodiment of the timekeeping device further includes a third dial indicia region 162 being visible through the fifth first dial aperture 130 and one of the second dial apertures 142 or 144 at the first time, and being visible through the fifth first dial aperture 130 and another of the second dial apertures 144 or 142 at the second time.

Further summarizing, the first embodiment of the timekeeping device includes a first dial 120 including a plurality of first dial apertures 122-128, the first dial 120 having a first dial front side 120A and a first dial rear side 120B opposite the first dial front side, and a second dial 140 adjacent the first dial rear side 120B, where the second dial includes a first set of indicia 146 representing a first 12-hour period of time, and a second set of indicia 148 representing a second 12-hour period of time sequentially following the first 12-hour period of time. The plurality of first dial apertures 122-128 capable of being aligned with the first set of indicia 146 at a first time within the first 12-hour period of time, and being aligned with the second set of indicia 148 at a second time within the second 12-hour period of time. The first 12-hour period of time being from 0:00 to 12:00, and the second 12-hour period of time being from 12:00 to 24:00, where one of 1) the first set of indicia represents hour indicia including 0:00, 03:00, 06:00 and 09:00, and the second set of indicia represents hour indicia including 12:00, 15:00, 18:00 and 21:00, or 2) the first set of indicia represents hour indicia including 03:00, 06:00, 09:00 and 12:00, and the second set of indicia represents hour indicia including 15:00, 18:00, 21:00 and 24:00.

Each indicium of the first set of indicia 146 being oriented at an angle of 90-degrees with respect to the central axis of rotation 104 from adjacent indicia of the first set of indicia 146, and each indicium of the second set of indicia 148 being oriented at an angle of 90-degrees with respect to the central axis of rotation 104 from adjacent indicia of the second set of indicia 148. A first common graphical indicia alignment axis 152 exists for each indicium of the first set of indicia 146, and a second common graphical indicia alignment axis 154 exists for each indicium of the second set of indicia 148. The first common graphical indicia alignment axis 152 is oriented an angle of 45-degrees to the second common graphical indicia alignment axis 154 with respect to the central axis of rotation 104.

The timekeeping device further includes the second dial 140 including two second dial apertures 142, 144 oriented at an angle of 45-degrees from each other with respect to the central axis of rotation, where the plurality of first dial apertures 122-128, further including a fifth first dial aperture 130 being aligned with one of the two second dial apertures 142, 144 at a first time, and aligned with the other of the two second dial apertures 144, 142 at a second time.

The timekeeping device further includes a third dial 160 positioned toward the first dial rear side 120B, the third dial being 160 visible through the fifth first dial aperture 142, 144 and the one of the two second dial apertures 144, 142 at the first time, and being visible through the fifth first dial aperture and the other of the two second dial apertures at the second time.

Figure 6:
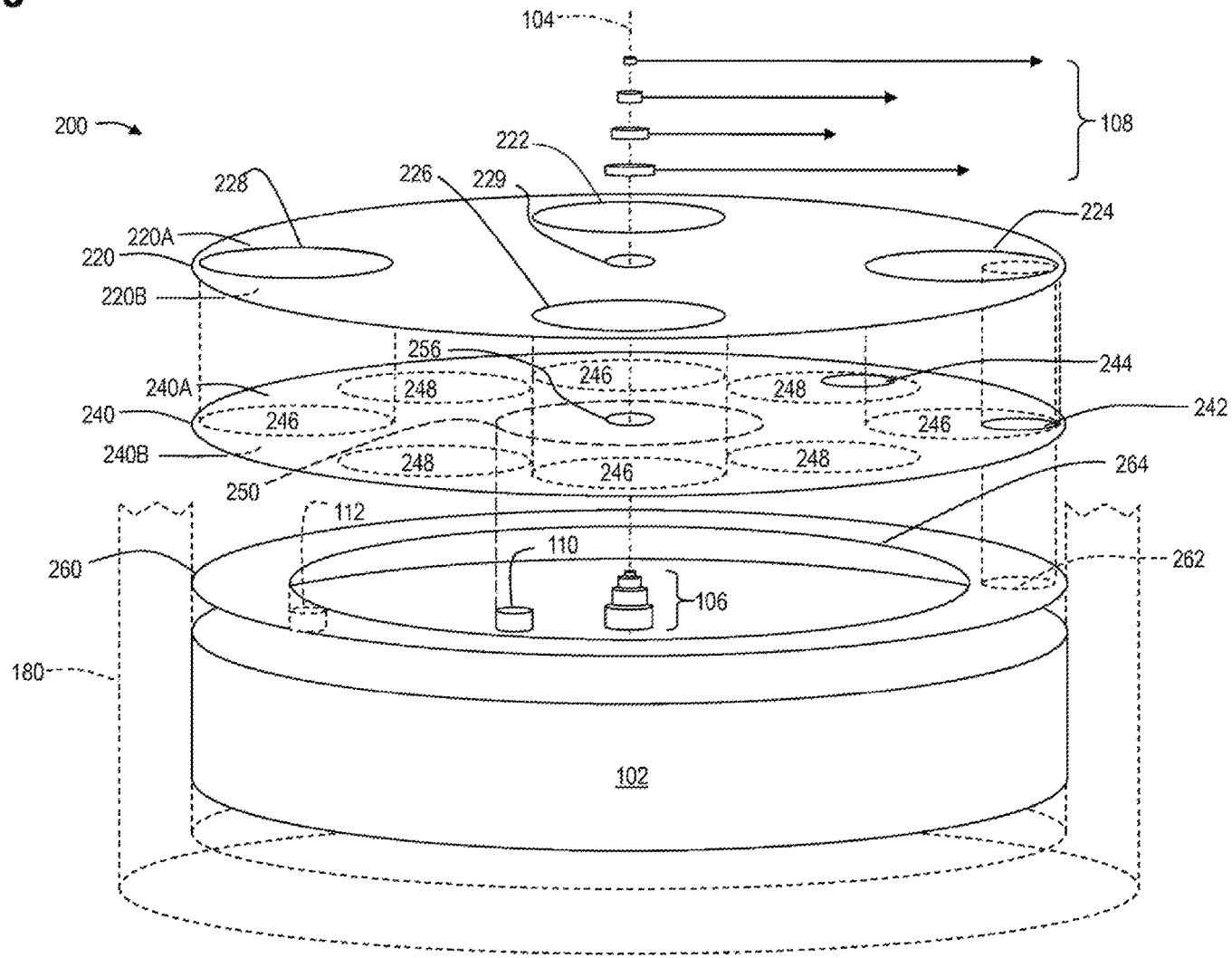
FIG. 6 illustrates a perspective exploded view of a second embodiment presented herein.

FIG. 6 illustrates a perspective exploded view of a second embodiment of a timekeeping device 200 similar to the first embodiment of the timekeeping device 100 as shown in FIGS. 1-5B. In the following description, elements that remain substantially similar between the different embodiments disclosed herein will be given identical reference numbers that correspond to subject matter of previous sections in this disclosure.

Similarly illustrated in FIG. 1 and its accompanying description above, FIG. 6 illustrates a second embodiment of a timekeeping device 200 including a timekeeping device movement 102 includes a central axis of rotation 104, a plurality of concentric plurality of concentric indicator hand attachment stems 106, a plurality of indicator hands 108, an hour dial actuator 110, and a date dial actuator 112. The hour dial actuator 110 and date dial actuator 112 may be located between the central axis of rotation 104 and an outer edge of the timekeeping device movement 102. The movement is controlled by controller circuit generally described hereafter and illustrated in FIGS. 25-26.

A fixed dial 220 is fixedly attached to a timekeeping device case 180, (partially illustrated), and includes a fixed dial front side 220A and a fixed dial rear side 220B opposite the fixed dial front side 220A. The fixed dial 220 further includes four fixed dial hour apertures 222, 224, 226 and 228 that are disposed at equal intervals of 90-degrees, and are generally positioned locations of the hour indicia of 12:00, 3:00, 6:00 and 9:00 of a conventional timekeeping device. Additionally, a fixed central aperture 229 in the fixed dial 220 may be disposed to allow the plurality of concentric indicator hand attachment stems 106 to be connected to the plurality of indicator hands 108 above the fixed dial front side 220A.

An hour dial 240 is positioned below the fixed dial 220 in a direction toward the fixed dial rear side 220B, and similarly includes an hour dial front side 240A, and an hour dial rear side 240B. The hour dial 240 further includes two hour dial date/day apertures 242, 244, which when the hour dial 240 is rotated between two positions, are each aligned with one of the four fixed dial hour apertures 224 of the fixed dial 220. Hour dial 240 includes two distinct sets of indicia, a first set of 12-hour indicia 246, and second set of 12-hour indicia 248. Each set of indicia are disposed at equal intervals of 90-degrees with respect to the central axis of rotation 104, thus yielding an alternating disposition of the first and second sets of 12-hour indicia 246, 248 around the periphery of the hour dial 240, in a similar manner to the embodiment shown in FIGS. 1-5B. However, the two hour dial date/day apertures 242, 244 are located within adjacent indicia regions of the first 246 and second 248 sets of 12-hour indicia. Additionally, an hour dial central aperture 256 in the hour dial 240 may be disposed to allow the plurality of concentric indicator hand attachment stems 106 to be connected to the plurality of indicator hands 108 above the fixed dial front side 220A.

An hour dial actuator interface 250 is disposed on the hour dial rear side 240B that engages the hour dial actuator 110 of the timekeeping device movement 102 to rotate the hour dial 240 around the central axis of rotation 104. The hour dial actuator interface 250 may include a gear track that engages a mating gear of the hour dial actuator 110 or may include other known mechanisms that transfer the rotational motion of the hour dial actuator 110 to the hour dial 240.

A date dial 260 is positioned below the hour dial 240 in a direction toward the hour dial rear side 240B and includes a date dial indicium display region 262 that aligns with one of the two hour dial date/day apertures 242, 244 when the hour dial 240 is rotated between two positions and is also aligned with one of the four fixed dial hour apertures, e.g., 224 of the fixed dial 220. The date dial 260 includes a date dial inner diameter 264 that interfaces with the date dial actuator 112 to rotate the date dial 260 around the central axis of rotation 104. The date dial inner diameter 264 may include a gear track that engages a mating gear of the date dial actuator 112 or may include other known mechanisms that transfer the rotational motion of the date dial actuator 112 to the date dial 260.

A timekeeping device case 180 encloses the timekeeping device movement 102, the date dial 260, the hour dial 240 and the fixed dial 220 to allow rotational movement of the hour dial 240 and the date dial 260, but fixedly holds the fixed dial 220 in place relative to the other dials, and may include an outer transparent glass or mineral crystal window, (not shown), in a similar manner as described above.

Figure 7:
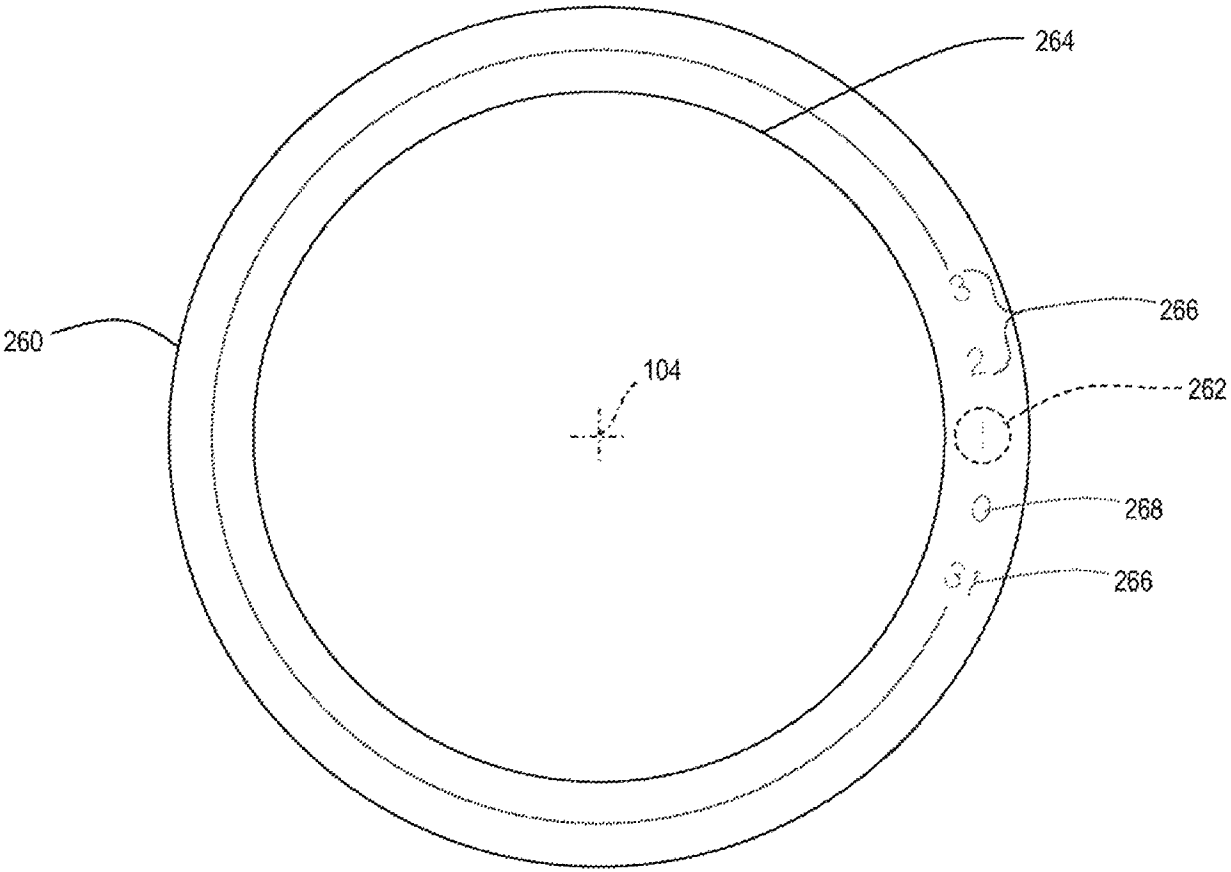
FIG. 7 illustrates a top view of a date dial of the second embodiment presented in FIG. 6.

FIG. 7 illustrates a top view of a date dial 260 of the second embodiment where a date dial indicium display region 262 is positioned to display a series of date dial indicia 266. Note that the date dial indicium display region 262 is oriented with respect to the central axis of rotation 104 at the "3 o'clock" position and is aligned with one of the four fixed dial hour apertures, e.g., fixed dial hour aperture 224 of the fixed dial 220.

The series of date dial indicia 266 are exemplary illustrated as a series of numbers from "0" to "31". Traditionally, the values 1 to 31 are reserved for displaying the numbered date through the one of the four fixed dial hour apertures, e.g., fixed dial hour aperture 224 and one of two hour dial date/day apertures 242, 244, however, a "0" value may be added as a date dial null indicia value 268 that has the function to identify a day "0" period of time, that is, date display value of less than 24-hours for chronograph functions later described herein. A date dial inner diameter 264 is indicated that may interface with the date dial actuator 112 as described above. Again, date dial inner diameter 264 may include a gear track, (not shown), that engages a mating gear of the date dial actuator 112 or may include other known mechanisms that transfer the rotational motion of the date dial actuator 112 to the date dial 260.

Figure 8:
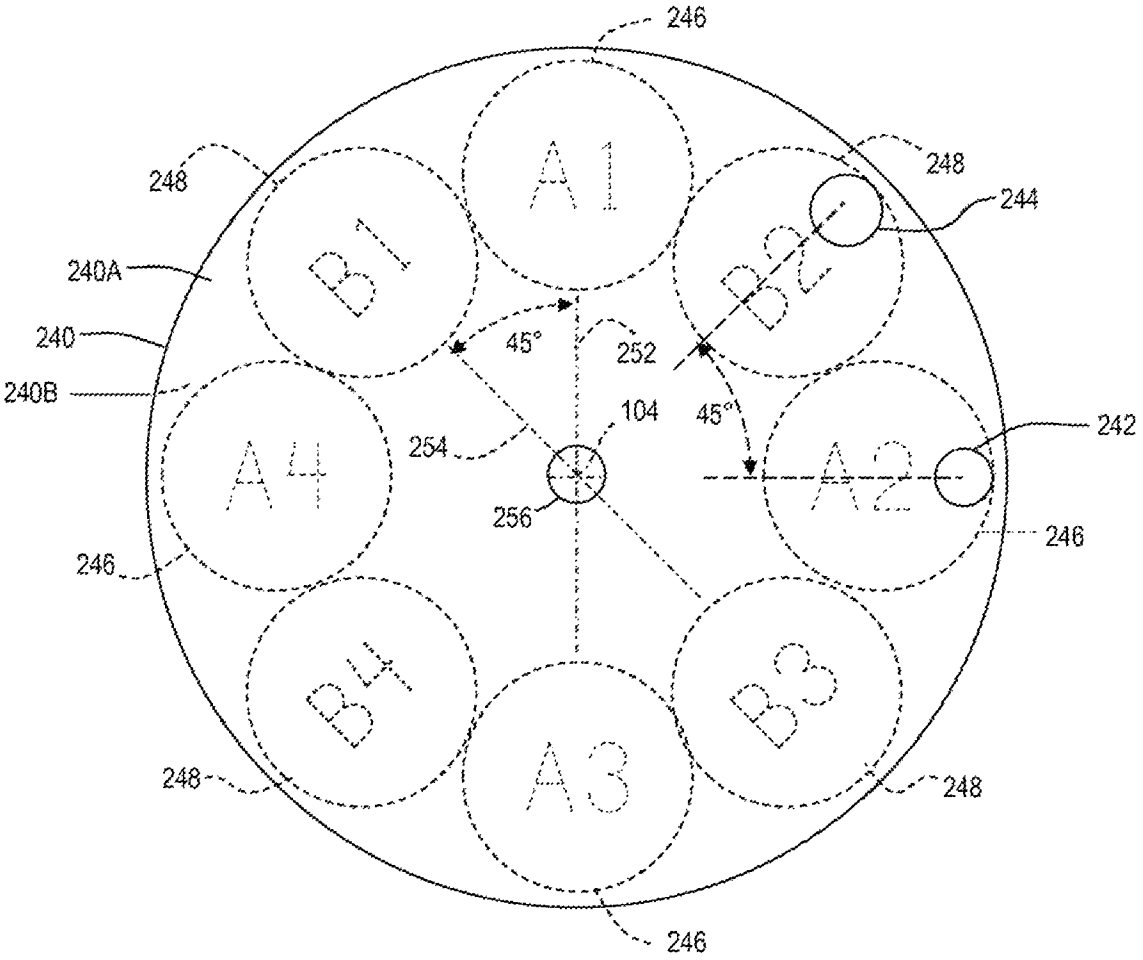
FIG. 8 illustrates a top view of an hour dial of the second embodiment presented in FIG. 6.

FIG. 8 illustrates a top view of the hour dial 240 of the second embodiment that includes the first set of 12-hour indicia 246 with exemplary characters A1, A2, A3 and A4 representing a first series of hour indicia that include a first 12-hour period of time, and the second set of 12-hour indicia 248 with exemplary characters B1, B2, B3 and B4 representing a second series of hour indicia that display a second 12-hour period of time. For example, exemplary characters A1, A2, A3 and A4 may represent 0:00 (or 12:00), 3:00, 6:00 and 9:00, respectively, while exemplary characters B1, B2, B3 and B4 may represent 12:00 (or 24:00), 15:00, 18:00 and 21:00, respectively. Each of the first set of 12-hour indicia 246 is disposed at an angle of 90-degrees to each other with respect to the central axis of rotation 104. Likewise, each of the second set of 12-hour indicia 248 is disposed at an angle of 90-degrees to each other with respect to the central axis of rotation 104. Thus, both sets of indicia alternate between the first set and second set of indicia around the hour dial 240.

The first set of 12-hour indicia 246 further includes a first common graphical indicia alignment axis 252 where each indicium of the first 12-hour indicia 246 is oriented to be displayed in a common direction, (about first common graphical indicia alignment axis 252), when the hour dial 240 is in a first position. The second set of 12-hour indicia 248 further includes a second common graphical indicia alignment axis 254 where each of the second set of 12-hour indicia 248 is oriented to be displayed in a second common direction, (about second common graphical indicia alignment axis 254) when the hour dial 240 is in a second position. The angle between the common graphical indicia alignment of the first common graphical indicia alignment axis 252 and the common graphical indicia alignment of second common graphical indicia alignment axis 254 is 45-degrees with respect to the central axis of rotation 104.

Each common graphical indicia alignment axes 252 and 254 represents a relative display orientation of the two sets of 12-hour indicia 246 and 248. The indicia in each set may be displayed in along a similar vertical axis, that is, where all the indicia of each set may be displayed in a vertical or an upright orientation. Additionally, each set of 12-hour indicia 246, 248 may also be displayed in a variable orientation based on the position of the indicia around the central of the axis of rotation 104, for example, the indicia at the three o'clock position may be rotated clockwise 90-degrees, and the indicia at the nine o'clock position may be rotated counter-clockwise 90-degrees. Nevertheless, the common graphical indicia alignment axes 252 and 254 of each first 246 and second 248 set of 12-hour indicia remains at a 45-degree angular offset with respect to each other.

The two hour dial date/day apertures 242, 244 are located within adjacent indicia regions of a first 246 and second 248 sets of 12-hour indicia, and the two hour dial date/day apertures 242, 244 are disposed at an angle of 45-degrees with respect to the central axis of rotation 104. These two hour dial date/day apertures 242, 244 are oriented on the hour dial 240 to allow the display of the date dial 260 with its corresponding series of date dial indicia 266 therethrough.

Figure 9A:
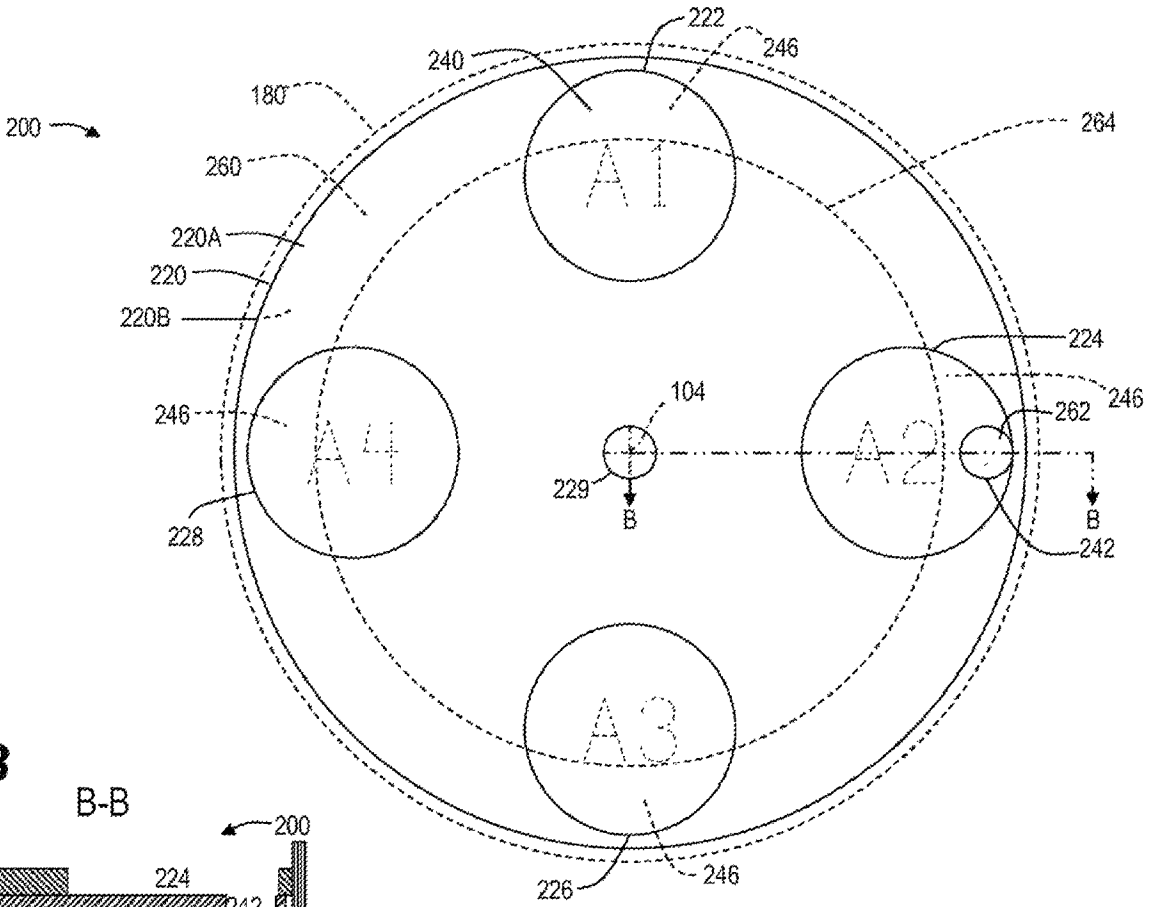
FIG. 9A illustrates a top assembly view of the second embodiment presented in FIGS. 6-8.

FIG. 9A illustrates a top assembly view of the second embodiment where the fixed dial 220 overlays the hour dial 240 and the date dial 260 are beneath the hour dial 240. The first set of 12-hour indicia 246 of the hour dial 240 is oriented by the hour dial actuator 110 of the timekeeping device movement 102 to be display through the four fixed dial hour apertures 222, 224, 226 and 228. Likewise, the date dial actuator 112, (shown in FIG. 6), orients the date dial 260 to position the appropriate date of the series of date dial indicia 266, relative to the function of the second embodiment of a timekeeping device 200, to be displayed through one of the two hour dial date/day apertures 242, 244, (not shown in FIG. 9A, see FIG. 8), and one of the four fixed dial hour apertures, e.g., fixed dial hour aperture 224.

Figure 9B:
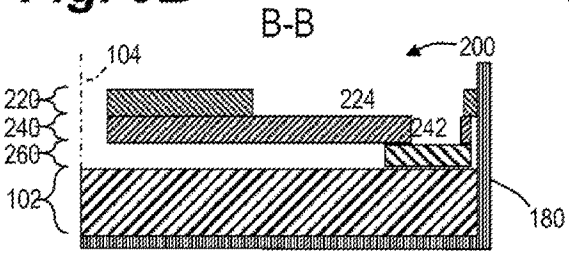
FIG. 9B illustrates a partial cross-sectional view along line B-B of the top assembly view of the second embodiment presented in FIG. 9A.

FIG. 9B illustrates a partial cross-sectional view along line B-B of the top assembly view of FIG. 9A where a timekeeping device case 180 encloses the timekeeping device movement 102, the date dial 260, the hour dial 240, (including the hour dial date/day aperture 242), and the fixed dial 220, (including one of the four fixed dial hour apertures, 224). Fixed dial 220 is fixed to the timekeeping device case 180 with respect to the timekeeping device movement 102. However, the hour dial 240 and the date dial 260 are able to freely rotate with respect the timekeeping device case 180.

FIG. 10A illustrates a top assembly view of an alternative configuration of the second embodiment 200B shown in FIGS. 9A-9B where the fixed dial 220 is replaced with an alternative fixed dial 230 having alternative fixed dial central aperture 239 that overlays the hour dial 240 and the date dial 260 being beneath the hour dial 240. The alternative fixed dial 230 includes an alternative fixed dial front side 230A and an alternative fixed dial rear side 230B having a cloverleaf shaped design with four alternative fixed dial hour apertures 232, 234, 236 and 238 open to the outer circumference of the alternative fixed dial 230. The first alternative set of 12-hour indicia 246' of the hour dial 240 is oriented by the hour dial actuator 110, (see FIG. 9), of the timekeeping device movement 102 to be display through four alternative fixed dial hour apertures 232, 234, 236 and 238. Likewise, the date dial actuator 112 orients the date dial 260 to position the appropriate date of the series of date dial indicia 266, relative to the function of the timekeeping device, to be displayed through one of the two hour dial date/day apertures 242, 244, and one of the alternative four fixed dial hour apertures, e.g., aperture 234. An advantage of this alternative fixed dial 230 embodiment allows for a larger area of the hour dial 240 with its corresponding alternative 12-hour indicia region 246' (and e.g., alternative 12-hour indicia regions 248' shown underneath alternative fixed dial 230) to be displayed though each of the four alternative fixed dial hour apertures 232, 234, 236 and 238.

FIG. 10B illustrates a partial cross-sectional view along line C-C of the top assembly view of FIG. 10A where a timekeeping device case 180 encloses the timekeeping device movement 102, the date dial 260, the hour dial 240, (including the hour dial date/day aperture 242), and the alternative fixed dial 230, (including one of the four alternative fixed dial apertures, e.g., 234). Alternative fixed dial 230 is fixed to the timekeeping device case 180 with respect to the timekeeping device movement 102. However, the hour dial 240 and the date dial 260 are able to freely rotate with respect the timekeeping device case 180.

In summary, the second embodiment of the timekeeping device includes one of the four first dial apertures 222-228 being aligned with one of the two second dial apertures 242 or 244 at a first time, and aligned with another of the two second dial apertures 244 or 242 at a second time. The third dial indicia region 262 being visible through the one of the four first dial apertures 222-228 and the one of the two second dial apertures 242, 244 at the first time, and being visible through the one of the four first dial apertures 222-228 and another of the two second dial apertures 244, 242 at the second time.

Furthermore, the timekeeping device includes one of the four first dial apertures 222-228 being aligned with one of the two second dial apertures 242, 244 at a first time, and aligned with the other of the two second dial apertures 244, 242 at a second time. The third dial 260 positioned toward the first dial rear side 220B, the third dial being 160 visible through the one of the four first dial apertures 222-228 and the one of the two second dial apertures 242, 244 at the first time, and being visible through the one of the four first dial apertures 222-228 and the other of the two second dial apertures 244, 242 at the second time.

Figure 11:
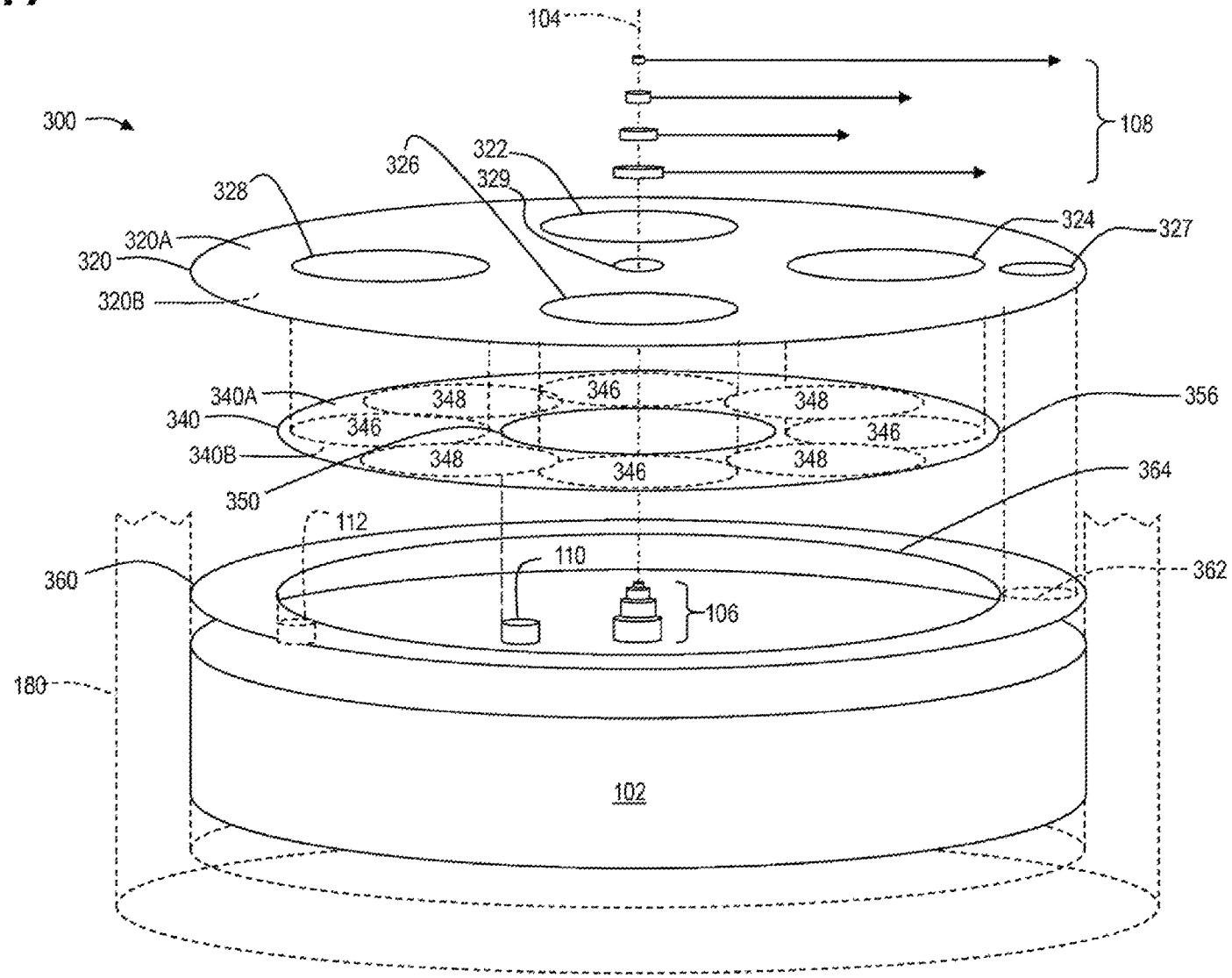
FIG. 11 illustrates a perspective exploded view of a third embodiment presented herein.

FIG. 11 illustrates a perspective exploded view of a third embodiment a timekeeping device 300 similar to the first embodiment as shown in FIGS. 1-5B, and the second embodiment as shown in FIGS. 6-10B. In the following description, elements that remain substantially similar between the different embodiments disclosed herein will be given identical reference numbers that correspond to subject matter of previous sections in this disclosure.

Similarly illustrated in FIGS. 1 and 6 and their accompanying description above, a timekeeping device movement 102 includes a central axis of rotation 104, a plurality of concentric plurality of concentric indicator hand attachment stems 106, a plurality of indicator hands 108, an hour dial actuator 110, and a date dial actuator 112. The hour dial actuator 110 and date dial actuator 112 are not located on the central axis of rotation 104, but between the central axis of rotation 104 and an outer edge of the timekeeping device movement 102. The movement is controlled by controller circuit generally described hereafter and illustrated in FIGS. 25-26.

Figure 13A:
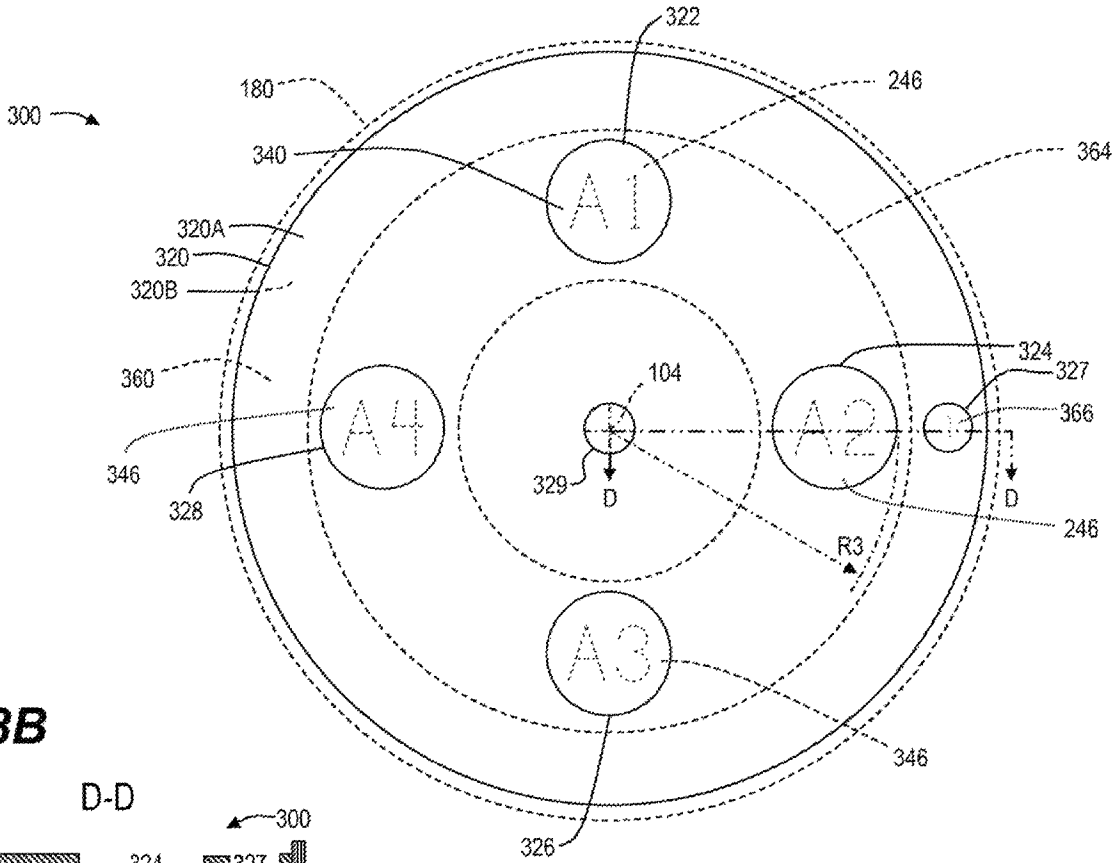
FIG. 13A illustrates a top assembly view of the third embodiment presented in FIGS. 11-12.

A fixed dial 320 is fixedly attached to a timekeeping device case 180, (partially illustrated), and includes a fixed dial front side 320A and a fixed dial rear side 320B opposite the fixed dial front side 320A. The fixed dial 320 further includes four fixed dial hour apertures 322, 324, 326 and 328 that are disposed at equal intervals of 90-degrees, and are generally positioned at the location of the hour indicia of 12:00, 3:00, 6:00 and 9:00 of a conventional timekeeping device. A radius of the four fixed dial hour apertures R3 of the four fixed dial hour apertures 322, 324, 326 and 328, as shown in FIG. 13A and described hereafter, is defined as encompassing each of the four fixed dial hour apertures 322, 324, 326 and 328 from the central axis of rotation 104. A fifth fixed dial aperture 327 is located outside of the radius R3 of the four fixed dial hour apertures of the four fixed dial hour apertures 322, 324, 326 and 328 with respect to the central axis of rotation 104 and adjacent one of the four fixed dial hour apertures, e.g., aperture 324. Additionally, a fixed dial central aperture 329 may be disposed to allow the plurality of concentric indicator hand attachment stems 106 to be connected to the plurality of indicator hands 108 above the fixed dial front side 320A.

An hour dial 340 is positioned below the fixed dial 320 in a direction toward the fixed dial rear side 320B, and similarly includes an hour dial front side 340A, and an hour dial rear side 340B. Hour dial 340 includes two distinct sets of indicia, a first set of 12-hour indicia 346, and a second set of 12-hour indicia 348. Each set of 12-hour indicia are disposed at equal intervals of 90-degrees with respect to the central axis of rotation 104, thus yielding an alternating disposition of the first 346 and second 348 sets of 12-hour indicia around the periphery of the hour dial 340. Additionally, a central aperture in the hour dial 340 may be disposed to allow the plurality of concentric indicator hand attachment stems 106 to be connected to the plurality of indicator hands 108 above the fixed dial front side 320A.

An hour dial actuator interface 350 may be disposed on an inner diameter hour dial that engages the hour dial actuator 110 of the timekeeping device movement 102 to rotate the hour dial 340 around the central axis of rotation 104. The hour dial actuator interface 350 may include a gear track that engages a mating gear of the hour dial actuator 110 or may include other known mechanisms that transfer the rotational motion of the hour dial actuator 110 to the hour dial 340.

A date dial 360 is positioned to encompass an hour dial outer diameter 356 of the hour dial 340 on a substantially similar horizontal plane, and includes a date dial indicium display region 362 that aligns with the fifth fixed dial date aperture 327 of the fixed dial 320. The date dial 360 includes a date dial inner diameter 364 that may interface with the date dial actuator 112 to rotate the date dial 360 around the central axis of rotation 104. The date dial inner diameter 364 may include a gear track that engages a mating gear of the date dial actuator 112 or may include other known mechanisms that transfer the rotational motion of the date dial actuator 112 to the date dial 360.

A timekeeping device case 180 encloses the timekeeping device movement 102, the date dial 360, the hour dial 340 and the fixed dial 320 to allow rotational movement of the hour dial 340 and the date dial 360, but fixedly holds the fixed dial 320 in place relative to the other dials. Depending on the type of timekeeping device, a transparent glass or mineral crystal window, (not shown), may enclose all the elements within the timekeeping device case 180 to encapsulate the timekeeping device elements from ambient humidity, fluids, dust and dirt.

Figure 12:
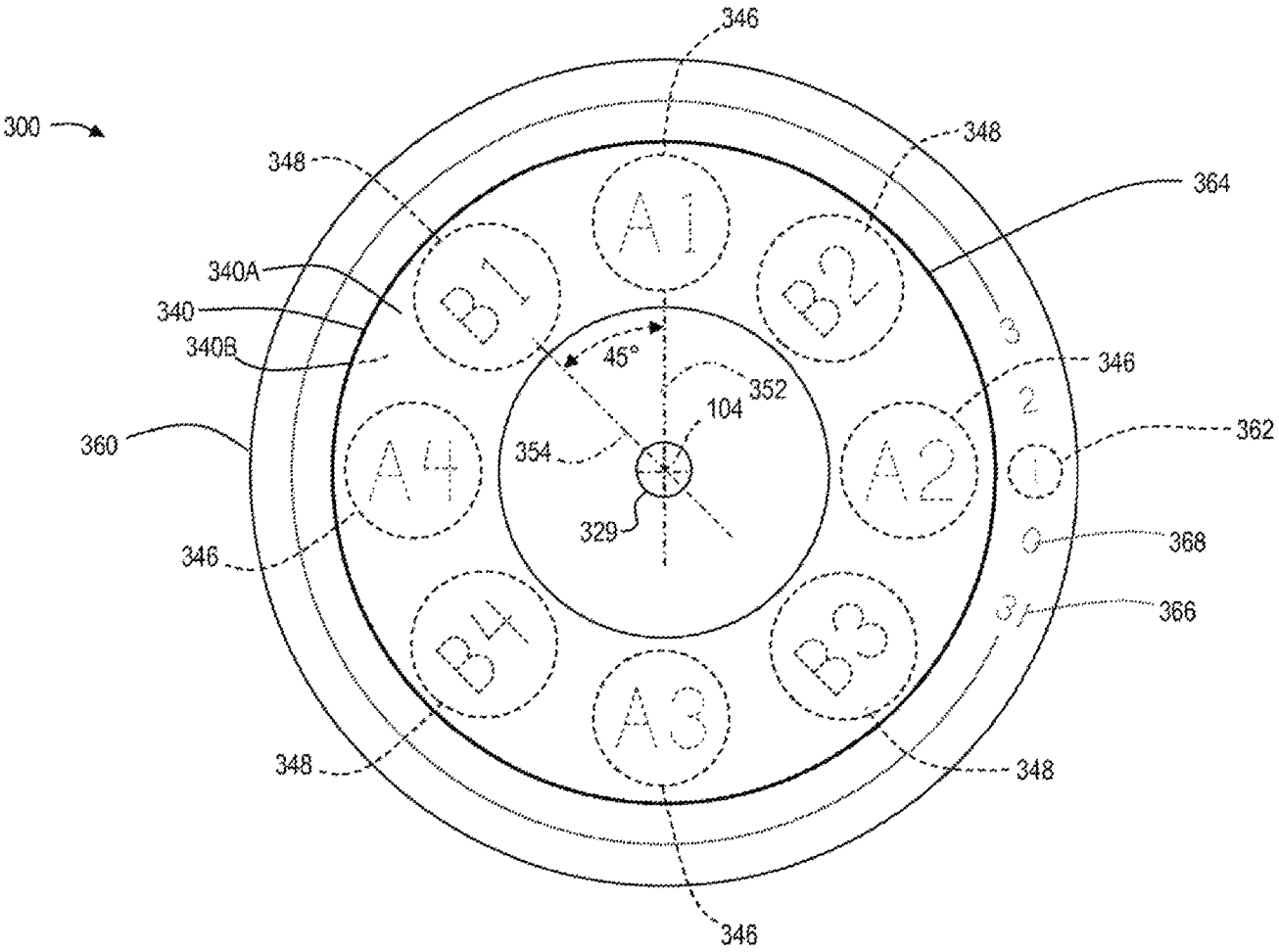
FIG. 12 illustrates a top partial assembly view of an hour dial and a date dial of the third embodiment presented in FIG. 11.

FIG. 12 illustrates a top partial assembly view of the hour dial 340 and the date dial 360 of the third embodiment of the timekeeping device 300, where the date dial 360 is identical to the date dial 260 of the second embodiment of the timekeeping device 200 as shown in FIG. 7 and its accompanying description. However, the hour dial 340 of the third embodiment of the timekeeping device 300 fits within the date dial inner diameter 364 of the date dial 360 such that both the hour dial 340 and the date dial 360 lie in substantially the same plane.

The hour dial 340 includes the first set of 12-hour indicia 346 with exemplary characters A1, A2, A3 and A4 representing a first series of hour indicia that include a first 12-hour period of time, and the second set of 12-hour indicia 348 with exemplary characters B1, B2, B3 and B4 representing a second series of hour indicia that include a second 12-hour period of time. Each of the first set of 12-hour indicia 346 is disposed at an angle of 90-degrees to each other with respect to the central axis of rotation 104. Likewise, each of the second set of 12-hour indicia 348 is disposed at an angle of 90-degrees to each other with respect to the central axis of rotation 104. Thus, both sets of indicia alternate between the first set and second set of indicia around the hour dial 340.

The first set of 12-hour indicia 346 further includes a first common graphical indicia alignment axis 352 where each of the first set of 12-hour indicia 346 is oriented to be displayed in a common direction, (about axis 352), when the hour dial 340 is in a first position. The second set of 12-hour indicia 348 further includes a second common graphical indicia alignment axis 354 where each of the second set of 12-hour indicia 348 is oriented to be displayed in a second common graphical alignment axis 354 when the hour dial 340 is in a second position. The angle between the first common graphical indicia alignment axis 352 of the first set of 12-hour indicia 346 and the second common graphical indicia alignment axis 354 of the second set of 12-hour indicia 348 is 45-degrees with respect to the central axis of rotation 104.

The date dial 360 includes a date dial indicium display region 362 is positioned to display a series of date dial indicia 366. The date dial indicium display region 362 may be oriented with respect to the central axis of rotation 104 at the "3 o'clock" position to be aligned with the fifth fixed dial date aperture 327.

The series of date dial indicia 366 is exemplary illustrated similar to FIG. 7. A date dial inner diameter 364 may interface with the date dial actuator 112 as described above. The date dial inner diameter 364 may include a gear track, (not shown), that engages a mating gear of the date dial actuator 112 or may include other known mechanisms that transfer the rotational motion of the date dial actuator 112 to the date dial 360.

In summary, the third embodiment of the timekeeping device further includes the third dial 360 adjacent the first dial rear side 320B, and an inner diameter 364 of the third dial 360 encompassing an outer diameter 356 of the second dial 340.

FIG. 13A illustrates a top assembly view of the third embodiment of the timekeeping device 300 where the fixed dial 320 is overlaying both the hour dial 340 and the date dial 360 lying substantially within the same plane. The first set of 12-hour indicia 346 of the hour dial 340 is oriented by the hour dial actuator 110 of the timekeeping device movement 102 to be display through the four fixed dial hour apertures 322, 324, 326 and 328. Likewise, the date dial actuator 112 orients the date dial 360 to position the appropriate indicium of the series of date dial indicium 366, (see FIGS. 7 and 12), relative to the function of the timekeeping device, to be displayed through the fifth fixed dial date aperture 327.

Figure 13B:
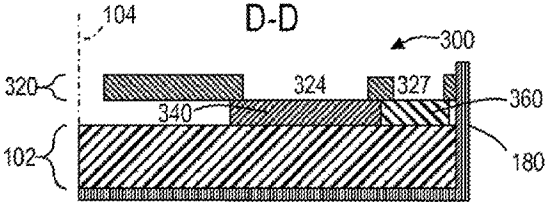
FIG. 13B illustrates a partial cross-sectional view along line D-D of the top assembly view of the third embodiment presented in FIG. 13A.

FIG. 13B illustrates a partial cross-sectional view along line D-D of the top assembly view of FIG. 13A where a timekeeping device case 180 encloses the timekeeping device movement 102, the date dial 360 and the hour dial 340 lying in substantially the same plane, and the fixed dial 320, (including one of the four fixed dial hour apertures, 324, and the fifth fixed dial aperture 327). Fixed dial 320 is fixed to the timekeeping device case 180 with respect to the timekeeping device movement 102. However, the hour dial 340 and the date dial 360 are able to freely rotate with respect the timekeeping device case 180.

In summary, the third embodiment of the timekeeping device further includes the plurality of first dial apertures 322-328 further including a fifth first dial aperture 327, the fifth first dial aperture 327 positioned outside a radius R3 from the central axis of rotation 104 containing the four first dial apertures 322-328.

Figure 14A:
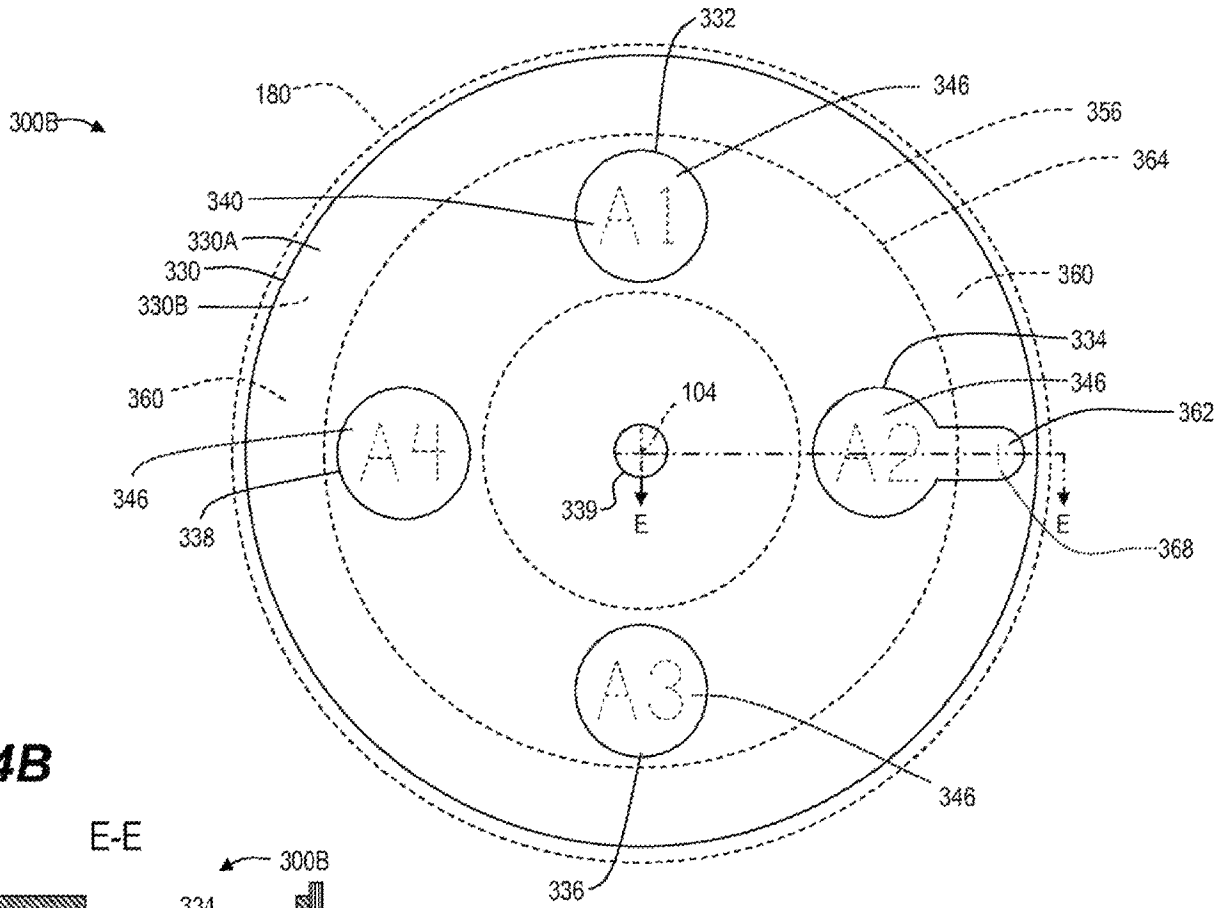
FIG. 14A illustrates a top assembly view of an alternative embodiment of the third embodiment presented in FIGS. 11-13B.

FIG. 14A illustrates atop assembly view of an alternative third embodiment of the timekeeping device 300A with an alternative fixed dial 330 overlaying both the hour dial 340 and the date dial 360 that are substantially lying in the same plane. The first set of 12-hour indicia 346 of the hour dial 340 is oriented by the hour dial actuator 110 of the timekeeping device movement 102 to be display through alternative four fixed dial hour apertures 332, 334, 336 and 338. Likewise, the date dial actuator 112 orients the date dial 360 to position the appropriate indicium of the series of date dial indicium 366, (see FIG. 7), relative to the function of the third embodiment of the timekeeping device 300, to be displayed through the one of the four fixed dial hour apertures. One of the alternative four fixed dial hour apertures, e.g., 334, allows for the display of either the first or second set of 12-hour indicia 346 or 348 of the hour dial 340, and a date dial indicium 368 of the date dial 360 at the date dial indicium display region 362. Additionally, a fixed dial central aperture 339 may be disposed to allow the plurality of concentric indicator hand attachment stems 106 to be connected to the plurality of indicator hands 108 above the alternative fixed dial front side 330A opposite the alternative fixed dial rear side 330B.

Figure 14B:
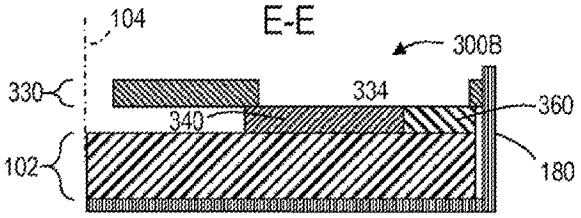
FIG. 14B illustrates a cross-sectional view along line E-E of the alternative embodiment of the third embodiment presented in FIG. 14A.

FIG. 14B illustrates a partial cross-sectional view along line E-E of the top assembly view of FIG. 14A where a timekeeping device case 180 encloses the timekeeping device movement 102, the date dial 360 and the hour dial 340 substantially lying in the same plane, and the alternative fixed dial 330, including one of the alternative four fixed dial hour apertures, (e.g., aperture 334), revealing indicia via portions of both the hour dial 340 and the date dial 360.

Additionally, the alternative fixed dial hour aperture 334 may be positioned at any one of the other alternative fixed dial hour apertures, that is, where aperture 322, 326 or 328 may be located in FIG. 14A. If any of these alternative positions are chosen to display the hour dial 340 and the date dial 360, the orientation of the series of date dial indicia 366 may be changed to be readable though the aperture at any one of these different locations.

In summary, the third embodiment of the timekeeping device further includes an alternative embodiment where one of the plurality of first dial apertures 334 being positioned over a portion of the second dial 346 and a portion of the third dial 362. A third dial 360 is adjacent the first dial rear side 320B, and an inner diameter 364 of the third dial 360 encompasses an outer diameter 356 of the second dial 340.

FIGS. 15A-15C and FIG. 16 illustrate several embodiments that illuminate certain features of the rotating hour dial (140, 240 and 340) illustrated in the previously described embodiments. 1llumination is often needed to display certain features of timekeeping devices in low or no-light environments. However, since certain display portions, e.g., the first or second 12-hour indicia sets 146, 246, 346 or 148, 248, 348 of the hour dial 140, 240 or 340, respectively, at certain 12-hour segments of a 24-hour period remain behind the fixed dial 120, 220, 320, respectively, there exists a need for self-illuminating these portions of the hour dial at various light environments during any given 24-hour period.

Figure 15A:
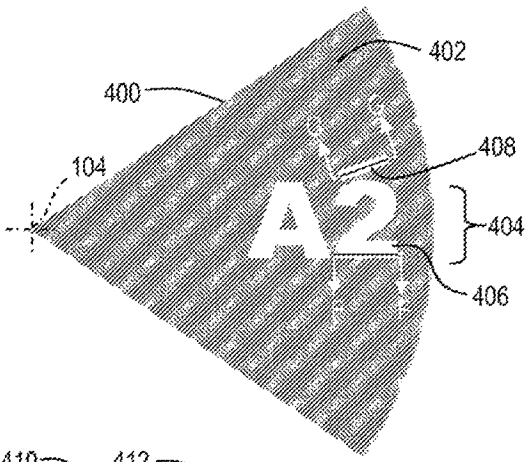
FIG. 15A illustrates a top view of a fourth embodiment of illumination elements for use on an hour dial with the embodiments presented herein.
Figure 15B:
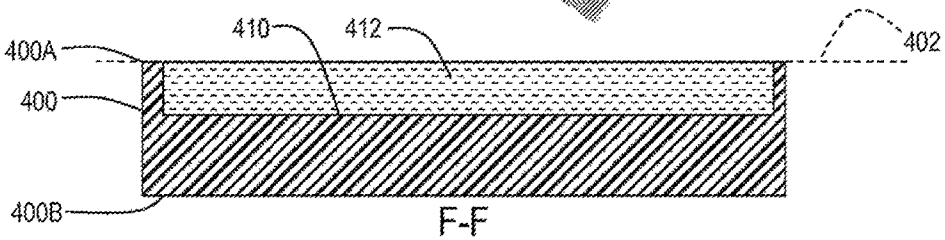
FIG. 15B illustrates a partial cross-sectional view along line F-F of the fourth embodiment of the illumination element presented in FIG. 15A.
Figure 15C:
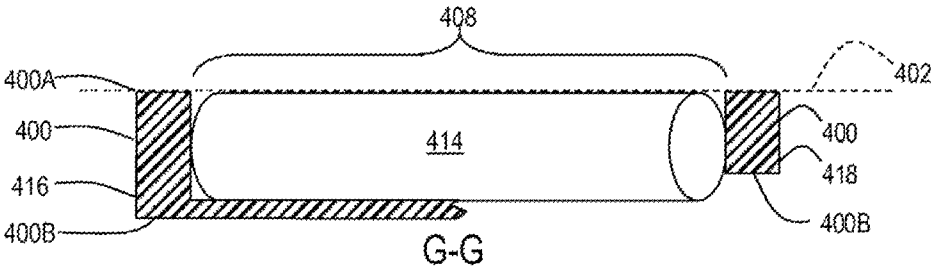
FIG. 15C illustrates a partial cross-sectional view along line G-G of the fourth embodiment of the illumination element presented in FIG. 15A.

A requirement of any self-illumination feature located within the hour dial in the embodiments described herein must accommodate the rotation of the hour dial positioned between the fixed dial and the date dial. FIG. 15A-15C illustrates a top view of an exemplary first self-illumination embodiment where self-illumination elements are located within a representative hour dial 400. This configuration may be used in combination with any of the embodiments already presented herein. FIG. 15A illustrates an hour dial upper surface 402 of the hour dial front side 400A may contain various types of self-illumination elements to enable an hour dial indicium display region 404 to be illuminated. Here, an exemplary hour indicium 406 represented by the characters "A2" may have self-illumination features. In addition, an illuminated marker region 408 may provide for various illuminated markings on the face of the hour dial 400, for example, incremental second marks. Since the hour dial 400 oscillates 45-degrees between two positions under the fixed dial 120, 220 or 320, any self-illumination elements cannot interfere with the fixed dial rear side 120B, (e.g., see FIG. 1), or the upper surface of the date dial 160 when moving between these two positions.

FIG. 15B illustrates a cross-sectional view along line F-F of FIG. 15A of an illumination element that may be used in combination with any of the embodiments presented above, and particularly with respect to indicia on the hour dial 400. Cross section F-F illustrates one embodiment of a self-illumination element on a portion of indicia on an exemplary first hour dial indicium display region 404. In particular, the exemplary indicium characters "A2" includes a recess 410 in the hour dial upper surface 402 of the hour dial 400. The recess 410 may receive a photo-luminescent material 412 deposited upon the hour dial upper surface 402 of the hour dial 400 where any excess material that remains above the hour dial upper surface 402 of the hour dial 400 is removed before the photo-luminescent material 412 is permanently dried or cured. The photo-luminescent material 412 may include luminescent paint or other materials that illuminate for a period of time after being exposed to particular electromagnetic radiation wavelengths.

FIG. 15C illustrates a cross-sectional view along line G-G of FIG. 15A of another illumination element that may be used in combination with any of the embodiments presented above. Cross section G-G illustrates illuminated marker region 408 on the hour dial 400 located either within the regions or proximate to the regions of the first or second representative sets of indicia as disclosed above. The illuminated marker region 408 may be disposed in the hour dial upper surface 402 and may receive a radio-luminescent gaseous tritium gas (also known as T2, 3H2, or hydrogen-3, a radioactive isotope of hydrogen) light source comprising a sealed thin glass tube or tritium vial 414 having inner surfaces thereof coated with phosphor. FIG. 15C illustrates two separate configurations for the hour dial 400 receiving the tritium vial 414. First, on the left side of FIG. 15C, the hour dial 400 has a first hour dial depth profile 416 where the hour dial 400 profile is thicker than the tritium vial 414 and supports the tritium vial 414 within a trench in the hour dial 400. A second configuration on the right side of FIG. 15C illustrates the hour dial 400 including a second hour dial depth profile 418 being less than the tritium vial 414. In this configuration the tritium vial 414 may be secured to the hour dial 400 by an adhesive and/or a press-fit configuration to an aperture in the hour dial 400 as the hour dial rear side 400B may be less than or equal in depth to the tritium vial 414. Both of the configurations however illustrate that the tritium vial 414 is secured below the hour dial upper surface 402 of the hour dial front side 400A of the hour dial 400. Additionally, both first and second hour dial depth profiles 416 and 418 are configured such that any illumination sources will not interfere with the movement of the date dial under the hour dial 400 as shown in the previous embodiments of FIGS. 1-14B.

In summary, a timekeeping device may further include the first set of indicia 146 and the second set of indicia 148 further including a self-illuminating feature 412, 414, the self-illuminating feature disposed below a surface 400A of the second dial 400 and adjacent the first dial rear side 120B. The self-illuminating feature further comprising at least one of a photo-luminescent material 412, or a sealed radio-luminescent filled container 414.

Figure 16:
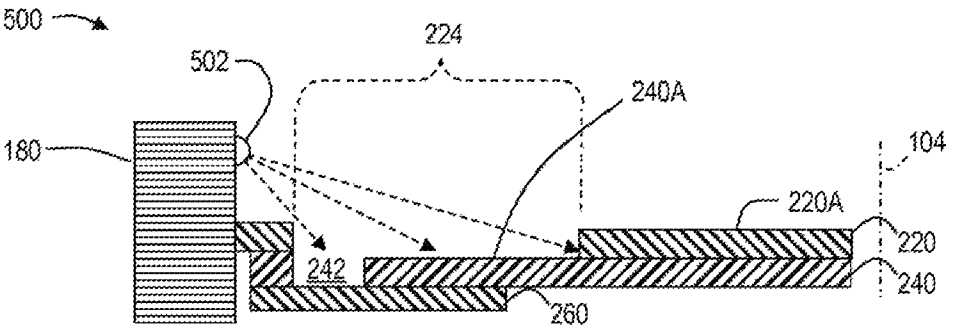
FIG. 16 illustrates a cross-sectional view of an alternate fourth embodiment of the illumination element presented herein.

FIG. 16 illustrates a cross-sectional view, (similar to the second embodiment shown in FIGS. 6-10A), of an alternate illumination configuration 500 that may be used in combination with any of the embodiments presented above to directly illuminate the hour dial 140, 240 or 340 indicia regions through the apertures in the fixed dial 120, 220 or 320 with an illumination source. An illumination source 502 may be disposed on the timekeeping device case 180 or on any element attached to the timekeeping device case 180, (not shown), that may direct visible or non-visible light radiation from an illumination source 502 through the fixed dial hour apertures (e.g., 124) in the fixed dial 220 to the hour dial front side 240A. Additionally, the date dial 260 and the date dial indicia may be illuminated in the same manner through the hour dial date/day aperture 242. The illumination source may be a battery powered light source such as a Light Emitting Diode (LED) or may be a self-illuminating light source like the tritium vial 414 as discussed above in FIGS. 15A-15C. In addition, the date dial 260 at the date dial display region may be illuminated by the illumination source 502 if so desired though the hour dial date/day aperture 242 of the hour dial 240. 1llumination of both the hour dial and the date dial as shown in the previous embodiments may be accomplished in a similar manner.

Further summarizing, a timekeeping device may include an illuminating device 502 for illuminating one of the first set of indicia 146 and the second set of indicia 148 on the second dial 140, 204, 304, the illuminating device 502 oriented on the timekeeping device to enable illuminating of one of the first set of indicia 146 or the second set of indicia 148 through the plurality of first dial apertures 122-128, 222-228, 322-328.

Figure 17:
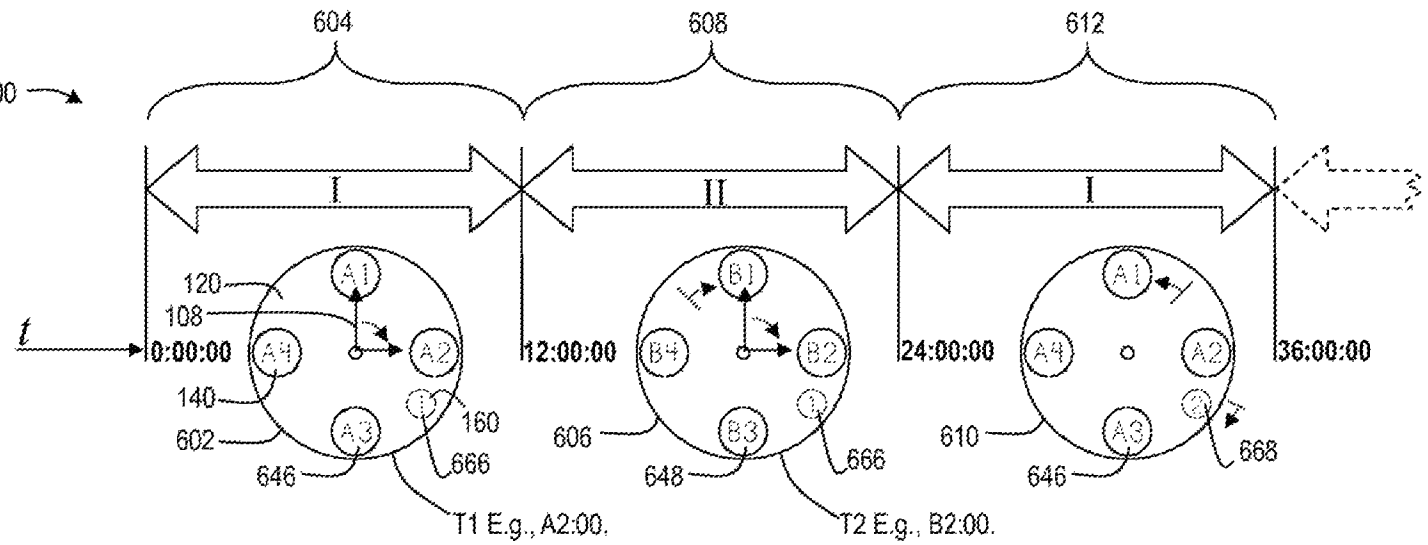
FIG. 17 illustrates a schematic diagram of a fifth embodiment of a method of operating a time display mode on the timekeeping device presented in FIGS. 1-14B.

FIG. 17 illustrates a schematic diagram of a method for presenting a time display mode 600 on a timekeeping device displaying a time using two sequential 12-hour periods of time. For representative purposes only, FIG. 17 depicts the first embodiment illustrated in FIGS. 1-5B. However, the other above-presented embodiments pertaining to FIGS. 6-14B may operate in a similar manner according to each of their particular features. FIG. 17 illustrates the fixed dial 120 overlaying the hour dial 140 and the date dial 160, where the latter two dials are driven by the timekeeping device movement 102, (not shown, see FIG. 1). Additionally, a plurality of indicator hands 108 overlay all these dials to indicate a specific time "t" during one of two 12-hour timekeeping periods displayed by the rotation of the hour dial 140 under the fixed dial 120. See FIGS. 1-5B, in particular for the first embodiment, and FIGS. 6-14B in general for the second and third embodiments and their accompanying disclosure above.

A first display 602 illustrates a timekeeping device display during a first 12-hour time period 604, (represented by the Roman numeral "I"), i.e., a period of time between t=0:00, and t=12:00. The hour dial 140 displays a first set of 12-hour indicia 646, (e.g., A1, A2, A3, A4) in the apertures of the fixed dial 120, and the date dial 160 displays a first date indicium 666 value of "I" in an aperture of the fixed dial 120 and the hour dial 140 per the first embodiment as described above. The plurality of indicator hands 108 rotate in a clockwise direction to indicate an exemplary time of T1, (e.g., A2:00), where A2 is a third hour incremented from an hour value of A1. For example, if A1 were 0:00, then A2 would be 03:00.

A second display 606 of the same timekeeping device illustrates a timekeeping device display during a second 12-hour time period 608, (represented by Roman numeral "II"), i.e., a period of time between t=12:00 and t=24:00. The hour dial 140 will have rotated 45-degrees in a first direction beneath the fixed dial 120 at the beginning of the second 12-hour time period 608, (as discussed above), to display a second set of 12-hour indicia 648, (e.g., B1, B2, B3, B4) in the apertures of the fixed dial 120, while the date dial 160 displays the same first date indicium 666 value of "I" in the aperture of the fixed dial 120 and the hour dial 140 per the first embodiment as described above. The plurality of indicator hands 108 continue to rotate in a clockwise direction to indicate an exemplary time of T2, (e.g., B2:00), where B2 is a third hour incremented from an hour value of B1. For example, if B1 were 12:00, then B2 would be 15:00.

A third display 610, similar to the first display 602, illustrates a timekeeping device display during a third 12-hour time period 612, (similar to the first 12-hour time period 604, represented by Roman numeral "I"), during a cumulative period of time between t=24:00 and t=36:00. The hour dial 140 rotates 45-degrees in a second direction opposite the first direction beneath the fixed dial 120, (as discussed above), to re-display the first set of 12-hour indicia 646, (A1, A2, A3, A4) in the apertures of the fixed dial 120. However, the date dial 160 displays a second incremented date indicium 668 value of "2" in the aperture of the fixed dial and the hour dial per the first embodiment as described above, since the second instance of the first 12-hour time period is within a new 24-hour time period, thereby necessitating incrementing the value of date dial indicia by a single unit value from "1" to "2".

The time display mode 600 continues to oscillate the hour dial 140 between the first 12-hour period "I" and the second 12-hour period "II" for every 12-hour hour period thereafter, while incrementing the date dial indicia value once for every completed first and successive second 12-hour period, that is, every 24-hour period.

Figure 18:
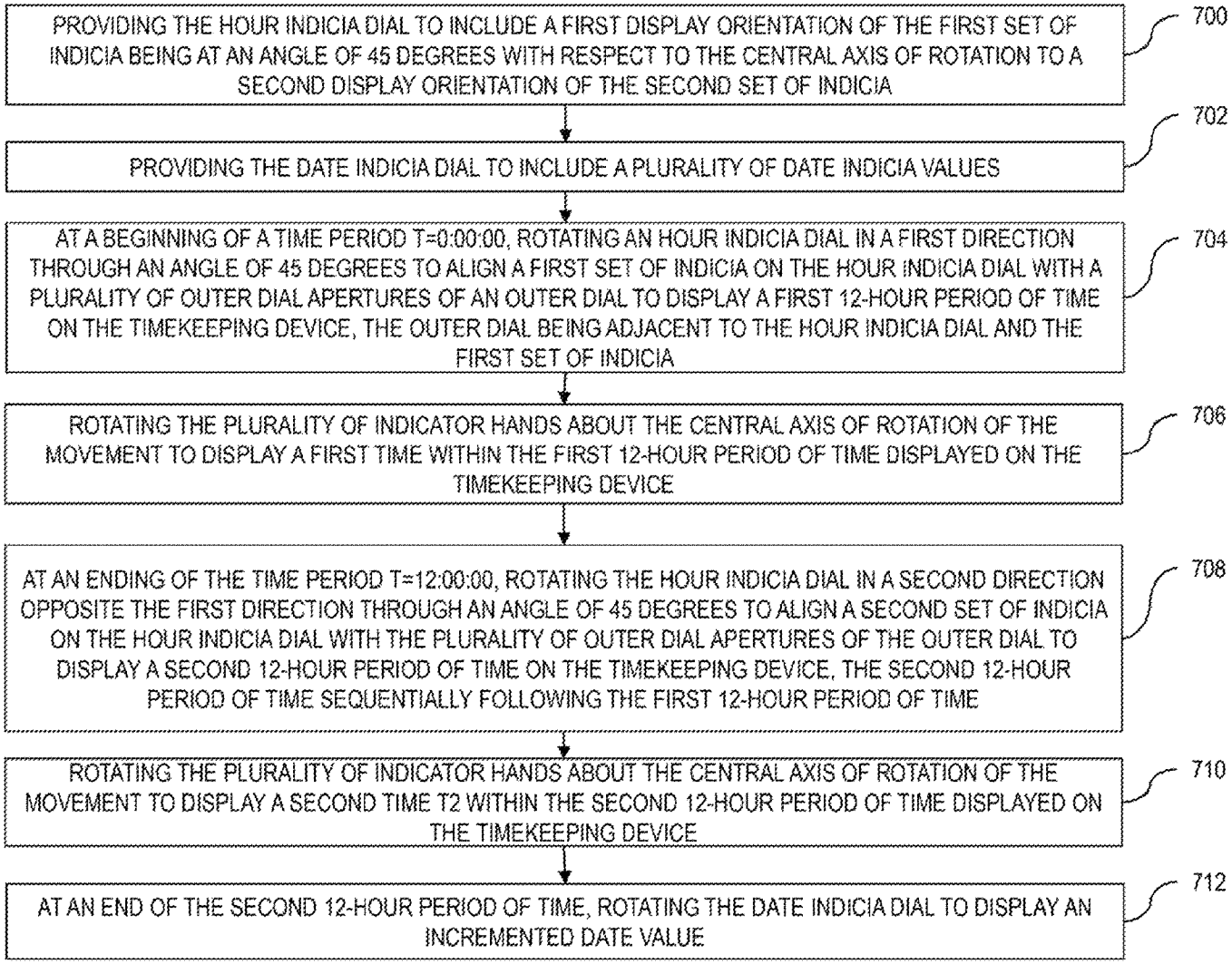
FIG. 18 illustrates a logic flowchart of the fifth embodiment of the method of operating the time display mode on a timekeeping device presented in FIG. 17.

FIG. 18 illustrates a logic flowchart of a method for displaying a series of sequential timekeeping periods on a timekeeping device as described in FIG. 17 and according to the exemplary first embodiment of FIGS. 1-5B. However, the other above-presented embodiments pertaining to FIGS. 6-14B may operate in a similar manner according to each of their particular features. The method includes providing 700 the hour dial 140 to include a first common graphical indicia alignment axis 152 of the first set of 12-hour indicia 146 being at an angle of 45-degrees with respect to the central axis of rotation 104 to the second common graphical indicia alignment axis 154 of the second set of 12-hour indicia 148. The date dial 160 is provided 702 to include a series of date dial indicia 166.

The method further includes at a beginning of a time period, t=0:00, rotating 704 the hour dial 140 in a first direction through an angle of 45-degrees to align a first set of 12-hour indicia 146 on the hour dial 140 with four fixed dial hour apertures 122, 124, 126, 128 of a fixed dial 120 to display a first 12-hour period of time ("I") on the timekeeping device. The fixed dial 120 is adjacent to the hour dial 140 and the first set of 12-hour indicia 146.

The method further rotates 706 the plurality of indicator hands 108 about the central axis of rotation 104 of the timekeeping device movement 102 to display a first time T1 within the first 12-hour period of time "I" displayed on the timekeeping device.

At an ending of the time period "I" where t=12:00, the hour dial 140 is rotated 708 in a second direction opposite the first direction through an angle of 45-degrees to align a second set of 12-hour indicia 148 on the hour dial 140 with the four fixed dial hour apertures 122, 124, 126, 128 of the fixed dial 120 to display a second 12-hour period of time "II" on the timekeeping device, the second 12-hour period of time "II" sequentially following the first 12-hour period of time "I."

The plurality of indicator hands 108 are rotated 710 about the central axis of rotation 104 of the timekeeping device movement 102 to display a second time T2 within the second 12-hour period of time "II" displayed on the timekeeping device. At an end of the second 12-hour period of time "II," the date dial 160 may be rotated 712 to display an incremented date value.

Figure 19:
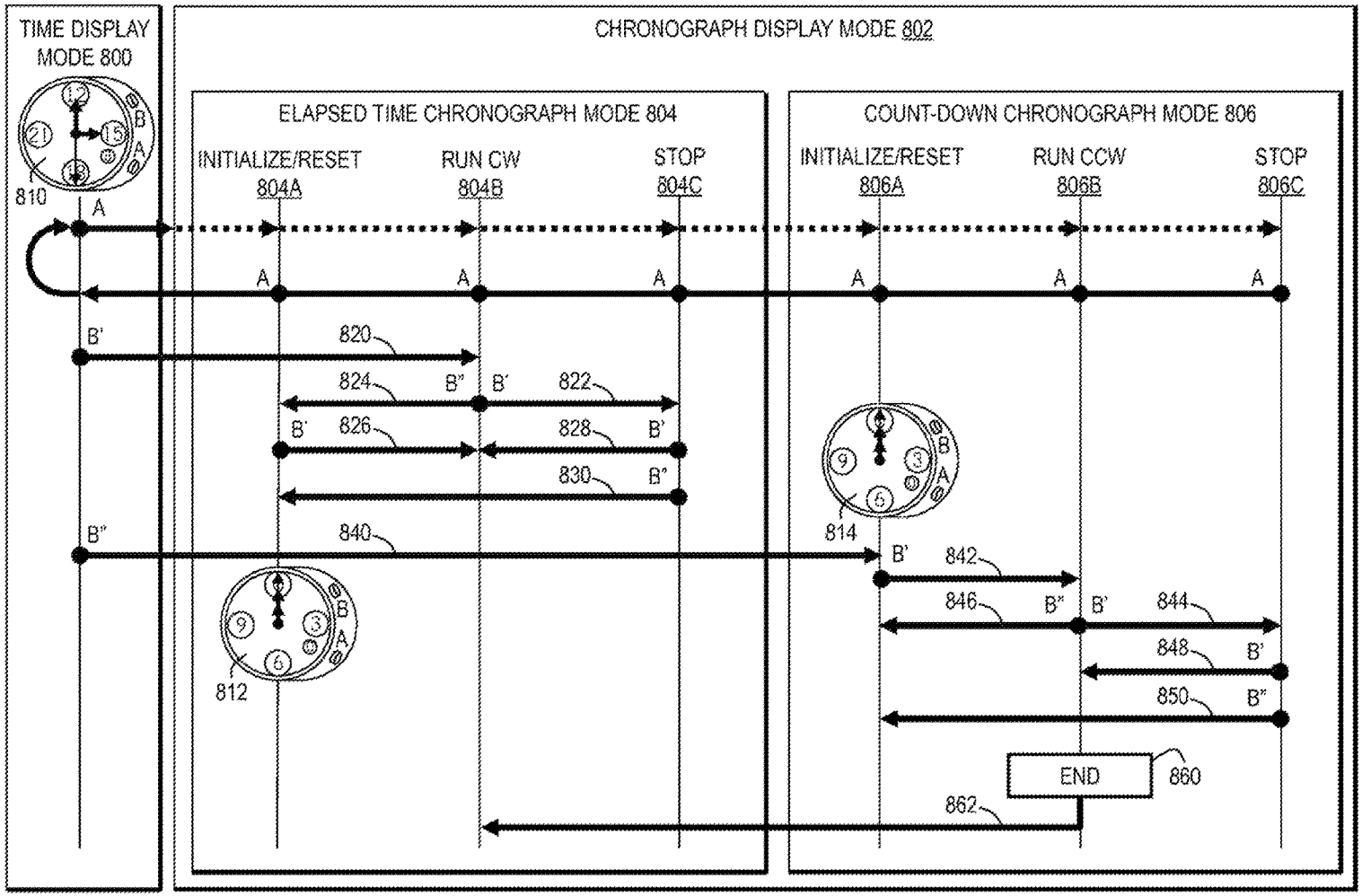
FIG. 19 illustrates a logic state diagram for toggling between a time display mode of FIGS. 17-18 and a chronograph display mode of FIGS. 20-23, and selecting a particular chronograph mode in the chronograph display mode.

FIG. 19 illustrates a logic state diagram for a method of toggling between the time display mode 800, (generally described in FIGS. 17-18), and a chronograph display mode 802, including a selection of either an elapsed time chronograph sub-mode 804 or a countdown chronograph sub-mode 806, both described in more detail in FIGS. 20-21 and FIGS. 22-23, respectively.

A timekeeping device 810 is illustrated having a configuration similar to the embodiment described in FIGS. 1-5B. However, any of the other embodiments described FIGS. 6-14B may be used to illustrate this operation example. An exemplary first time is displayed on the timekeeping device 810 where hour, minute and second indicator hands are aligned at an exemplary 3 o'clock position and the hour dial, showing through the apertures in the fixed dial, is rotated to indicate the actual time display being 15:00:30. Additionally, an exemplary date is indicated on date dial, visible through the apertures in the hour dial and the fixed dial, to be the 8th day of the month. The timekeeping device 810 may also include a first actuator labeled "A" and a second actuator labeled "B." These first A and second B actuators may be any type of input device on or communicating with the timekeeping device 810 that allows a user to provide input thereto during any display mode of the timekeeping device 810 described below. When the timekeeping device 810 is in a time display mode 800, a current time of day in hours, minutes and seconds, and the day of the month is displayed on the face of the timekeeping device 810 as previous described above.

The chronograph display mode 802 consists of two representative chronograph sub-modes: an elapsed time chronograph sub-mode 804; and a countdown chronograph sub-mode 806. Other chronograph modes, sub-modes or functions not presented herein may be additionally accommodated in the logic control of the timekeeping device 810. Each type of chronograph sub-mode has an initialize/reset state 804A/806A, a run state 804B/806B and a stop state 804C/806C. As the timekeeping device 810 is operating within any of these chronograph sub-modes, when the first actuator A is actuated, the timekeeping device 810 toggles to the time display mode 800 to display the current time. When the first actuator A is actuated again in the time display mode 800, the timekeeping device 810 toggles back to the last operating chronograph sub-mode and last operational state the timekeeping device was in. For example, if the timekeeping device 810 is in the stop state 804C of the elapsed time chronograph sub-mode 804, and the first actuator A is actuated, the timekeeping device 810 reverts back to the time display mode 800 to display the current time. If the first actuator A is actuated again in the time display mode 800, the timekeeping device 810 reverts back to the last operating chronograph state the timekeeping device 810 was in before the time display mode 800 was actuated, i.e., the stop state 804C of the elapsed time chronograph sub-mode 804. The dotted lines in FIG. 19 indicate this toggling function to return to the last active operational chronograph state within the chronograph display mode 802.

Operations in the elapsed time chronograph sub-mode 804 will now be described. When the timekeeping device 810 is in the time display mode 800 and the second actuator B is actuated in a first manner, (denoted by B', for example, pressing and quickly releasing the second actuator B), the timekeeping device 810 passes through the initialize/reset state 804A of the elapsed time chronograph sub-mode 804 and immediately enters 820 the run state 804B of the elapsed time chronograph mode 804. In the elapsed time chronograph run state 804B, the timekeeping device displays an elapsed time by sequentially advancing the second indicator hand, the minute indicator hand, and the hour indicator hand in a clock-wise direction, and actuates the hour dial and the date dial in the manner previous described in the embodiments presented in FIGS. 1-14B.

In the elapsed time chronograph run state 804B, when the second actuator B is actuated in the first manner B', the elapsed time chronograph enters 822 a stop state 804C and stops registering the elapsed time. However, while in the elapsed time chronograph run while 804B, when the second actuator B is actuated in a second manner, (denoted by B", for example, pressing and holding the second actuator B for brief period of time before releasing), the elapsed time chronograph reverts back 824 to the initialize/reset state 804A where the elapsed time chronograph is reset by initializing all the time and day values to null or zero values. The timekeeping device 810 in the initialize/reset state 804A causes all the indicator hands to move to the 12 o'clock position, the hour dial to rotate to an initialized position showing the first or "0" hour in the 12 o'clock position, and the date dial to rotate to the null or "0" date position as depicted by the initialize/reset schematic diagram 812. In the elapsed time chronograph initialize/reset state 804A, when the second actuator B is actuated in the first manner B', the elapsed time chronograph enters 822 the run state 804B as previously described above.

In the elapsed time chronograph stop state 804C, when the second actuator B is actuated in the first manner B', the elapsed time chronograph enters 828 back into the run state 804B, effectively restarting the elapsed time chronograph. However, in the elapsed time chronograph stop state 804C, when the second actuator B is actuated in the second manner B", the elapsed time chronograph enters 830 the initialize/reset state 804A where the elapsed time chronograph is reset by initializing all time and date values to null or zero values as previously described above.

Operations in the countdown chronograph sub-mode 806 will now be described. When the timekeeping device 810 is in the time display mode 800 and the second actuator B is actuated in the second manner B", the timekeeping device 810 enters 840 a countdown chronograph initialization/reset state 806A. The timekeeping device 810 in the initialization/reset state 806A causes all indicator hands to move to the 12 o'clock position, the hour dial to rotate to an initialized position showing the first or "0" hour in the 12 o'clock position, and the date dial to rotate to the null or "0" date position as depicted by the initialize/reset schematic diagram 814. The operator may then input to the timekeeping device 810 an initial countdown time through any combination of first and second actuators or other input actuation means not described herein but well known in the art. The initial countdown time may consist of any combination of seconds, minutes, hours and days that may be displayed on the timekeeping device via the second, minute and hour indicator hands, the rotating hour dial 140 and the rotating date dial 160. For example, if a user wanted to input an initial countdown time of 1 day, 17 hours, 30 minutes and 10 seconds, the date dial would be rotated to display a "1" value to indicate a first 24-hour period of time, the hour dial would rotate to a second position to indicate a second 12-hour period of time between 12:00 and 24:00, the hour indicator hand would rotate to the 17:00 hour position, (the typical 5 o'clock position), the minute indicator hand would rotate to the 30 minute position and the second indicator hand would rotate to the 10 second position.

After the initial countdown time has been set in the countdown chronograph initialization/reset state 806A, when the first actuator B is actuated in a first manner B', (as described above,) the countdown chronograph enters 842 a run state 806B and the timekeeping device 810 sequentially decrements the second indicator hand, the minute indicator hand, and the hour indicator hand in a counter clock-wise direction, and actuates the hour dial and the date dial in a manner such that their indicated values are all being decremented towards a null countdown time value of 0 days, 0 hours, 0 minutes and 0 seconds. In particular, the date dial and hour dial operate in a reverse manner to indicate a reverse direction of operation as described in the embodiments presented in FIGS. 1-14B.

In the countdown chronograph run state 806B, when the second actuator B is actuated in the first manner B', the countdown chronograph mode 806 enters 844 a stop state 806C and stops counting down time from the initial countdown time value. However, in the countdown chronograph run state 806B, when the second actuator B is actuated in the second manner B", (as described above), the countdown chronograph re-enters 846 the initialization/reset state 806A where the countdown chronograph is reset and all time and date values are initialized to null or zero values and awaits for the user to enter a new initial countdown time value as described above.

In the countdown chronograph stop state 806C, when the second actuator B is actuated in the first manner B', the countdown chronograph enters 848 back into the run state 806B, effectively restarting the countdown chronograph from the last value before it was stopped. However, in the countdown chronograph stop state 806C, when the second actuator B is actuated in the second manner B", the countdown chronograph re-enters 850 the initialization/reset state 806A where the countdown chronograph is reset and all time and date values are initialized to null or zero values as previously described above.

When the countdown chronograph sub-mode 806 arrives at the end 860 of the initial set countdown time value in the run state 806B, the timekeeping device 810 may cause the countdown chronograph mode 806 to automatically switch to the elapsed time chronograph run state 804B causing the timekeeping device 810 indicator hands, hour dial and date dial to resume movement in a clockwise manner to increment an elapsed time value. This dual chronograph mode feature is important for events including a preliminary countdown time period immediately before the start of an event where an elapsed time chronograph record is necessary thereafter.

In summary, the embodiments presented herein include a method of displaying a series of sequential timekeeping periods on a timekeeping device 810 including a movement 102, a central axis of rotation 104 and a plurality of indicator hands 108 rotationally connected to the movement 102 at the central axis of rotation 104. The method further includes providing the hour indicia dial to include a first display orientation 152/252/352 of the first set of indicia 146 being at an angle of 45-degrees, with respect to the central axis of rotation 104, to a second display orientation 154/254/354 of the second set of indicia 148. The plurality of indicator hands 108 may rotate about the central axis of rotation 104 of the movement 102 to display a first time within the first 12-hour period of time displayed on the timekeeping device. The plurality of indicator hands may be rotated about the central axis of rotation 104 of the movement 102 to display a second time within the second 12-hour period of time displayed on the timekeeping device.

A chronograph display actuator "A" switches the timekeeping device 810 between a time display mode 800 and a chronograph display mode 802, where a method further includes actuating the chronograph display actuator "A" to switch to the chronograph display mode 802 from the time display mode 800, and rotating the plurality of indicator hands 108 about the central axis of rotation 104 of the movement 102 to display a chronograph time within the first 12-hour period of time displayed on the timekeeping device 810.

Figure 20:
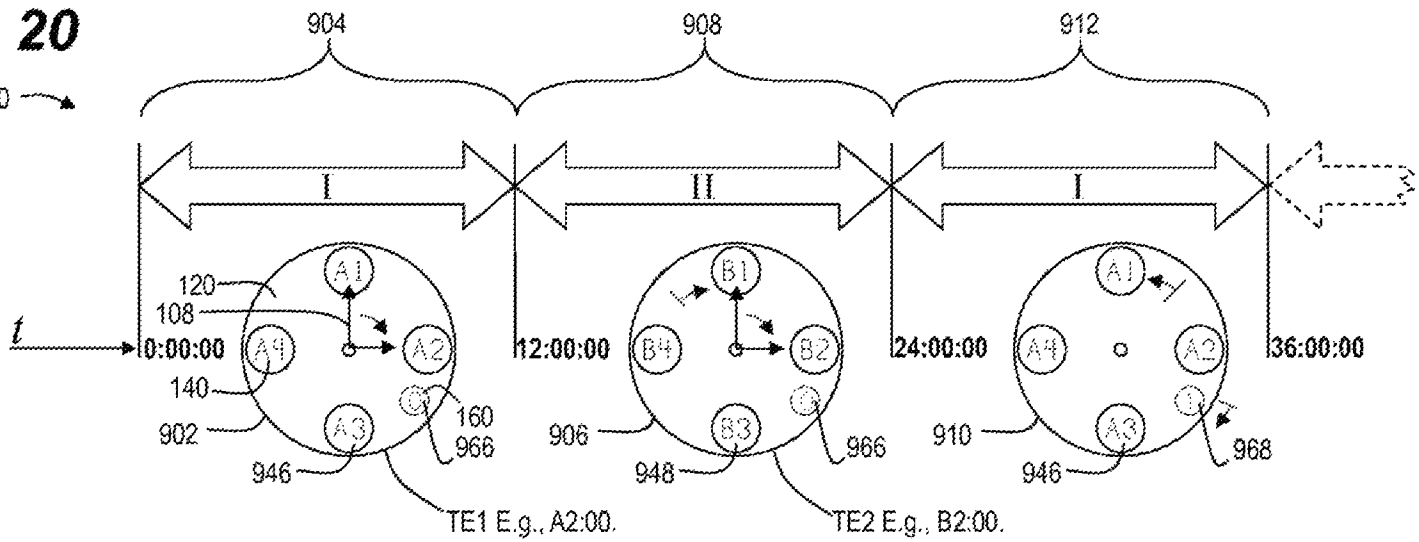
FIG. 20 illustrates a schematic diagram of a sixth embodiment of a method of operating an elapsed time chronograph in the chronograph display mode presented in FIG. 19.

FIG. 20 illustrates a schematic diagram of a method for presenting the elapsed time chronograph in a chronograph display mode 900 for use with a timekeeping device displaying an elapsed time using two sequential 12-hour periods of time as illustrated in FIG. 19 by reference numbers 820-830. For representative purposes only, FIG. 20 depicts the first embodiment illustrated in FIGS. 1-5B. However, the other above-presented embodiments pertaining to FIGS. 6-14B may operate in a similar manner according to each of their particular features. FIG. 20 illustrates the fixed dial 120 overlaying the hour dial 140, and the date dial 160, the latter two dials being driven by the timekeeping device movement 102, (not shown, see FIG. 1). Additionally, a plurality of indicator hands 108 overlay all these dials to indicate a specific time "t" during one of two 12-hour timekeeping periods displayed by the rotation of the hour dial 140 under the fixed dial 120. See FIGS. 1-5B, in particular, and FIGS. 6-14B in general for the second and third embodiments disclosed above.

A first display 902 illustrates an elapsed time chronograph device display for an elapsed time within a first 12-hour time period 904, (represented by Roman numeral "I"), of a cumulative period of time between t=0:00, and t=12:00. The hour dial 140 displays a first set of 12-hour indicia 946, (e.g., A1, A2, A3, A4) in the apertures of the fixed dial 120, and the date dial 160 displays a first date indicium 966 value of "0" in an aperture of the fixed dial 120 and the hour dial 140 per the first embodiment as described above. In this embodiment, the date dial's 160 first date indicium 966 value of "0" indicates that the elapsed time chronograph has been "zeroed", that is, it is set to a null date value before the passing of a first 24-hour period of the elapsed time chronograph. The plurality of indicator hands 108 rotate in a clockwise direction from a 0:00 position, (shown in FIG. 19 at reference number 812), to indicate an exemplary elapsed time of T1, (e.g., A2:00), where A2 is a third hour incremented from an hour value of A1. For example, if A1 were 0:00, then A2 would be 03:00.

A second display 906 of the same timekeeping device illustrates an elapsed time chronograph device display with a second 12-hour time period 908, (represented by Roman numeral "II"), of a cumulative period of time between t=12:00 and t=24:00. The hour dial 140 will have rotated 45-degrees in a first direction beneath the fixed dial 120 at the beginning of the second 12-hour time period 908, (as discussed above), to display a second set of 12-hour indicia 948, (e.g., B1, B2, B3, B4) in the apertures of the fixed dial 120, while the date dial 160 displays the same first date indicium 966 null value of "0" in the aperture of the fixed dial 120 and the hour dial 140 per the first embodiment as described above. The plurality of indicator hands 108 continue to rotate in a clockwise direction to indicate an exemplary elapsed time of T2, (e.g., B2:00), where B2 is a third hour incremented from an hour value of B1. For example, if B1 were 12:00, then B2 would be 15:00.

A third display 910, similar to the first display 902, illustrates an elapsed chronograph device display with a third 12-hour time period 912, (similar to the first 12-hour time period 904, represented by Roman numeral "I"), of a cumulative period of time between t=24:00 and t=36:00. The hour dial 140 rotates 45-degrees in a second opposite direction beneath the fixed dial 120, (as discussed above), to re-display the first set of 12-hour indicia 946, (e.g., A1, A2, A3, A4) in the apertures of the fixed dial 120. However, the date dial 160 displays a second incremented date indicium 968 value of "1" in the aperture of the fixed dial 120 and the hour dial 140 per the first embodiment as described above, since the second instance of the first 12-hour time period is within a new 24-hour time period, thus necessitating incrementing the value of date dial indicia by a single unit value from "0" to "1".

The elapsed time chronograph in a chronograph display mode 900 continues to oscillate the hour dial 140 between the first 12-hour period "I" and the second 12-hour period "II" for every 12-hour period thereafter, while incrementing the date dial indicia value one unit value for every completed first and successive second 12-hour period, that is, every 24-hour period.

In summary, the plurality of indicator hands rotate about the central axis of rotation 104 of the movement 102 to display a first elapsed chronograph time TE1 within the first 12-hour period of time displayed on the timekeeping device 810, and a second elapsed chronograph time TE2 within the second 12-hour period of time displayed on the timekeeping device.

Figure 21:
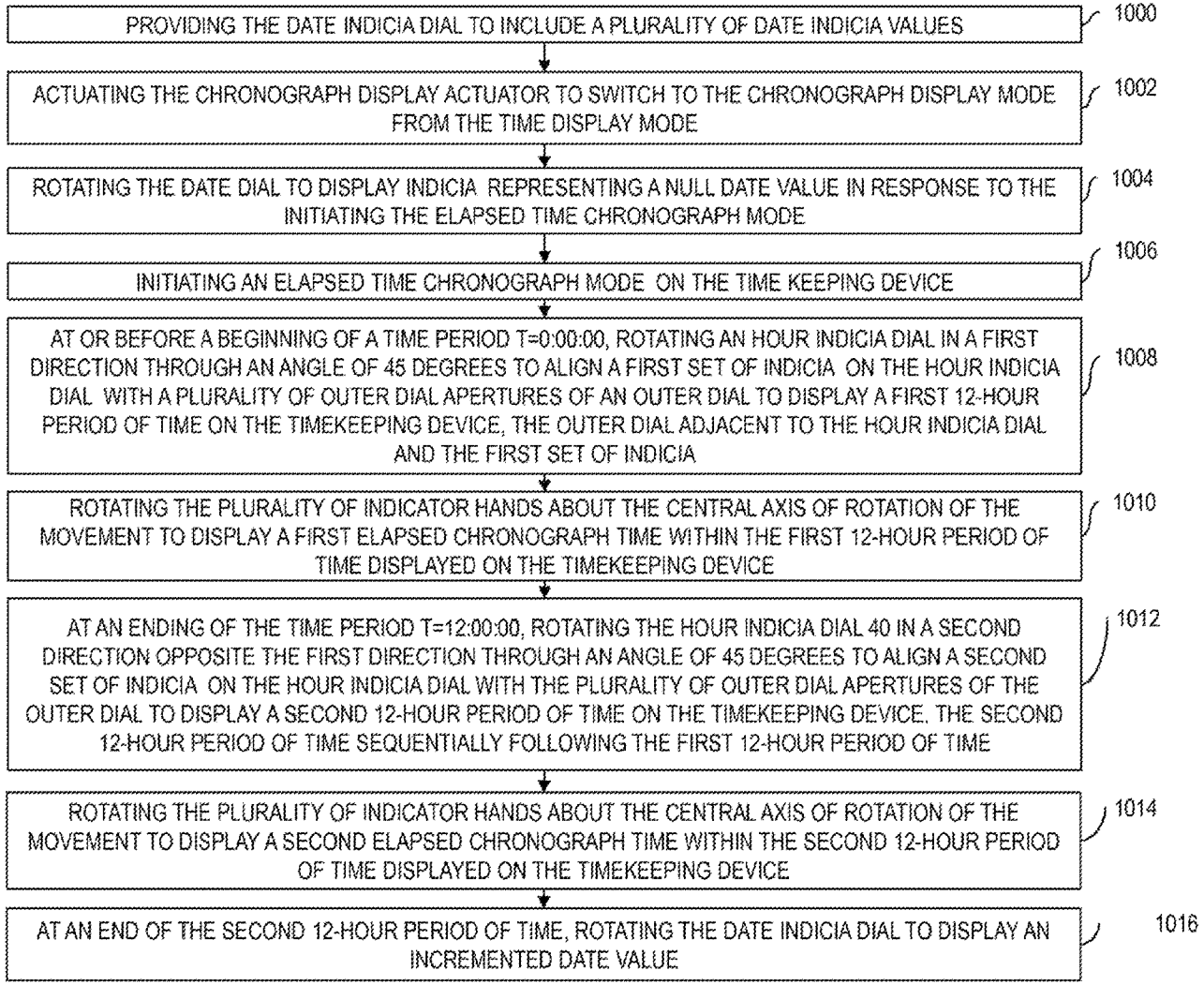
FIG. 21 illustrates a logic flowchart of the sixth embodiment of the method of operating the elapsed time chronograph in the chronograph display mode presented in FIG. 20.

FIG. 21 illustrates a logic flowchart of a method for displaying a series of sequential timekeeping periods on a timekeeping device that displays an elapsed time for an elapsed time chronograph using two sequential 12-hour periods of time according to FIG. 20 of the exemplary first embodiment of FIGS. 1-5B. However, the other above-presented embodiments pertaining to FIGS. 6-14B may operate in a similar manner according to each of their particular features.

The method includes providing 1000 the date dial 160 to include a series of date dial indicia 166. A chronograph actuator B is actuated 1002 to switch to a chronograph display mode 802 from a time display mode 800. The chronograph display mode 802 enters an initialize/reset state 804A and rotates 1004 the date dial to display indicia representing an initial null or "0" value, while all the other indicators return to their initial "0" values. An elapsed time chronograph run state 804B is initiated 1006 on the time keeping device by an actuator.

The method further includes at or before a beginning of a time period, t=0:00, rotating 1008 an hour dial 140 in a first direction through an angle of 45-degrees to align a first set of 12-hour indicia 146 on the hour dial 140 with four fixed dial hour apertures 122, 124, 126, 128 of a fixed dial 120 to display a first 12-hour period of time ("I") on the timekeeping device. The fixed dial 120 is adjacent to the hour dial 140 and the first set of 12-hour indicia 146.

The method further rotates 1010 a plurality of indicator hands 108 about the central axis of rotation 104 of the timekeeping device movement 102 to display a first time T1 within the first 12-hour period of time "I" displayed on the timekeeping device.

At or immediately before an ending of the time period "I" where t=12:00, rotating 1012 the hour dial 140 in a second direction opposite the first direction through an angle of 45-degrees to align a second set of 12-hour indicia 148 on the hour dial 140 with the four fixed dial hour apertures 122, 124, 126, 128 of the fixed dial 120 to display a second 12-hour period of time "II" on the timekeeping device, the second 12-hour period of time "II" sequentially following the first 12-hour period of time "I."

The plurality of indicator hands 108 are rotated 1014 about the central axis of rotation 104 of the timekeeping device movement 102 to display a second time T2 within the second 12-hour period of time "II" displayed on the timekeeping device. At an end of the second 12-hour period of time "II," the date dial 160 may be rotated 1016 to display an incremented date value.

In summary, a chronograph display actuator A is actuated to switch to the chronograph display mode 802 from the time display mode 800, and either simultaneously or shortly thereafter, an elapsed time chronograph run state is initiated on the timekeeping device. The date indicia dial is rotated to display a null date value in response to initiating the elapsed time chronograph state and the plurality of indicator hands are rotated about the central axis of rotation of the movement to display a first elapsed chronograph time TE1 within the first 12-hour period of time displayed on the timekeeping device. The plurality of indicator hands 108 may continue to rotate about the central axis of rotation 104 of the movement 102 to display a second elapsed chronograph time TE2 within the second 12-hour period of time displayed on the timekeeping device. Finally, at an end of the second 12-hour period of time, the date indicia dial may be rotated to display an incremented date value 968.

Figure 22:
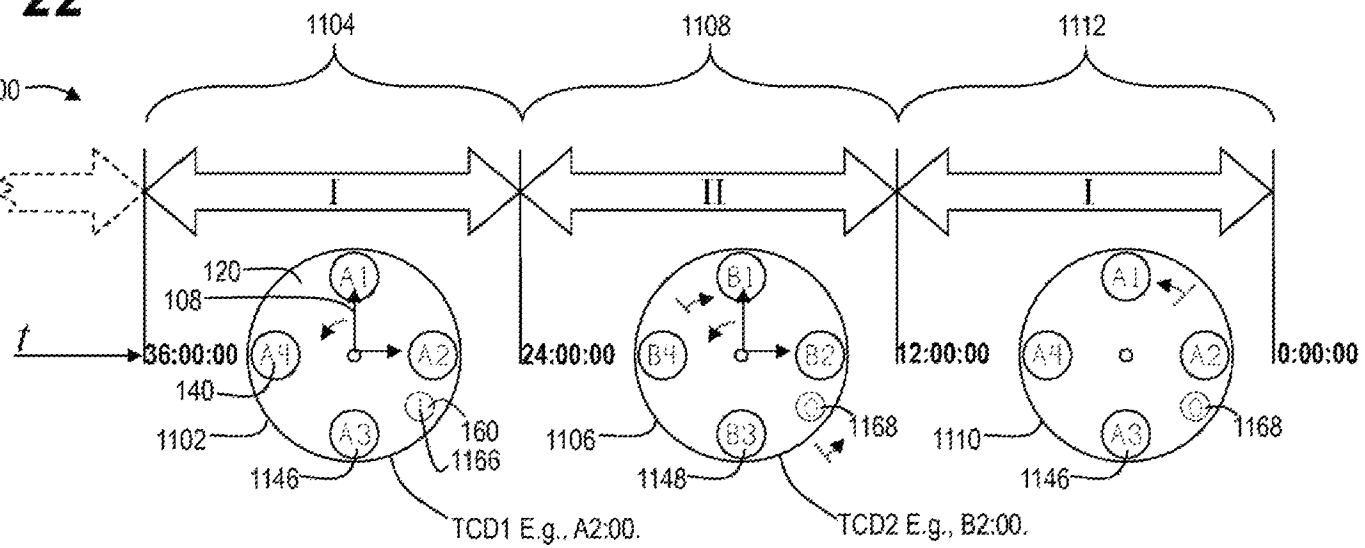
FIG. 22 illustrates a schematic diagram of a seventh embodiment of a method of operating a countdown chronograph in the chronograph display mode presented in FIG. 19.
Figure 23:
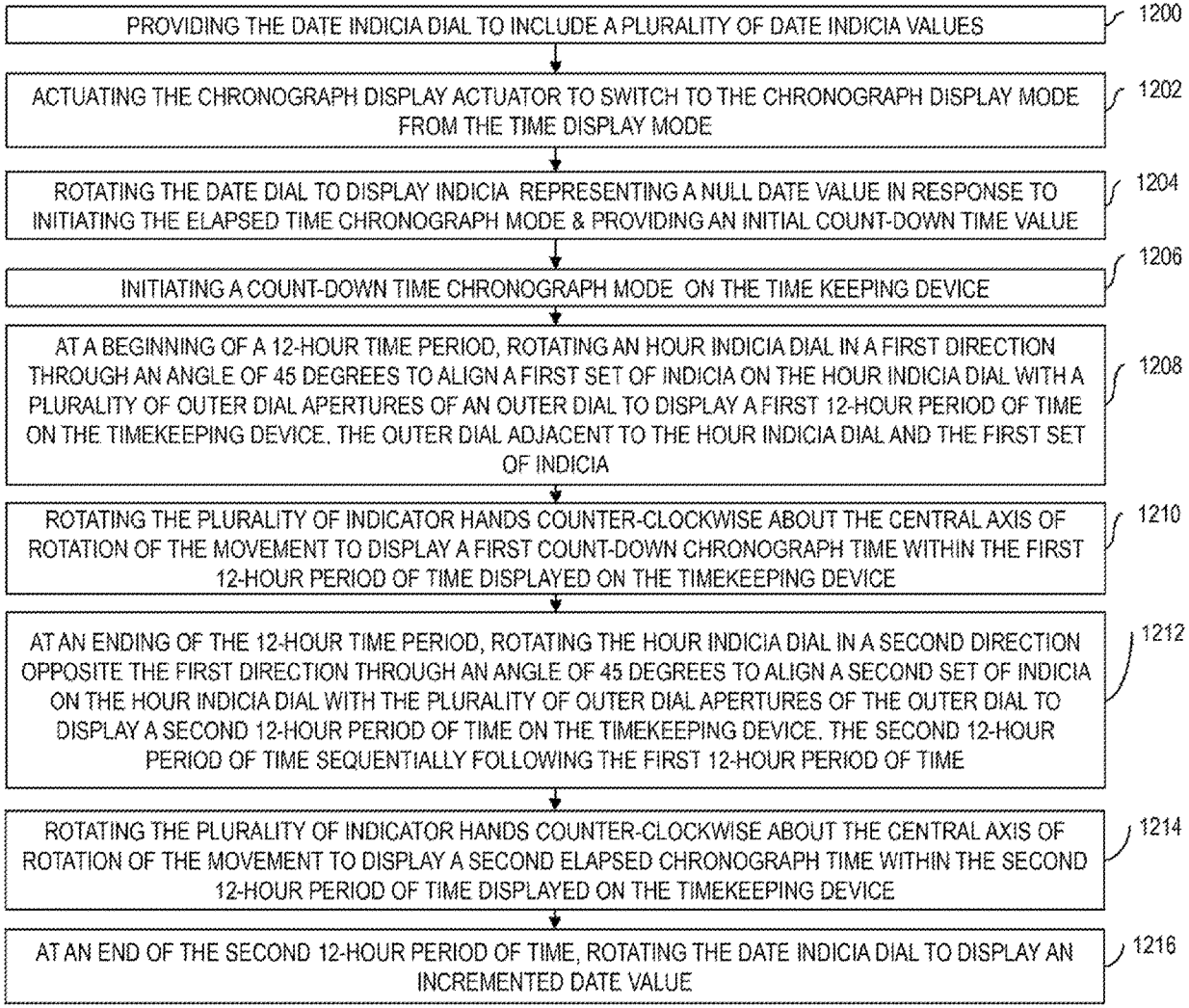
FIG. 23 illustrates a logic flowchart of the seventh embodiment of the method of operating the countdown chronograph in the chronograph display mode of FIG. 22.

FIG. 22 illustrates a schematic diagram of a method of displaying a countdown chronograph in a chronograph display mode 1100 for use with the timekeeping device displaying a countdown time using two sequential 12-hour periods of time as illustrated in FIG. 19 by reference numbers 840-860. FIGS. 22-23 for representative purposes illustrate only the first embodiment depicted in FIGS. 1-5B, but the other above presented embodiments pertaining to FIGS. 6-14B may operate in a similar manner according to their particular features. In particular, FIG. 21 illustrates the fixed dial 120 overlaying the hour dial 140 and the date dial 160, the latter two dials being driven by the timekeeping device movement 102, (not shown, see FIG. 1). Additionally, a plurality of indicator hands 108 overlay all these dials to indicate a specific time during one of two 12-hour timekeeping periods displayed by the rotation of the hour dial 140 under the fixed dial 120.

A first display 1102 illustrates a countdown time chronograph device display for a countdown time within a first 12-hour time period 1104, (represented by Roman numeral "I"), of a countdown period of time between t=36:00, and t=24:00. The hour dial 140 displays a first set of 12-hour indicia 1146, (A1, A2, A3, A4) in the apertures of the fixed dial 120, and the date dial 160 displays an exemplary first date indicium 1166 value of "I" in an aperture of the fixed dial 120 and the hour dial 140 per the first embodiment as described above. In this instance, the first date indicium 1166 value of "I" indicates that a countdown time chronograph has been set to include a first 24-hour value corresponding to a value of "I" day, that is, the date dial is set to an exemplary unit date value greater than "0" before the expiration of the first 24-hour period of the countdown time chronograph. The plurality of indicator hands 108 during the operation of the countdown chronograph rotate in a counterclockwise direction from an initial set countdown time position, to indicate an exemplary countdown time of TCD1, e.g., A2:00, where A2 is a third hour incremented from an hour value of A1. For example, if A1 were 0:00 then A2 would be 03:00.

A second display 1106 of the same timekeeping device illustrates a countdown time chronograph device display within a second 12-hour time period 1108, (represented by Roman numeral "II"), of a countdown period of time between t=24:00 and t=12:00. The hour dial 140 will have rotated 45-degrees in a first direction beneath the fixed dial 120 at the beginning of the second 12-hour time period 1108, (where t=24:00), to display a second set of 12-hour indicia 1148, (B1, B2, B3, B4) in the apertures of the fixed dial 120, while the date dial 160 displays a second decremented date indicium 1168 value of "0" in the aperture of the fixed dial 120 and the hour dial 140 per the first embodiment as described above. The value of "0" is displayed since the second 12-hour time period 1108 is within a new 24-hour time period, thus necessitating decrementing the value of date dial indicia by a single unit value from "I" to "0". The plurality of indicator hands 108 continue to rotate in a counterclockwise direction to indicate an exemplary countdown time of TCD2, e.g., B2:00, where B2 is a third hour incremented from an hour value of B1. For example, if B1 were 12:00, then B2 would be 15:00.

A third display 1110, similar to the first display 1102, illustrates a countdown chronograph device display within a third 12-hour time period 1112, (similar to the first 12-hour time period 1104, represented by Roman numeral "I"), of a period of time between t=12:00 and t=0:00. The hour dial 140 rotates 45-degrees in a second opposite direction beneath the fixed dial 120, (as discussed above), to re-display the first set of 12-hour indicia 1146, (A1, A2, A3, A4) in the apertures of the fixed dial. Generally, the countdown chronograph in a chronograph display mode 1100 continues to oscillate the hour dial 140 between the first 12-hour period "I" and the second 12-hour period "II" for every 12-hour hour period thereafter, while decrementing the date dial indicium value once for every completed first and successive second 12-hour period, that is, every 24-hour period. As described in FIG. 19, when the countdown chronograph reaches the end 860 of its set countdown time period, the chronograph state may automatically switch to the elapsed time chronograph run state 804B in the elapsed time chronograph state 804.

FIG. 23 illustrates a logic flowchart of a method for displaying a series of sequential timekeeping periods on a timekeeping device for displaying a countdown chronograph using two sequential 12-hour periods of time according to the exemplary first embodiment of FIGS. 1-5B. However, the other above-presented embodiments pertaining to FIGS. 6-14B may operate in a similar manner according to each of their particular features.

The method includes providing 1200 the date dial 160 to include a series of date dial indicia 166. A chronograph actuator B is actuated 1202 to switch to a countdown chronograph mode 806 from a time display mode 800. The countdown chronograph mode 806 enters through an initialization/reset state 806A and rotates 1204 the date dial to display indicia representing an initial null or "0" value, while all the other indicators, both the plurality of indicator hands 108 and the hour dial 140 return to their initial "0" values to allow the provision of an initial countdown time value to be set. Thereafter, a countdown chronograph run state 806B is initiated 1206 on the timekeeping device 810 by an actuator B.

The method further includes at the beginning of a 12-hour time period, rotating 1208 an hour dial 140 in a first direction through an angle of 45-degrees to align a first set of 12-hour indicia 146 on the hour dial 140 with the four fixed dial hour apertures 122, 124, 126, 128 of a fixed dial 120 to display a first 12-hour period of time on the timekeeping device 810. The fixed dial 120 is adjacent to the hour dial 140 and the first set of 12-hour indicia 146.

The method further rotates 1210 a plurality of indicator hands 108 counter-clockwise about the central axis of rotation 104 of the timekeeping device movement 102 to display a first time within the first 12-hour period of time displayed on the timekeeping device while the countdown chronograph run state 806B is active.

At an ending of the 12-hour time period, the hour dial 140 is rotated 1212 in a second direction opposite the first direction through an angle of 45-degrees to align a second set of 12-hour indicia 148 on the hour dial 140 with the four fixed dial hour apertures 122, 124, 126, 128 of the outer dial 120 to display a second 12-hour period of time on the timekeeping device 810, the second 12-hour period of time sequentially following the first 12-hour period of time.

The plurality of indicator hands 108 are rotated 1214 counter-clockwise about the central axis of rotation 104 of the timekeeping device movement 102 to display a second time within the second 12-hour period of time displayed on the timekeeping device. At an end of the second 12-hour period of time, the date dial 160 may be rotated 1216 to display a decremented date value 1168.

In summary, the chronograph display actuator, e.g., "B" in FIG. 19, is actuated to switch to the chronograph display mode 802 from the time display mode 800, and thereafter rotating, in a counter-clockwise direction, the plurality of indicator hands 108 about the central axis of rotation 104 of the movement 102 to display a first countdown chronograph time TCD1 within the first 12-hour period of time displayed on the timekeeping device 810. Thereafter, the plurality of indicator hands 108 rotate about the central axis 104 of the movement 102 to display a second countdown chronograph time TCD2 within the second 12-hour period of time displayed on the timekeeping device 810. Thereafter, the plurality of indicator hands 108 are rotated in the counter-clockwise direction about the central axis of rotation 104 of the movement 102 to display a second countdown chronograph time TCD2 within the second 12-hour period of time "II" displayed on the timekeeping device 810. At an end of the second 12-hour period of time "II," the date indicia dial proceeds to be rotated to display a decremented date value 1168.

Figure 24A:
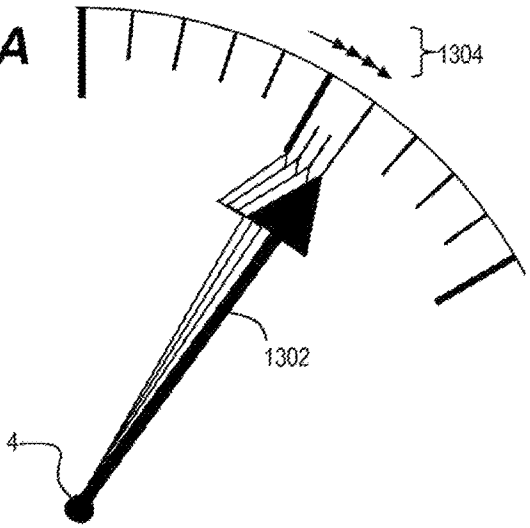
FIG. 24A illustrates a schematic diagram of an eighth embodiment of a method of operating a second indicator hand in one of a time display mode or a chronograph display mode.
Figure 24B:
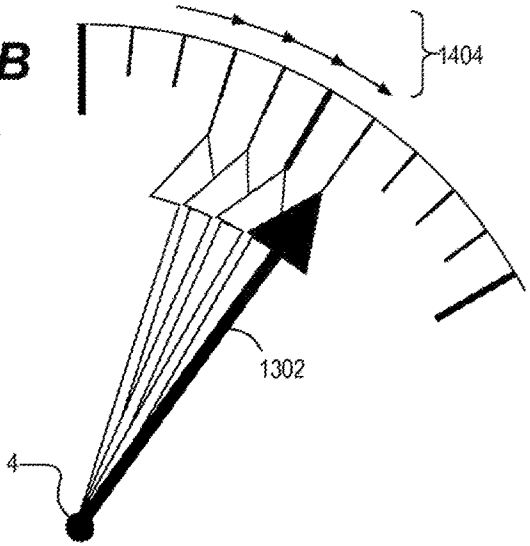
FIG. 24B illustrates a schematic diagram of the eighth embodiment of the method of operating a second indicator hand in one of a time display mode or a chronograph display mode corresponding to FIG. 24A.

FIGS. 24A and 24B illustrate a schematic diagram of a method of operating a second hand indicator in one of two display modes presented above in combination with the embodiments presented herein. The second hand indicator 1302 has two modes of operation that visually distinguish to a user whether the timekeeping device is operating in a time display mode, (as represented in FIG. 19 by the time display mode 800), or a chronograph display mode, (as represented in FIG. 19 by the chronograph display mode 802, generally), which may be operating in either an elapsed time chronograph sub-mode, (FIG. 19, reference numbers 820-830 and FIGS. 20-21), or a countdown chronograph sub-mode, (FIG. 19, reference numbers 840-862 and FIGS. 22-23).

FIG. 24A illustrates a sub-second hand indication mode 1300 where a second hand indicator 1302 controlled by the timekeeping device movement 102, (not shown, see FIG. 1), displays a sub-second second hand angular displacement 1304 through each second indicia on the fixed dial 120 or the hour dial 140. For example, the second hand indicator 1302 may incrementally move three equal positions between each second indicating a quarter of a second period of time, i.e., 0.25 sec., 0.50 sec. and 0.75 sec. In another example, the second hand indicator 1302 may incrementally move four equal positions between each second indicating one-twentieth of a second, i.e., 0.20 sec., 0.40 sec., 0.60 sec. and 0.80 sec. Additionally, the timekeeping device movement 102 may allow for a continuous sweeping or a substantially continuous sweeping angular displacement of the second hand indicator.

FIG. 24B illustrates an incremental second hand indication mode 1400 where a second hand indicator 1302, (the same as in FIG. 24A), is controlled by the timekeeping device movement 102, (not shown, see FIG. 1), to display incremental second indicia hand angular displacement 1404 at each second indicia on the fixed dial 120 or the hour dial 140.

The benefit for having both the sub-second hand indication mode 1300 and the incremental second hand indication mode 1400 is that a user may be presented with a clear indication as to which display mode the timekeeping device is in based on the nature of the movement of the second hand indicator 1302. Either of these indication modes 1300/1400 may be assigned to either of the time display mode (FIG. 19, ref no. 800), or the chronograph display mode (FIG. 19, ref no. 802). This allows a user to determine the priority of the second hand indicator for the display mode the user chooses. For example, if the user determines that having a greater than one-second resolution is important for reading a time result(s) within a chronograph display mode, the user may select the sub-second hand indication mode 1300 for use with any chronograph type in the chronograph display mode(s) 802 and the incremental second hand indication mode 1400 is assigned to the time display mode 800. This selection, for example, may also benefit the user by providing more precise chronograph time readings during the chronograph display mode.

Likewise, if the user determines that displaying a one-second increment is important for reading a time result(s) within a chronograph display mode, the user may select the incremental second hand indication mode 1400 for use with any chronograph type in the chronograph display mode 802 and the sub-second hand indication mode 1300 to be assigned to the time display mode 800. This selection, for example, may benefit the user during a countdown time sequence to better anticipate the end of a certain period of time.

Figure 24C:
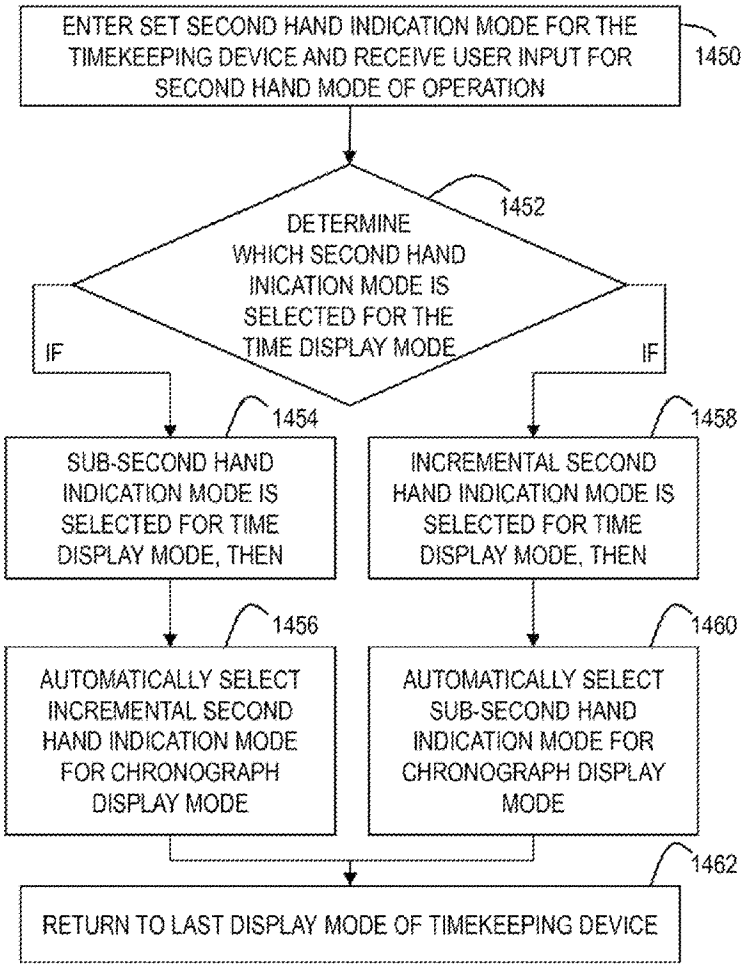
FIG. 24C illustrates a logic flowchart of the eighth embodiment of a method of selecting a second indicator hand indication mode for a timekeeping device for use in one of an operating time display mode or a chronograph display mode as presented in FIGS. 24A-24B.

FIG. 24C illustrates a logic flowchart of a method of selecting a second indicator hand indication mode for the timekeeping device as presented above to indicate whether the timekeeping device is in one of an operating time display mode or a chronograph display mode. The user first enters 1450 a second hand indication setting mode for the timekeeping device where the user selects a second hand mode of operation. The timekeeping device then determines 1452 which second hand indication mode is selected by the user for either display mode, for example in this illustration, the time display mode. If the user selects 1454 the sub-second hand indication mode 1300 for the time display mode, the incremental second hand indication mode 1400 is automatically chosen 1456 for the chronograph display mode.

Likewise, if the user selects 1458 the incremental second hand indication mode 1400 for the time display mode, the sub-second hand indication mode 1300 is automatically chosen 1460 for the chronograph display mode. After setting the second hand indication mode, the timekeeping device returns 1462 to the last display mode operating before the setting function 1450 was initiated.

In summary, a method of displaying the series of sequential timekeeping periods on the timekeeping device further includes, based on the actuating the chronograph display actuator to switch the timekeeping device from the time display mode to the chronograph display mode, causing the second-hand indicator hand 1302 to one of: 1) incrementally move on a second-by-second basis in the chronograph display mode when the second-hand indicator hand incrementally moves on a fraction-of-a-second by a fraction-of-a-second basis in the time display mode; or 2) incrementally move on a fraction-of-second by a fraction-of-a-second basis in the chronograph display mode when the second-hand indicator hand incrementally moves on a second-by-second basis in the time display mode.

Figure 25:
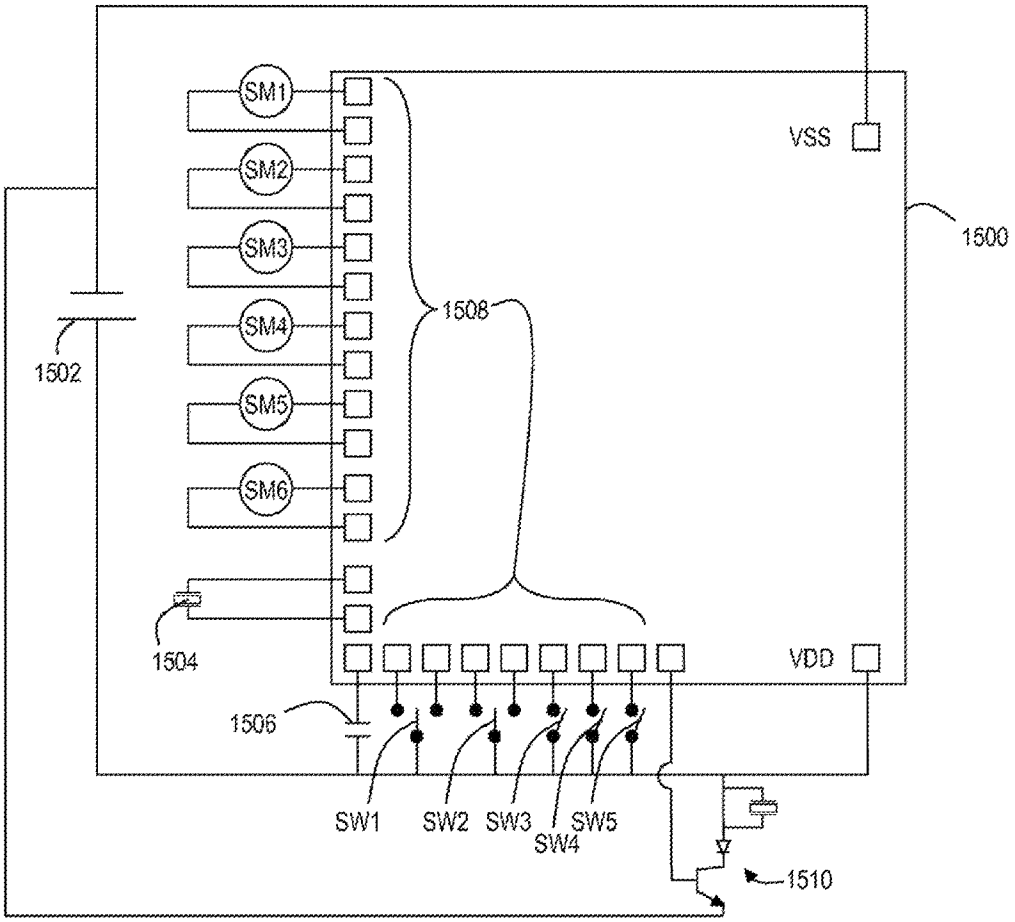
FIG. 25 illustrates a schematic diagram of a ninth embodiment of a controller for use in a timekeeping device to implement the embodiments described in FIGS. 1-24C.
Figure 26:
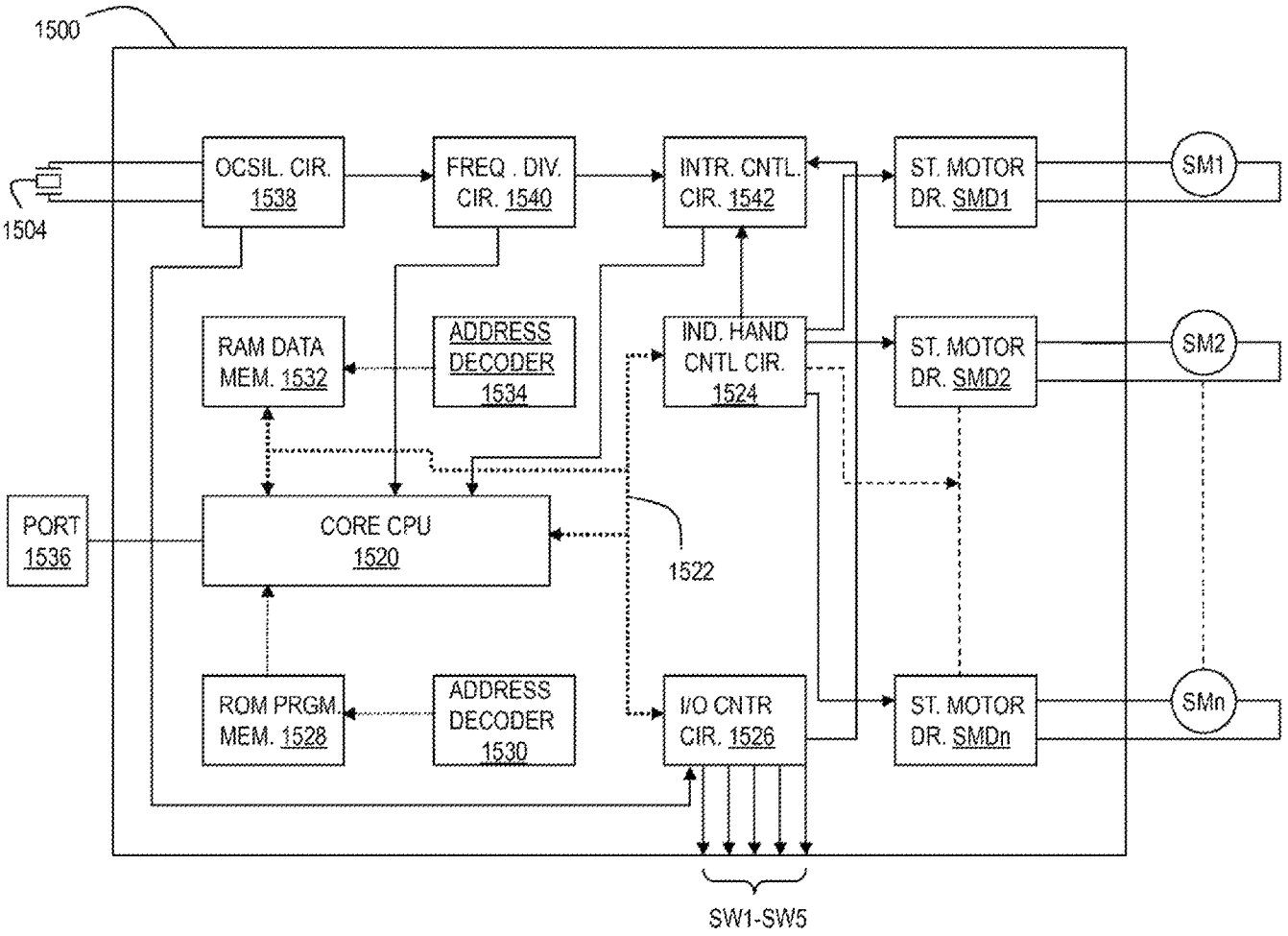
FIG. 26 further illustrates a schematic diagram of the ninth embodiment of the controller illustrated in FIG. 25 for use in a timekeeping device to implement the embodiments described in FIGS. 1-24C.

FIGS. 25-26 illustrates a schematic diagram of a control circuit for the construction of an electronic timekeeping device controller 1500 associated with controlling the timekeeping device movement 102 for the timekeeping device presented in the previously described embodiments of FIGS. 1-14B. Electronic timekeeping device controller 1500, as illustrated in FIG. 25, is preferably an integrated microcontroller that integrates onto a single chip and includes a CPU core, a motor hand control circuit, an input/output control circuit, addressing and decoding functionality, memory and motor drivers further described below with reference to FIG. 26.

FIG. 25 illustrates electronic timekeeping device controller 1500 includes, among other things, a battery 1502, a resonator 1504 to provide basic timing, a filter capacitor 1506, interface connections 1508 to bi-directional stepper motors SM1-SM6 and switches SW1-SW5, although more switches and motors may be added as would be understood by one skilled in the art. A serial sensor interface, (not shown), may also be provided for receiving data from a connected sensor or wireless remote sensor and transmitter. In addition, an alarm circuit 1510 is provided for alarm activation.

Bi-directional stepper motors SM1-SM6 may each separately control the plurality of indicator hands 108 including an hour hand, a minute hand, a second hand, multipurpose/second time zone hand, the hour dial 140 and the date dial 160.

Switches SW1-SW5 are intended to generically indicate either side or top mounted actuation buttons, pushers or rotatable crowns on the timekeeping device case 180 that respond to a user's actuation of pulling, pushing and/or rotating. The pulling, pushing or rotating actuations may be provided to the timekeeping device for toggling timekeeping device display modes, setting indicator hands, setting chronograph features, setting alarm(s), calibration of indicator hands and/or actuating lighting capabilities.

FIG. 26 illustrates a block diagram of electronic timekeeping device controller 1500 that includes a core Central Processing Unit (CPU) 1520 which itself includes an Algorithmic Logic Unit (ALU), a calculation register, a stack pointer, an instruction register and an instruction decoder. The electronic timekeeping device controller 1500 utilizes a memory mapped I/O bus 1522 to communicate with motor indicator hand control circuit 1524 and input/output control circuit 1526.

A ROM program memory block 1528 in cooperation with an address encoder 1530 provide access to electronic device control software and fixed data. The methodology for programming the core CPU 1520 on the steps and logic necessary to keep track of and determine subsequent stepper motor positions is also coded into ROM program memory block 1528.

A RAM data memory block 1532, in cooperation with an address decoder 1534, provides storage for intermediate calculation values and is used to hold current position of the various electronic device components, such as the plurality of indicator hands 108, the hour dial 140 and the date dial 160, and to store changeable information that may be downloaded into electronic timekeeping device controller 1500 through a communication port 1536, which may be an IR port, a keyboard input, a port for optical transmission, LEDs, RF, or a computer interface.

Electronic timekeeping device controller 1500 includes oscillator circuit 1538 which oscillates at a frequency determined by the resonator 1504. A frequency divider circuit 1540 divides the output of oscillator circuit 1538 to generate appropriate timing signals for timekeeping, motor control and data acquisition functions.

The motor indicator hand control circuit 1524 receives a commanded "next number of pulses" from core CPU 1520 and generates pulsed and phased signals necessary to move a desired bi-directional stepper motor(s) (SM1-SMn) a desired amount and in a desired direction. Pulse outputs of the motor indicator hand control circuit 1524 are buffered by bi-directional stepper motor drivers SMD1-SMDn and applied to bi-directional stepper motors SM1-SMn. Bi-directional stepper motors SM1-SMn remain in their last position unless pulsed to move. Therefore, to smoothly display continuously varying information with at least one of the plurality of indicator hands 108, (or hour dial 140 or date dial 160), driven by a stepper motor, the preferred embodiment delivers to the stepper motor the necessary number of pulses to move the rotor of the stepper motor between a desired position at t=0, for example, and a position desired after some small time interval later.

The input/output control circuit 1526 receives the user operated crown and/or pushbutton switch actuations and provides such signaling information to core CPU 1520.

An interrupt control circuit 1542 is connected to frequency divider circuit 1540, motor indicator hand control circuit 1524 and input/output control circuit 1526 and outputs timer interrupts, motor control interrupts, and actuator interrupts to core CPU 1520*s*.

Electronic timekeeping device controller 1500 directly or indirectly controls the rotational movement of the plurality of indicator hands 108, the hour dial 140 and the date dial 160. The timekeeping device disclosed herein in FIGS. 1-14B may also include one or more sensor circuits for measuring external parameters, and providing information to be displayed on the timekeeping device. Such external parameters include, but are not limited to ambient temperature, altitude, body temperature, heart rate, compass headings and global positioning system (GPS) data.

Figure 27:
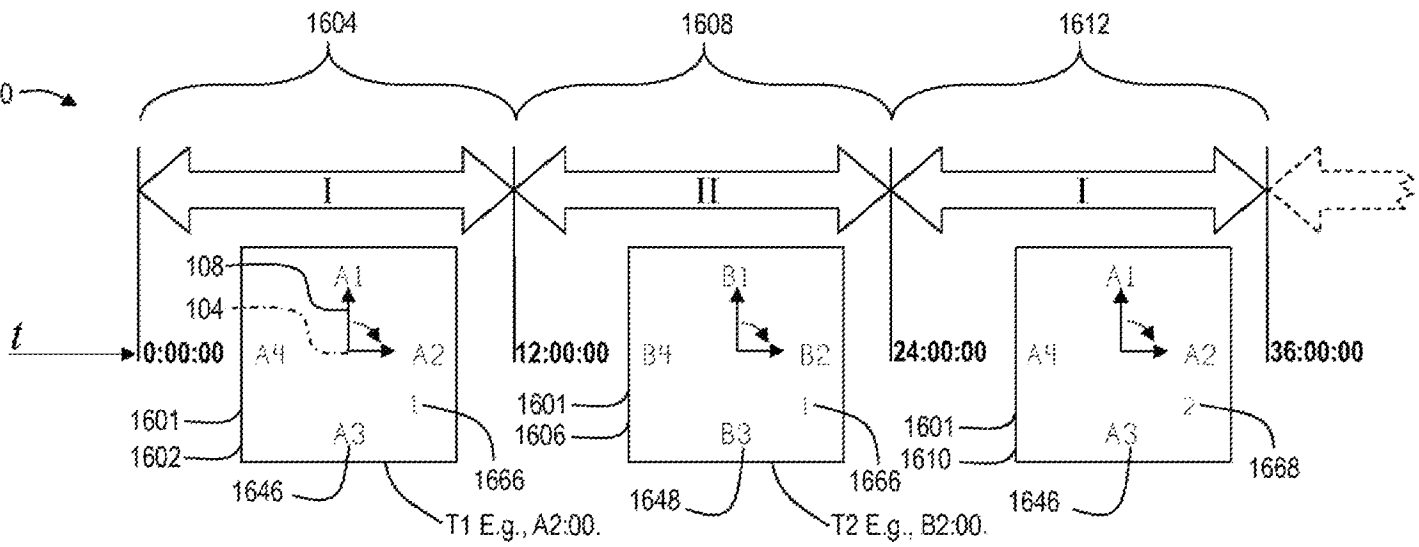
FIG. 27 illustrates a schematic diagram of a tenth embodiment of a method of displaying a time display mode on a graphical display.

FIG. 27 illustrates a schematic diagram of a method for presenting a time display mode 1600 for use on a graphical timekeeping display device 1601 to display a time using two sequential 12-hour periods of time. The graphical timekeeping display device 1601 may include displays including LCD, LED, plasma, CRT ore-ink display technology that are programmed to display graphical images on a graphical display output device. The graphical display embodiment of FIGS. 27-28 generally corresponds to the timekeeping device embodiments depicted in FIGS. 1-14B. In particular, FIG. 27 illustrates a graphical display device representing similar graphically displayed information of the previously described timekeeping device embodiments illustrated in FIGS. 1-14B. Additionally, a plurality of indicator hands 108 may either be incorporated as graphical elements of the graphical display, or may be physical indicator hands overlaying a graphical display to indicate a specific time during one of two 12-hour timekeeping periods displayed on the graphical display, similar to the plurality of indicator hands 108 of the embodiments shown in FIGS. 1-14B.

A first graphical display 1602 illustrates a graphical timekeeping display device 1601 displaying a first 12-hour time period 1604, (represented by Roman numeral "I"), i.e., a cumulative period of time between t=0:00, and t=12:00. A first set of graphical 12-hour indicia 1646, (A1, A2, A3, A4) and a first graphical date indicium 1666 having a value of "1" are displayed on the graphical timekeeping display device 1601 in a manner similar to the physical embodiments described above. The plurality of indicator hands 108 may either graphically rotate within or physically rotate above the graphical display device in a clockwise direction to indicate an exemplary time of T1, e.g., A2:00, where A2 is a third hour incremented from an hour value of A1. For example, if A1 were 0:00, then A2 would be 03:00. In the instant graphical display embodiment, the hour dial and date dial of the embodiments of FIGS. 1-14B have been replaced with graphical output to the graphical timekeeping display device 1601 that accomplishes the same function of displaying two discrete 12-hour increments and the date features on the graphical display.

A second graphical display 1606 of the same graphical timekeeping display device 1601 illustrates a second 12-hour time period 1608, (represented by Roman numeral "II"), i.e., a cumulative period of time between t=12:00 and t=24:00. At the beginning of the second 12-hour time period 1608, (as discussed above), a second set of graphical 12-hour indicia 1648, (B1, B2, B3, B4) is displayed while the same first graphical date indicium 1666 value of "I" is displayed as described above. The plurality of indicator hands 108 continue to either graphically rotate within or physically rotate above the graphical timekeeping display device 1601 in a clockwise direction to indicate an exemplary time of T2, e.g., B2:00, where B2 is a third hour incremented from an hour value of B1. For example, if B1 were 12:00, then B2 would be 15:00.

A third graphical display 1610, similar to the first graphical display 1602, illustrates a graphical timekeeping display device 1601 displaying a third 12-hour time period 1612, (similar to the first 12-hour time period 1604, represented by Roman numeral "I"), i.e., cumulative period of time between t=24:00 and t=36:00, wherein the first set of graphical 12-hour indicia 1646, (A1, A2, A3, A4) are redisplayed. However, a second incremented graphical date indicium 1668 value of "2" is displayed as described above, since the second instance of the first 12-hour time period is within a new 24-hour time period, thus necessitating incrementing the unit value "I" of the first graphical date indicium 1666 to a unit value "2" of the second incremented graphical date indicium 1668.

The method for presenting a time display mode 1600 continues to alternate between the first 12-hour period "I" and the second 12-hour period "II" for every 12-hour hour period thereafter, while incrementing the date indicium value 1666/1668 one unit value for every completed first and successive second 12-hour period, i.e., every 24-hour period.

Figure 28:
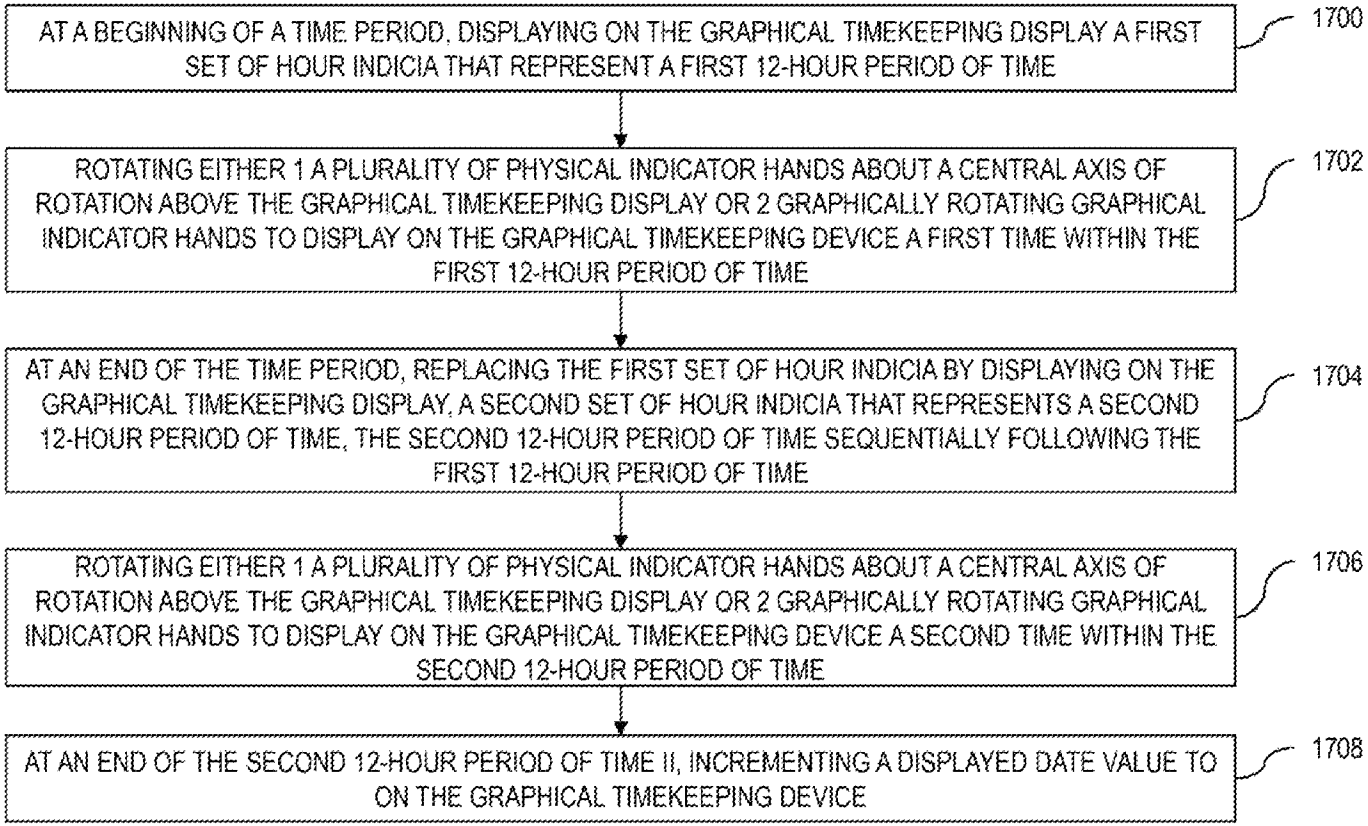
FIG. 28 illustrates a logic flowchart of the tenth embodiment of the method of operating a time display mode on a graphical display presented in FIG. 27.

FIG. 28 illustrates a logic flowchart of a method of operating a graphical display in a time display mode on that includes, at a beginning of a time period, (t=0:00), displaying 1700 a first set of graphical hour indicia (e.g., A1, A2, A3, A4) to display a first 12-hour period of time ("I") on the graphical timekeeping device. A graphical date indicium 1666 displays a first value during the first 12-hour period of time.

The method further includes rotating 1702 either a plurality of physical indicator hands 108 about the central axis of rotation 104 of the timekeeping device movement 102 over a graphical timekeeping display device 1601, or graphically rotating a set of graphical indicator hands about a central point of rotation, (identified at reference number 104), within the graphical display, to display a first time T1 within the first 12-hour period of time "I" displayed on the graphical timekeeping display device 1601.

At an ending of the 12-hour time period "I," where t=12:00, replacing 1704 the first set of graphical hour indicia (e.g., A1, A2, A3, A4) on the graphical display device with a second set of graphical hour indicia, (e.g., B1, B2, B3, B4) that represent a second 12-hour period of time, "II," sequentially following the first 12-hour time period "I."

The method then includes rotating 1706 either a plurality of physical indicator hands 108 about the central axis or central point of rotation 104 of the timekeeping device movement 102 over a graphical timekeeping display device 1601, or graphically rotating a set of graphical indicator hands within the graphical display to display a second time T2 within the second 12-hour period of time "II" displayed on the graphical timekeeping display device 1601. A graphical date indicium continues to display the first value during the second 12-hour period of time.

At an end of the second 12-hour period of time "II," the graphical date indicium may be incremented 1708 to display an incremented date value reflecting the incrementing of a 24-hour period of time.

In summary, a method of displaying a series of sequential timekeeping periods for a graphical timekeeping display includes, at a beginning of a time period, displaying on the graphical timekeeping display, a first set of hour indicia 1646 that represents a first 12-hour period of time "I." A plurality of indicator hands 108 are physically or graphically rotated about a central axis or central point of rotation to display on the graphical timekeeping device 1601 a first time T1 within the first 12-hour period of time "I." At an end of the time period "I," the first set of hour indicia 1646 are replaced by displaying on the graphical timekeeping display, a second set of hour indicia 1648 that represents a second 12-hour period of time "II," the second 12-hour period of time "II" sequentially following the first 12-hour period of time "I." The plurality of indicator hands 108 then proceed to be graphically rotated about the central axis or central point of rotation 104 to display on the graphical timekeeping device 1601 a second time T2 within the second 12-hour period of time "II." Thereafter, an end of the second 12-hour period of time "II," a displayed date value 1668 is incremented on the graphical timekeeping device 1601.

Figure 29:
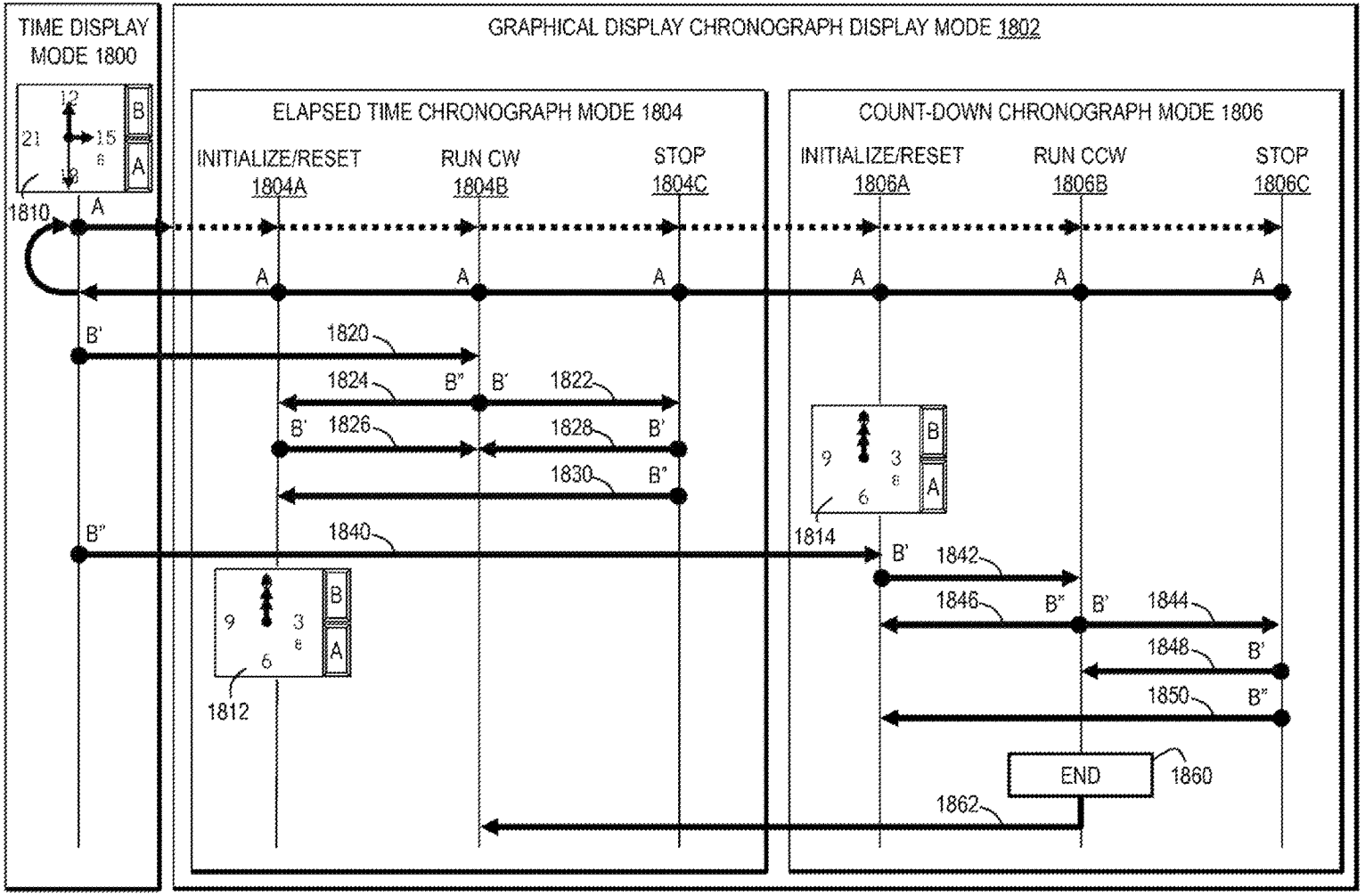
FIG. 29 illustrates a logic state diagram of a method for toggling between a time display mode of FIGS. 27-28 and a chronograph display mode of FIGS. 30-33, and selecting a particular chronograph mode in the chronograph display mode.

FIG. 29 illustrates a logic state diagram of a method for toggling a graphical display device 1810 between a graphical display time display mode 1800, (generally described in FIGS. 27-28), and a graphical display chronograph display mode 1802, and the selection of either a graphical display elapsed time chronograph sub-mode 1804 or a graphical display countdown chronograph sub-mode 1806, both described in more detail in FIGS. 30-31 and FIGS. 32-33, respectively.

A graphical display device 1810 is illustrated having a configuration similar to the embodiment described in FIG. 27. An exemplary first time is displayed on the graphical display device 1810 where hour, minute and second indicator hands are aligned at an exemplary 3 o'clock position and hour indicia displays 12-hour period of time where the actual time display may be 15:00:30. Additionally, an exemplary date is indicated on the graphical display to be the 8th day of the month. The graphical display device 1810 may also include a first actuator labeled "A" and a second actuator labeled "B." These actuators A and B may be any input device on or in communication with a processor (not shown) connected to or within the graphical display device 1810 that allows a user to provide input thereto during any display mode of the graphical display device as further described below. For example, the actuators A and B may be physical buttons on a remote device connected to the graphical display, physical buttons on the display device or a processor connected to the display device, graphical icons represented on the display device for selection by the user with another input device like a mouse or touch-pad, or graphical icons represented on a display device having a touch screen input device for selection by the user.

When the graphical display device 1810 is in a graphical display time display mode 1800, both a time of day in hours, minutes and seconds, and the day of the month is displayed on the graphical display device 1810.

The graphical display chronograph display mode 1802 consists of two representative chronograph sub-modes: a graphical display elapsed time chronograph sub-mode 1804; and a graphical display countdown chronograph sub-mode 1806. Other graphical display chronograph modes, sub-modes or functions not presented herein may be additionally accommodated in the logic control of the graphical display device 1810. Each type of graphical display sub-chronograph mode has an initialize/reset state 1804A/1806A, a run state 1804B/1806B and a stop state 1804C/1806C. As the graphical display device 1810 is operating within any of these graphical display chronograph sub-modes, when the first actuator A is actuated, the graphical display device 1810 toggles to the time display mode 1800 to display the current time. When the first actuator A is actuated again in the graphical display time display mode 1800, the graphical display device 1810 toggles back to the last operating chronograph sub-mode and last operational state the graphical display device was in. For example, if the graphical display device 1810 is in the graphical display elapsed time chronograph stop state 1804C of the graphical display elapsed time chronograph mode 1804, and the first actuator A is actuated, the graphical display device 1810 reverts back to the graphical display time display mode 1800 to display the current time. If the first actuator A is actuated again in the graphical display time display mode 1800, the graphical display device 1810 reverts back to the last operating graphical display chronograph state the graphical display device 1810 was in before the graphical display time display mode 1800 was actuated, i.e., the graphical display elapsed time chronograph stop state 1804C of the graphical display elapsed time chronograph sub-mode 1804. The dotted lines in FIG. 29 indicate this toggling function to return to the last active operational chronograph state within the chronograph display mode 802.

Operations in the graphical display elapsed time chronograph sub-mode 1804 will now be described. When the graphical display device 1810 is in the graphical display time display mode 1800 and the second actuator B is actuated in a first manner, (denoted by B', for example, pressing and quickly releasing the second actuator B), the graphical display device 1810 passes through the initialize/reset state 1804A of the graphical display elapsed time chronograph sub-mode 1804 and immediately enters 1820 the graphical display elapsed time chronograph run state 1804B. In the graphical display elapsed time chronograph run state 1804B, the graphical display device displays an elapsed time by sequentially advancing the second indicator hand, the minute indicator hand, and the hour indicator hand in a clock-wise direction and graphically displays a set of hour indicia and a date indicator in the manner previous described in the embodiments presented in FIGS. 1-14B.

In the graphical display elapsed time chronograph run state 1804B, when the second actuator B is actuated in the first manner B', the graphical display elapsed time chronograph enters 1822 a graphical display elapsed time chronograph stop state 1804C and stops registering the elapsed time. However, in the graphical display elapsed time chronograph run state 1804B, when the second actuator B is actuated in a second manner, (denoted by B", for example, pressing and holding the second actuator B for brief period of time before releasing), the graphical display elapsed time chronograph reverts back 1824 to the graphical display elapsed time chronograph initialize/reset state 1804A where the graphical display elapsed time chronograph is reset by initializing all the time and day values to null or zero values. The graphical display device 1810 in graphical display elapsed time chronograph initialize/reset state 1804A causes all the indicator hands to move to the 12 o'clock position, the hour indicia to display an initialized set of indicia showing the first or "0" hour in the 12 o'clock position, and the date indicium to display the null or "0" date position as depicted by the initialize/reset schematic diagram 1812. In the graphical display elapsed time chronograph initialize/reset state 1804A, when the second actuator B is actuated in the first manner B', the graphical display elapsed time chronograph enters 1822 the graphical display elapsed time chronograph run state 1804B as previously described above.

In the graphical display elapsed time chronograph stop state 1804C, when the second actuator B is actuated in the first manner B', the graphical display elapsed time chronograph enters 1828 back into the graphical display elapsed time chronograph run state 1804B, effectively restarting the graphical display elapsed time chronograph. However, in the graphical display elapsed time chronograph stop mode 1804C, when the second actuator B is actuated in the second manner B", the graphical display elapsed time chronograph re-enters 1830 the graphical display elapsed time chronograph initialize/reset state 1804A where the graphical display elapsed time chronograph is reset by initializing all time and date values to null or zero values as previously described above.

Operations in the graphical display countdown chronograph sub-mode 1806 will now be described. When the graphical display device 1810 is in the graphical display time display mode 1800 and the second actuator B is actuated in the second manner B", the graphical display device 1810 enters 1840 a graphical display countdown chronograph initialize/reset state 1806A. The graphical display device 1810 in the graphical display countdown chronograph initialize/reset state 1806A causes all indicator hands to move to the 12 o'clock position, the hour indicia to display an initialized position showing the first or "0" hour in the 12 o'clock position, and the date indicium to display the null or "0" date position as depicted by the initialize/reset schematic diagram 1814. The operator may then input to the graphical display device 1810 an initial countdown time through any combination of first and second actuators or other input actuation means not described herein but well known in the art. The initial countdown time may consist of any combination of seconds, minutes, hours and days that may be displayed on the graphical display device via the second, minute and hour indicator hands, the set of hour indicia and the date indicium in a similar manner as described above in FIG. 19.

After the initial countdown time has been set in the graphical display countdown chronograph initialize/reset state 1806A, when the first actuator B is actuated in a first manner B', (as described above,) the graphical display countdown chronograph enters 1842 a graphical display countdown chronograph run state 1806B and the graphical display device 1810 sequentially decrements the second indicator hand, the minute indicator hand, the hour indicator hand in a counter clock-wise direction, and displays the hour indicia and the date indicium in a manner such that their indicated values are all being decremented towards a null countdown time value of 0 days, 0 hours, 0 minutes and 0 seconds. In particular, the date indicium and hour indicia operate in a reverse manner to indicate a reverse direction of operation as described in the embodiments presented in FIGS. 1-14B.

In the graphical display countdown chronograph run state 1806B, when the second actuator B is actuated in the first manner B', the graphical display countdown chronograph enters 1844 a graphical display countdown chronograph stop state 1806C and stops counting down time from the initial countdown time value. However, in the graphical display countdown chronograph run state 1806B, when the second actuator B is actuated in the second manner B", (as described above), the graphical display countdown chronograph re-enters 1846 the graphical display countdown chronograph initialize/reset state 1806A where the graphical display countdown chronograph is reset and all time and date values are initialized to null or zero values and awaits for the user to enter a new initial countdown time value as described above.

In the graphical display countdown chronograph stop state 1806C, when the second actuator B is actuated in the first manner B', the graphical display countdown chronograph enters 1848 back into the graphical display countdown chronograph run state 1806B, effectively restarting the graphical display countdown chronograph from the last value before it was stopped. However, in the graphical display countdown chronograph stop state 1806C, when the second actuator B is actuated in the second manner B", the graphical display countdown chronograph re-enters 1850 the graphical display countdown chronograph initialize/reset state 1806A where the graphical display countdown chronograph is reset and all time and date values are initialized to null or zero values as previously described above.

When the graphical display countdown chronograph mode 1806 runs to the end 1860 of the initial countdown time value in the graphical display countdown chronograph run state 1806B, the graphical display device 1810 may cause the graphical display countdown chronograph mode 1806 to automatically switch to the graphical display elapsed time chronograph run state 1804B causing the graphical display device 1810 indicator hands, the displayed hour indicia and date indicium to resume movement in a clockwise manner to increment an elapsed time value. This dual chronograph mode feature is important for events including a preliminary countdown time period immediately before the start of an event where an elapsed time chronograph record is necessary thereafter.

Figure 30:
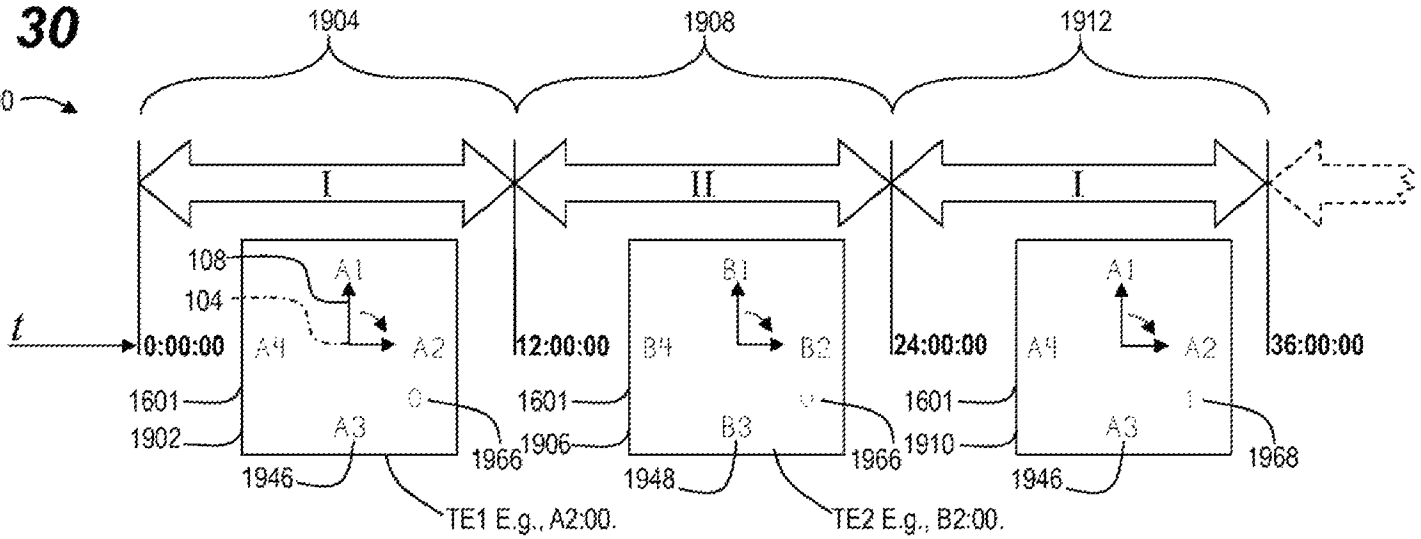
FIG. 30 illustrates a schematic diagram of an eleventh embodiment of a method of displaying an elapsed time chronograph in the chronograph display mode on a graphical display as presented in FIG. 29.
Figure 31:
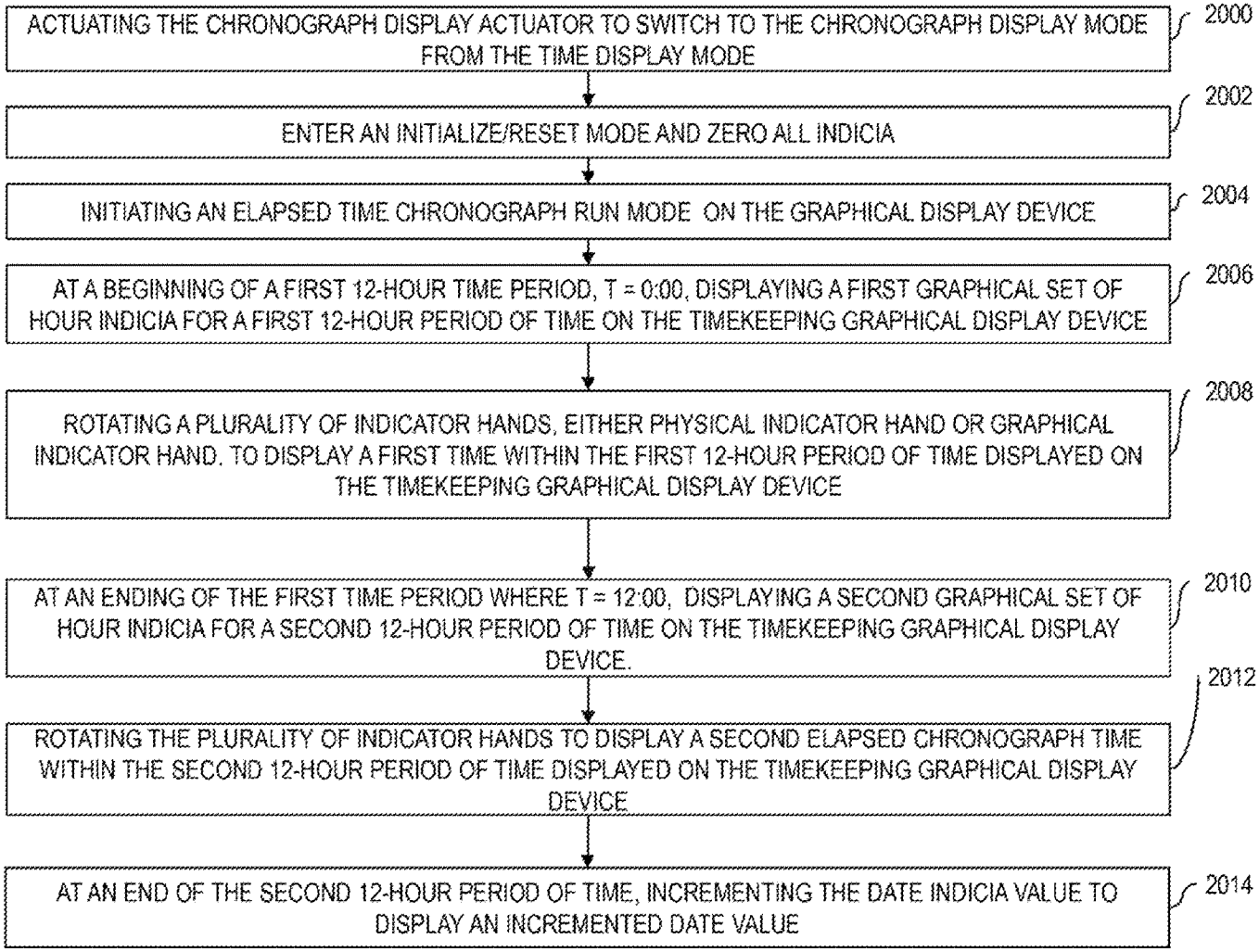
FIG. 31 illustrates a logic flowchart of the eleventh embodiment of the method of operating in an elapsed time chronograph in the chronograph display mode on a graphical display as illustrated in FIG. 30.

FIG. 30 illustrates a schematic diagram of a method for presenting a graphical display elapsed time chronograph mode 1900 (similar to ref no. 1804 in FIG. 29), for use with a graphical timekeeping display device 1601 displaying an elapsed time using two sequential 12-hour periods of time. In particular, FIGS. 30-31 illustrates a graphical timekeeping display device 1601 that may represent the same graphical information that the previously described timekeeping device embodiment of FIGS. 1-14B. Additionally, a plurality of indicator hands 108 may either be incorporated into the graphical display imagery or may be physical indicator hands that overlay the graphical timekeeping display device 1601 to indicate a specific time during one of two 12-hour timekeeping periods displayed on the graphical display.

A first graphical display 1902 illustrates an elapsed time chronograph graphical display for an elapsed time within a first 12-hour time period 1904, (represented by Roman numeral "I"), e.g., a cumulative period of time between t=0:00, and t=12:00. A first set of graphical 12-hour indicia 1946, (e.g., A1, A2, A3, A4) may be displayed with a date, or day, value of "0." In this embodiment, the date/day value of "0" of the second graphical date indicium 1968 indicates that the elapsed time chronograph has been "zeroed," that is, set to a null date value before the passing of a first 24-hour period of the elapsed time chronograph. The plurality of indicator hands 108 rotate in a clockwise direction from a 0:00 position to indicate an exemplary graphical display elapsed time of T1, (e.g., A2:00), where A2 is a third hour incremented from an hour value of A1. For example, if A1 were 0:00, then A2 would be 03:00.

A second graphical display 1906 of the graphical timekeeping display device 1601 illustrates an elapsed time chronograph graphical display with a second 12-hour time period 1908, (represented by Roman numeral "II"), of a cumulative period of time between t=12:00 and t=24:00. A second set of graphical 12-hour indicia 1948, (e.g., B1, B2, B3, B4) is displayed, while the date value displays the same first graphical date indicium 1966 null value of "0" per the first graphical display 1902. The plurality of indicator hands 108 continue to rotate in a clockwise direction to indicate an exemplary elapsed time of T2, (e.g., B2:00), where B2 is a third hour incremented from an hour value of B1. For example, if B1 were 12:00, then B2 would be 15:00.

A third graphical display 1910, similar to the first graphical display 1902, illustrates an elapsed chronograph graphical display with a third 12-hour time period 1912, (similar to the first 12-hour time period 1904, represented by Roman numeral "I"), e.g., a cumulative period of time between t=24:00 and t=36:00. The first set of graphical 12-hour indicia 1946, (e.g., A1, A2, A3, A4) is redisplayed, however, the date value now displays a second graphical date indicium 1968 value of "1" since the second instance of the first 12-hour time period is within a new 24-hour time period, thus necessitating incrementing the value of date dial indicia by a single unit value from "0" to "1".

The graphical display elapsed time chronograph mode 1900 continues to change between the first and second graphical 12-hour periods of time "I" and "II" for every 12-hour hour period thereafter, while incrementing the date indicia value one unit value for every completed first and successive second 12-hour period, that is, every 24-hour period.

FIG. 31 illustrates a logic flowchart of a method for displaying a series of sequential timekeeping periods on a graphical display device that displays an elapsed time of an elapsed time chronograph using two sequential 12-hour periods of time according to FIG. 30. The method includes actuating 2000 a graphical display chronograph actuator A to switch to a graphical display elapsed time chronograph mode 1804 of a graphical display chronograph display mode 1802 from a graphical display time display mode 1800.

The graphical display elapsed time chronograph mode 1804 enters 2002 a graphical display elapsed time chronograph initialize/reset state 1804A and zeros all the display indicia to an initial null or "0" value. A graphical display elapsed time chronograph run state 1804B is initiated 2004 on the graphical display device by an actuator. As previously described with respect to FIG. 29, the steps of initializing and running the graphical display elapsed time chronograph may be accomplished simultaneously with the actuation of the graphical display chronograph actuator A.

The method further includes, at a beginning of a first 12-hour time period, t=0:00, displaying 2006 a first graphical set of hour indicia for a first 12-hour period of time ("I") on the graphical display device.

The method further displays 2008 a plurality of indicator hands 108, (either physical indicator hand or graphical indicator hand, as previously discussed), to display an elapsed chronograph first time T1 within the first 12-hour period of time "I" displayed on the graphical display device.

At an ending of the elapsed chronograph time period "I" where t=12:00, displaying 2010 a second graphical set of hour indicia for a second 12-hour period of time ("II") on the graphical display device, the second 12-hour period of time sequentially following the first 12-hour period of time.

The plurality of indicator hands 108 are either graphically or physically rotated 2012 to display a second elapsed chronograph time T2 within the second 12-hour period of time "II" displayed on the graphical display device. At an end of the second 12-hour period of time "II," the graphical date indicia value may be incremented 2014 to display an incremented date value after two consecutive 12-hour periods of time.

In summary, a chronograph display actuator, e.g., "A," is actuated to switch the graphical timekeeping display 1601 between a time display mode 1800 and a chronograph display mode 1802. The plurality of indicator hands 108 proceed to be graphically rotated about the central axis or central point of rotation 104 to display on the graphical timekeeping device 1601 a first elapsed chronograph time TE1 within the first 12-hour period of time, "I." The plurality of indicator hands 108 proceed to be graphically rotated about the central axis or central point of rotation 104 to display on the timekeeping device 1601 a second elapsed chronograph time TE2 within the second 12-hour period of time, "II." At an end of the second 12-hour period of time "II", a displayed date value 1968 proceeds to be incremented on the graphical timekeeping device 1601.

Figure 32:
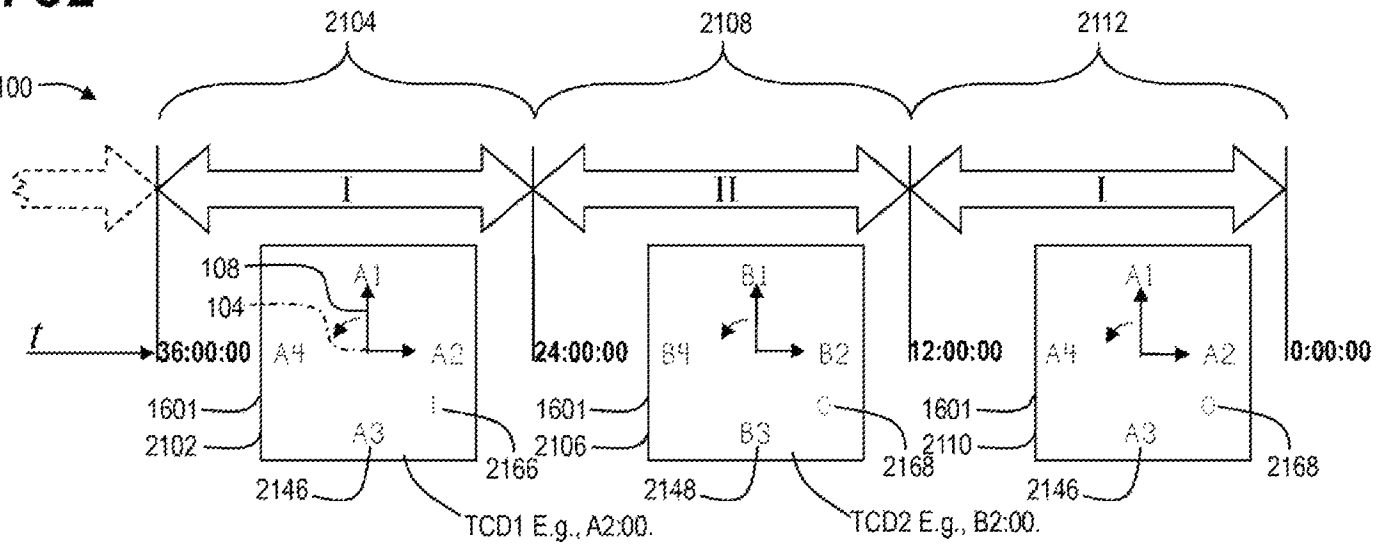
FIG. 32 illustrates a schematic diagram of a twelfth embodiment of a method of displaying a countdown chronograph in the chronograph display mode on a graphical display as illustrated in FIG. 29.
Figure 33:
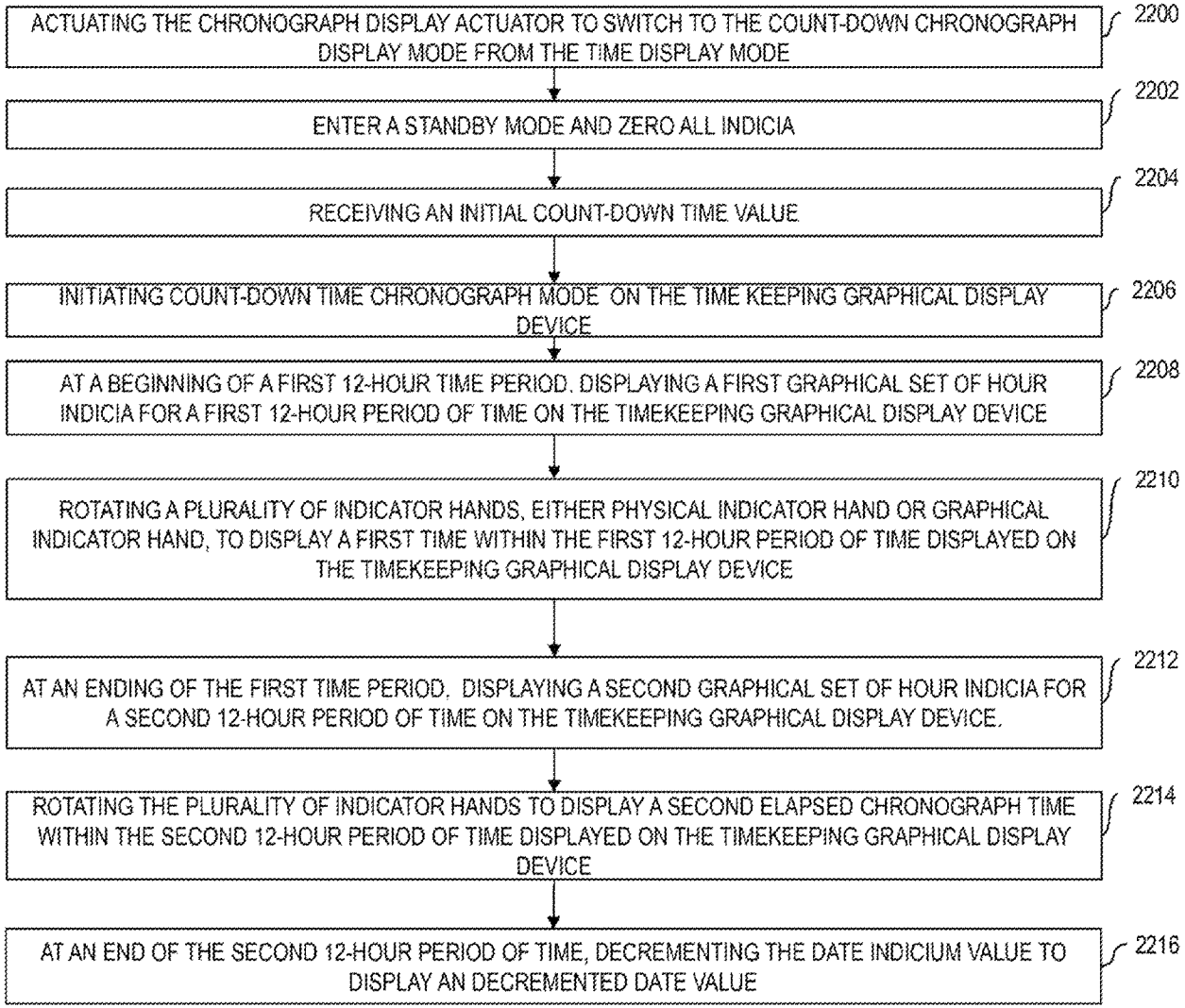
FIG. 33 illustrates a logic flowchart of the twelfth embodiment of the method of operating the countdown chronograph in the graphical display mode on a graphical display as illustrated in FIG. 32.

FIG. 32 illustrates a schematic diagram of a method of displaying a graphical display countdown chronograph in a chronograph display mode 2100 for use with a graphical timekeeping display device 1601 to display a countdown time using two sequential 12-hour periods of time. FIGS. 32-33 illustrate a graphical timekeeping display device 1601 that may represent the same graphical information that the previously described timekeeping device embodiment of FIGS. 1-14B. Additionally, a plurality of indicator hands 108 may either be incorporated into the graphical display imagery or may be physical indicator hands that overlay the graphical timekeeping display device 1601 to indicate a specific time during one of two 12-hour timekeeping periods displayed on the graphical display.

A first graphical display 2102 illustrates a countdown time chronograph graphical display for a countdown time within a first 12-hour time period 2104, (represented by Roman numeral "I"), of a countdown period of time between t=36:00, and t=24:00, where a first set of graphical 12-hour indicia 2146, (A1, A2, A3, A4) and an exemplary first graphical date indicium 2166 value of "1" are displayed. Here the first graphical date indicium 2166 value of "1" indicates that a countdown time chronograph has been set to include a first 24-hour value corresponding to a value of "1" day, that is, the date display is set to an exemplary unit date value greater than "0" before the expiration of the first 24-hour period of the countdown time chronograph. The plurality of indicator hands 108 rotate either on the graphical display device or over the graphical display device in a counterclockwise direction from an initial set countdown time position, (not shown), to indicate an exemplary countdown time of TCD1, e.g., A2:00, where A2 is a third hour incremented from an hour value of A1. For example, if A1 were 0:00 then A2 would be 03:00.

A second graphical display 2106 of the same graphical timekeeping display device 1601 illustrates a countdown time chronograph device display with a second 12-hour time period 2108, (represented by Roman numeral "II"), of a countdown period of time between t=24:00 and t=12:00 to display a second set of graphical 12-hour indicia 2148, (B1, B2, B3, B4) and a second graphical date indicium 2168 value of "0". The second graphical date indicium 2168 is decremented one unit value from a value of "1" to a value of "0" since the second 12-hour time period is within a new 24-hour time period. The plurality of indicator hands 108 continue to rotate either on the graphical display device or over the graphical display device in a counter-clockwise direction to indicate an exemplary countdown time of T2, e.g., B2:00, where B2 is a third hour incremented from an hour value of B1. For example, if B1 were 12:00, then B2 would be 15:00.

A third graphical display 2110, similar to the first graphical display 2102, illustrates a countdown chronograph device display with a third 12-hour time period 2112, (similar to the first 12-hour time period 2104, represented by Roman numeral "I"), of a period of time between t=12:00 and t=0:00 where the first set of graphical 12-hour indicia 2146, (A1, A2, A3, A4) is displayed.

The graphical display countdown chronograph in a chronograph display mode 2100 continues to alternate between the first 12-hour period "I" and the second 12-hour period "II" for every 12-hour hour period thereafter as the countdown chronograph is running, while decrementing the date indicium value once for every completed first and successive second 12-hour period, that is, every 24-hour period. As described in FIG. 29, when the countdown chronograph reaches the end 1860 of its set countdown time period, the chronograph state may automatically switch to the elapsed time chronograph run state 804B in the elapsed time chronograph state 1804.

FIG. 33 illustrates a logic flowchart of a method for displaying a series of sequential timekeeping periods on a graphical display device for displaying a countdown time of a countdown chronograph using two sequential 12-hour periods of time. The method includes actuating 2200 a chronograph actuator B to switch to the graphical display countdown chronograph mode 1806 of a graphical display chronograph display mode 1802 from a graphical display time display mode 1800. The graphical display countdown chronograph mode 1806 enters 2202 a graphical display countdown chronograph initialize/reset state 1806A and zeros all the display indicia 1814 to an initial null or "0" value. The graphical display device 1810 then receives 2204 an initial countdown time value from the user. A graphical display countdown chronograph run state 1806B in the graphical display countdown chronograph mode 1806 is initiated 2206 on the graphical display device by an actuator, e.g., B.

The method further includes, at a beginning of a first 12-hour time period, where the elapsed time is t=0:00, displaying 2208 a first graphical set of 12-hour indicia for a first 12-hour period of time ("I") on the graphical display device.

The method further rotates 2210 in a counter-clockwise direction a plurality of indicator hands 108, (either physical indicator hands or graphical indicator hands, as previously discussed), to display a countdown chronograph first time T1 within the first 12-hour period of time "I" displayed on the graphical display device while the graphical display countdown chronograph run state 1806B is active.

At an ending of the countdown chronograph time period "I" where t=12:00, the method displays 2212 a second graphical set of 12-hour indicia for a second 12-hour period of time ("II") on the graphical display device, the second 12-hour period of time sequentially following the first 12-hour period of time.

The plurality of indicator hands 108 are rotated 2214 either graphically or physically to display a second countdown chronograph time T2 within the second 12-hour period of time "II" displayed on the graphical display device. At an end of the second 12-hour period of time "II," the graphical date indicium value may be decremented 2216 to display a decremented date value after two consecutive 12-hour periods of time.

In summary, a chronograph display actuator "B" is actuated to switch the graphical timekeeping display 1601 between a time display mode 1800 to a chronograph display mode 1802, where after the plurality of indicator hands 108 proceed to be physically or graphically rotated, in a counterclockwise direction, about the central axis or central point of rotation 104 to display on the graphical timekeeping device 1601 a first countdown chronograph time TCD1 within the first 12-hour period of time, "I." The plurality of indicator hands about the central axis or central point of rotation to display on the graphical timekeeping device a second countdown chronograph time TCD2 within the second 12-hour period of time, "II." At an end of the second 12-hour period of time "II," a displayed date value 2168 proceeds to be decremented on the graphical timekeeping device 1601.

Figure 34:
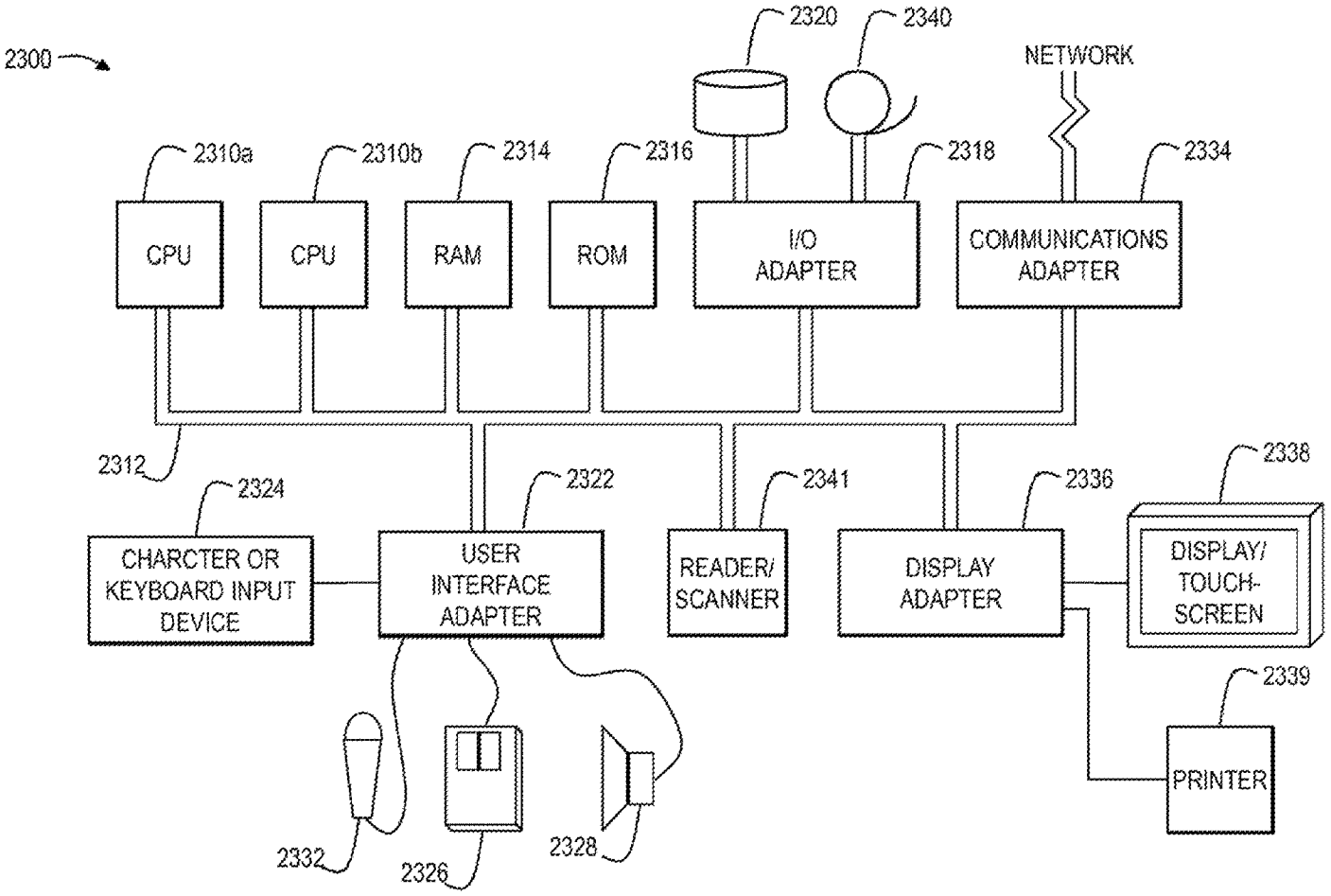
FIG. 34 illustrates a schematic diagram of a thirteenth embodiment of an exemplary hardware environment including a graphical display device that can be used to implement the embodiments described in FIGS. 27-33.

FIG. 34 illustrates a schematic diagram of an exemplary hardware environment that can be used to implement the embodiments described herein. System 2300 illustrates a typical hardware configuration which may be used for implementing the above embodiments on the graphical display device and method for displaying time and an elapsed time and countdown chronograph. The configuration has preferably at least one processor or central processing unit (CPU) 2310*a*, 2310*b*. The CPUs 2310*a*, 2310*b* are interconnected via a system bus 2312 to a random access memory (RAM) 2314, read-only memory (ROM) 2316, an input/output (I/O) adapter 2318 (for connecting peripheral devices such as disk units 2320 and tape drives 2340 to the system bus 2312), user interface adapter 2322 (for connecting a keyboard or character input device 2324, mouse 2326, speaker 2328, microphone 2332, and/or other user interface device to the system bus 2312), a communication adapter 2334 for connecting an information handling system to a data processing network, the Internet, and Intranet, a personal area network (PAN), etc., a reader/scanner 2341 and a display adapter 2336 for connecting the system bus 2312 to a display device 2338, (including a touch screen display device), and a printer 2339. The display device 2338, (similar to the graphical timekeeping display device 1601 and graphical display device 1810 of FIGS. 27-32), may configured to perform the method of graphically displaying the timekeeping features disclosed above and/or receiving input from a user from a position based touchscreen input device.

In addition to the system described above, an aspect of the embodiments presented herein includes a computer-implemented method for performing the above described methods both on a physical timekeeping device and a graphical display. As an example, these methods may be implemented in the particular environment discussed above in FIG. 34. Such methods may be implemented, for example, by operating a computer, as embodied by a digital data processing apparatus, to execute a sequence of machine-readable instructions. These instructions may reside in various types of signal-bearing media.

Such methods may be implemented, for example, by operating the at least one processor or CPU 2310*a*, 2310*b* to execute a sequence of machine-readable instructions. These instructions may reside in various types of stored signal bearing media. Thus, this aspect of the disclosed embodiments are directed to a programmed product, comprising signal-bearing media tangibly embodying a program of machine-readable instructions executable by a digital data processor incorporating the at least one processor or CPU 2310*a*, 2310*b* and hardware above, to perform the method of displaying a series of sequential timekeeping periods for a graphical timekeeping display includes, at a beginning of a time period, displaying on the graphical timekeeping display as described herein.

This stored signal-bearing media may include, for example, a RAM contained within the at least one processor or CPU 2310*a*, 2310*b*, as represented by the fast-access storage for example. Alternatively, the instructions may be contained in another signal-bearing media, such as a magnetic data storage diskette, CD-ROM or "plug-and-play" memory device, like a USB flash drive, directly or indirectly accessible by the at least one processor or CPU 2310*a*, 2310*b*.

Whether contained in the at least one processor or CPU 2310*a*, 2310*b*, or elsewhere, the instructions may be stored on a variety of machine-readable data storage media, such as storage, (e.g., a conventional "hard drive" or a RAID array), magnetic tape, electronic read-only memory, (e.g., ROM, EPROM, or EEPROM), an optical storage device (e.g., CD-ROM, WORM, DVD, digital optical tape, etc.), paper "punch" cards, or other suitable signal-bearing media.

The computer system of FIG. 34 may also be incorporated into portable computing devices that typically have a touch-screen input surface integrated with the display screen. These devices may include laptops, mobile smart-phones, tablet computers and other devices that allow users to connect to wired and or wireless networks.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method that displays a series of sequential timekeeping periods on a timekeeping device including a movement including a central axis of rotation, and a plurality of indicator hands rotationally connected to the movement at the central axis of rotation, and a chronograph display actuator that switches the timekeeping device between a time display mode and a chronograph display mode, the method comprising:

at a beginning of a time period, rotating an hour indicia dial in a first direction through an angle of 45 degrees, and aligning a first set of indicia on the hour indicia dial with a plurality of outer dial apertures of an outer dial, thereby displaying a first 12-hour period of time on the timekeeping device;

at an ending of the time period, rotating the hour indicia dial in a second direction opposite the first direction through an angle of 45 degrees, and aligning a second set of indicia on the hour indicia dial with the plurality of outer dial apertures of the outer dial, thereby displaying a second 12-hour period of time on the timekeeping device;

receiving input to actuate the chronograph display actuator to switch to the chronograph display mode from the time display mode; and rotating, based on actuating the chronograph display actuator, the plurality of indicator hands about the central axis of rotation of the movement to display a first elapsed chronograph time within the first 12-hour period of time displayed on the timekeeping device, wherein the second 12-hour period of time sequentially follows the first 12-hour period of time, and wherein the outer dial being configured adjacent to the hour indicia dial and the first and second sets of indicia.

2. The method that displays the series of sequential timekeeping periods on the timekeeping device according to claim 1, the timekeeping device including a movement including a central axis of rotation, and a plurality of indicator hands rotationally connected to the movement at the central axis of rotation, the method further including:

providing the hour indicia dial to include a first common display orientation of the first set of indicia, the first common display orientation of the first set of indicia being at an angle of 45 degrees with respect to a second common display orientation of the second set of indicia and the central axis of rotation;

rotating the plurality of indicator hands about the central axis of rotation of the movement to display a first time within the first 12-hour period of time displayed on the timekeeping device; and rotating the plurality of indicator hands about the central axis of rotation of the movement to display a second time within the second 12-hour period of time displayed on the timekeeping device.

3. The method that displays the series of sequential timekeeping periods on the timekeeping device according to claim 1, the plurality of indicator hands including a second-hand indicator hand, the method further comprising:

based on the actuating the chronograph display actuator to switch the timekeeping device from the time display mode to the chronograph display mode, causing the second-hand indicator hand to one of:

incrementally move on a second-by-second basis in the chronograph display mode when the second-hand indicator hand incrementally moves on a fraction-of-a-second by a fraction-of-a-second basis in the time display mode; and incrementally move on a fraction-of-second by a fraction-of-a-second basis in the chronograph display mode when the second-hand indicator hand incrementally moves on a second-by-second basis in the time display mode.

4. The method that displays the series of sequential timekeeping periods on the timekeeping device according to claim 1, the method further including:

rotating the plurality of indicator hands about the central axis of rotation of the movement to display a second elapsed chronograph time within the second 12-hour period of time displayed on the timekeeping device.

5. The method that displays the series of sequential timekeeping periods on the timekeeping device according to claim 1, the timekeeping device including a movement including a central axis of rotation, and a plurality of indicator hands rotationally connected to the movement at the central axis of rotation, and a date indicia dial rotatably connected to the movement, the method further including:

providing the hour indicia dial to include a first common display orientation of the first set of indicia, the first common display orientation being at an angle of 45 degrees with respect to a second common display orientation of the second set of indicia and the central axis of rotation;

providing the date indicia dial to include a plurality of date indicia values;

rotating the plurality of indicator hands about the central axis of rotation of the movement to display a first time within the first 12-hour period of time displayed on the timekeeping device;

rotating the plurality of indicator hands about the central axis of rotation of the movement to display a second time within the second 12-hour period of time displayed on the timekeeping device; and at an end of the second 12-hour period of time, rotating the date indicia dial to display an incremented date value.

6. A method that displays a series of sequential timekeeping periods on a timekeeping device including a movement including a central axis of rotation, and a plurality of indicator hands rotationally connected to the movement at the central axis of rotation, and a chronograph display actuator that switches the timekeeping device between a time display mode and a chronograph display mode, the method comprising:

at a beginning of a time period, rotating an hour indicia dial in a first direction through an angle of 45 degrees, and aligning a first set of indicia on the hour indicia dial with a plurality of outer dial apertures of an outer dial, thereby displaying a first 12-hour period of time on the timekeeping device;

at an ending of the time period, rotating the hour indicia dial in a second direction opposite the first direction through an angle of 45 degrees, and aligning a second set of indicia on the hour indicia dial with the plurality of outer dial apertures of the outer dial, thereby displaying a second 12-hour period of time on the timekeeping device;

receiving input to actuate the chronograph display actuator to switch to the chronograph display mode from the time display mode; and rotating, in a counter-clockwise direction, the plurality of indicator hands about the central axis of rotation of the movement to display a first countdown chronograph time within the first 12-hour period of time displayed on the timekeeping device, wherein the second 12-hour period of time sequentially follows the first 12-hour period of time, and wherein the outer dial being configured adjacent to the hour indicia dial and the first and second sets of indicia.

7. The method that displays the series of sequential timekeeping periods on the timekeeping device according to claim 6, the method further including:

rotating, in the counter-clockwise direction, the plurality of indicator hands about the central axis of rotation of the movement to display a second countdown chronograph time within the second 12-hour period of time displayed on the timekeeping device.

8. A method that displays a series of sequential timekeeping periods on a timekeeping device including a movement including a central axis of rotation, and a plurality of indicator hands rotationally connected to the movement at the central axis of rotation, a date indicia dial rotatably connected to the movement, and a chronograph display actuator operable to switch the timekeeping device between a time display mode and a chronograph display mode, the method comprising:

at a beginning of a time period, rotating an hour indicia dial in a first direction through an angle of 45 degrees, and aligning a first set of indicia on the hour indicia dial with a plurality of outer dial apertures of an outer dial, thereby displaying a first 12-hour period of time on the timekeeping device;

at an ending of the time period, rotating the hour indicia dial in a second direction opposite the first direction through an angle of 45 degrees, and aligning a second set of indicia on the hour indicia dial with the plurality of outer dial apertures of the outer dial, thereby displaying a second 12-hour period of time on the timekeeping device;

providing the date indicia dial to include a plurality of date indicia values; and receiving input to actuate the chronograph display actuator to switch to the chronograph display mode from the time display mode;

initiating an elapsed time chronograph mode on the timekeeping device;

rotating the date indicia dial to display a null date value in response to the initiating the elapsed time chronograph mode; and rotating the plurality of indicator hands about the central axis of rotation of the movement to display a first elapsed chronograph time within the first 12-hour period of time displayed on the timekeeping device, wherein the second 12-hour period of time sequentially follows the first 12-hour period of time, and wherein the outer dial being configured adjacent to the hour indicia dial and the first and second sets of indicia.

9. The method that displays the series of sequential timekeeping periods on the timekeeping device according to claim 8, the method further comprising:

rotating the plurality of indicator hands about the central axis of rotation of the movement to display a second elapsed chronograph time within the second 12-hour period of time displayed on the timekeeping device; and at an end of the second 12-hour period of time, rotating the date indicia dial to display an incremented date value.

10. A method that displays a series of sequential timekeeping periods on a timekeeping device including a movement including a central axis of rotation, and a plurality of indicator hands rotationally connected to the movement at the central axis of rotation, a date indicia dial rotatably connected to the movement, and a chronograph display actuator that switches the timekeeping device between a time display mode and a chronograph display mode, the method comprising:

at a beginning of a time period, rotating an hour indicia dial in a first direction through an angle of 45 degrees, and aligning a first set of indicia on the hour indicia dial with a plurality of outer dial apertures of an outer dial, thereby displaying a first 12-hour period of time on the timekeeping device;

at an ending of the time period, rotating the hour indicia dial in a second direction opposite the first direction through an angle of 45 degrees, and aligning a second set of indicia on the hour indicia dial with the plurality of outer dial apertures of the outer dial, thereby displaying a second 12-hour period of time on the timekeeping device;

receiving input to actuate the chronograph display actuator to switch from the time display mode to the chronograph display mode;

initiating a countdown chronograph mode on the timekeeping device;

rotating the date indicia dial to display an initial countdown value in response to the initiating the countdown chronograph mode; and rotating, in a counter-clockwise direction, the plurality of indicator hands about the central axis of rotation of the movement to display a first countdown chronograph time within the first 12-hour period of time displayed on the timekeeping device, wherein the second 12-hour period of time sequentially follows the first 12-hour period of time, and wherein the outer dial being configured adjacent to the hour indicia dial and the first and second sets of indicia.

11. The method that displays the series of sequential timekeeping periods on the timekeeping device according to claim 10, the method further comprising:

rotating, in the counter-clockwise direction, the plurality of indicator hands about the central axis of rotation of the movement to display a second countdown chronograph time within the second 12-hour period of time displayed on the timekeeping device.

12. The method that displays the series of sequential timekeeping periods on the timekeeping device according to claim 10, the method further comprising:

at an end of the second 12-hour period of time, rotating the date indicia dial to display a decremented date value.

* * * * *